US012250993B2

(12) United States Patent
Beers et al.

(10) Patent No.: US 12,250,993 B2
(45) Date of Patent: Mar. 18, 2025

(54) FOOTWEAR HEEL SPRING DEVICE

(71) Applicant: NIKE, Inc., Beaverton, OR (US)

(72) Inventors: Tiffany A. Beers, Portland, OR (US); John T. Dimoff, Portland, OR (US); Wade Flanagan, Portland, OR (US); Austin Orand, Portland, OR (US); George A. Xanthos, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/545,305

(22) Filed: Dec. 19, 2023

(65) Prior Publication Data

US 2024/0115003 A1 Apr. 11, 2024

Related U.S. Application Data

(60) Continuation of application No. 18/475,045, filed on Sep. 26, 2023, now Pat. No. 12,121,103, which is a (Continued)

(51) Int. Cl.

| | |
|---|---|
| ***A43B 11/00*** | (2006.01) |
| ***A43B 3/00*** | (2022.01) |
| ***A43B 11/02*** | (2006.01) |
| ***A43B 13/18*** | (2006.01) |
| ***A43B 13/28*** | (2006.01) |
| ***A43B 13/41*** | (2006.01) |

(Continued)

(52) U.S. Cl.

CPC ..... *A43B 21/28* (2013.01); *A43B 3/0036* (2013.01); *A43B 3/0063* (2013.01); *A43B 11/00* (2013.01); *A43B 11/02* (2013.01); *A43B 13/181* (2013.01); *A43B 13/28* (2013.01); *A43B 13/41* (2013.01); *A43B 23/08* (2013.01); *A43B 23/088* (2013.01)

(58) Field of Classification Search

CPC ..... A43B 11/00; A43B 23/08; A43B 23/088
USPC ..... 36/68, 69
See application file for complete search history.

(56) References Cited

U.S. PATENT DOCUMENTS 970,381 A * 9/1910 Muller ..... A43B 23/047 36/51
1,034,960 A * 8/1912 Bilger ..... A43B 13/10 36/7.1 R (Continued)

FOREIGN PATENT DOCUMENTS

JP H01179511 U 12/1989

*Primary Examiner* — Marie D Bays
(74) *Attorney, Agent, or Firm* — Quinn IP Law

(57) ABSTRACT

A device configured to surround a portion of a foot-receiving cavity at a heel region of an article of footwear comprises a control bar having a center segment, a first side arm extending from the center segment, and a second side arm spaced from the first side arm and extending from the center segment. The control bar may include a series of slats. A base supports the control bar and is connected to the first side arm and the second side arm. The control bar is biased to an unstressed position with the center segment a first distance from the base, and elastically bends under an applied force to a loaded position with the center segment a second distance from the base less than the first distance. The device stores potential energy that returns the control bar to the unloaded position upon removal of the applied load.

16 Claims, 50 Drawing Sheets

Related U.S. Application Data continuation of application No. 18/329,705, filed on Jun. 6, 2023, now Pat. No. 11,957,210, which is a continuation of application No. 17/532,394, filed on Nov. 22, 2021, now Pat. No. 11,707,112, which is a continuation of application No. 16/720,387, filed on Dec. 19, 2019, now Pat. No. 11,213,097, which is a division of application No. 15/793,008, filed on Oct. 25, 2017, now Pat. No. 10,568,385.

(60) Provisional application No. 62/532,449, filed on Jul. 14, 2017, provisional application No. 62/413,062, filed on Oct. 26, 2016.

(51) Int. Cl.
*A43B 21/28* (2006.01)
*A43B 23/08* (2006.01)

(56) References Cited

U.S. PATENT DOCUMENTS 1,174,619 A 3/1916 Scholl
1,710,077 A 4/1929 Scholl
2,275,191 A 3/1942 Schwartz et al.
2,562,514 A 7/1951 Sibulkin et al.
2,736,110 A * 2/1956 Hardimon ..... A43B 23/08 36/58.5
3,988,842 A * 11/1976 Rathmell ..... A43B 1/0018 36/118.2
4,489,509 A * 12/1984 Libit ..... A43B 3/18 36/7.1 R
4,608,769 A 9/1986 Sturlaugson
4,727,659 A * 3/1988 Walker ..... A43B 23/30 24/177
5,054,216 A * 10/1991 Lin ..... A43B 3/00 36/138
5,604,998 A 2/1997 Kita
9,635,905 B2 5/2017 Dekovic
10,617,170 B1 * 4/2020 Arnold ..... A43B 3/0073
2002/0066213 A1 6/2002 Wells
2003/0070322 A1 4/2003 Masseron
2003/0196354 A1 * 10/2003 Chu ..... A43B 5/003 36/34 R
2005/0241179 A1 * 11/2005 Chen ..... A43B 7/085 36/3 R
2010/0319218 A1 12/2010 Auger et al.
2011/0010964 A1 1/2011 Hardy et al.
2011/0078922 A1 4/2011 Cavaliere et al.
2013/0118035 A1 5/2013 Segato et al.
2014/0373288 A1 * 12/2014 Greene ..... A43B 23/02 12/142 R
2017/0055630 A1 * 3/2017 Marshall ..... A43B 11/00
2017/0273404 A1 9/2017 Doenges et al.
2018/0103727 A1 4/2018 Fracassi
2020/0367607 A1 * 11/2020 Cheney ..... A43B 11/00
2021/0068494 A1 3/2021 Zahabian
2022/0400810 A1 * 12/2022 Cheney ..... A43B 3/00
2023/0033366 A1 * 2/2023 Farina ..... A43B 21/30
2023/0045582 A1 * 2/2023 Fuerst ..... A43B 23/088
2024/0115003 A1 * 4/2024 Beers ..... A43B 11/02
2024/0122300 A1 * 4/2024 Farina ..... A43B 11/00

* cited by examiner

FOOTWEAR HEEL SPRING DEVICE

CROSS-REFERENCE TO RELATED APPLICATIONS

This application is a continuation of U.S. patent application Ser. No. 18/475,045, filed Sep. 26, 2023, which is a continuation of U.S. patent application Ser. No. 18/329,705, filed Jun. 6, 2023, which is a continuation of U.S. patent application Ser. No. 17/532,394, filed Nov. 22, 2021, now U.S. Pat. No. 11,707,112, issued Jul. 25, 2023, which is a continuation of U.S. application Ser. No. 16/720,387, filed Dec. 19, 2019, now U.S. Pat. No. 11,213,097, issued Jan. 4, 2022, which is a divisional of U.S. application Ser. No. 15/793,008, filed Oct. 25, 2017, now U.S. Pat. No. 10,568, 385, issued Feb. 25, 2020, which claims the benefit of priority to U.S. Provisional Application No. 62/413,062, filed Oct. 26, 2016, and also claims the benefit of priority to U.S. Provisional Application No. 62/532,449, filed Jul. 14, 2017, and all of which are incorporated by reference in their entirety.

TECHNICAL FIELD

The present teachings generally include a heel spring device for an article of footwear.

BACKGROUND

Traditionally, placing footwear on a foot often requires the use of one or both hands to stretch the ankle opening of a footwear upper, and hold the rear portion during foot insertion, especially in the case of a relatively soft upper and/or an upper that does not have a heel counter secured to a flexible fabric rearward of the ankle opening.

DESCRIPTION

Figure 1:
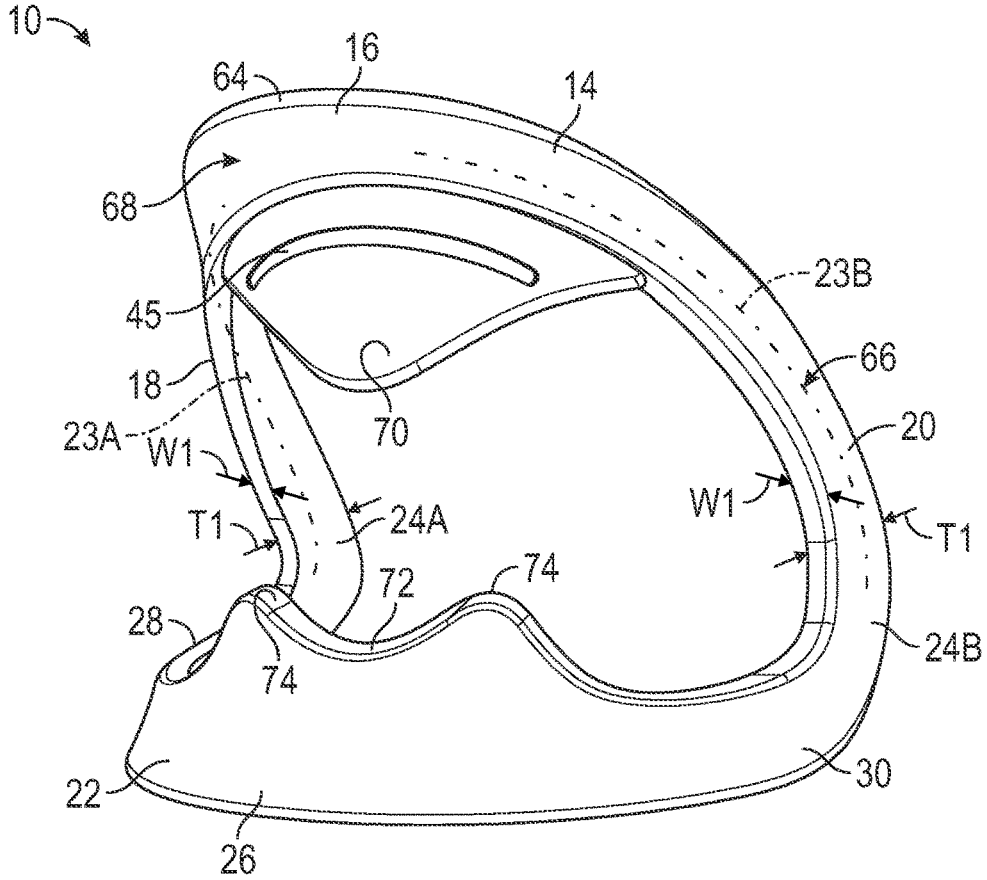
FIG. 1 is a schematic illustration in perspective view of a heel spring device for an article of footwear in an unloaded position.

Heel spring devices for easing foot entry into an article of footwear are disclosed herein. Each of the heel spring devices may enable hands-free foot entry, such as by loading the heel spring device with the foot to access a foot-receiving cavity from a rearward position, and sliding the foot forward and downward into the foot-receiving cavity.

Within the scope of the present disclosure, a device for easing foot entry into a foot-receiving cavity of an article of footwear is configured to surround a portion of the foot-receiving cavity at a heel region of an article of footwear and comprises a control bar having a center segment, a first side arm extending from the center segment, and a second side arm spaced from the first side arm and extending from the center segment. A continuous base may support the control bar and may be connected to both of the first side arm and the second side arm. The control bar is biased to an unloaded position with the center segment a first distance from the base, and elastically deforms under an applied force to a loaded position with the center segment a second distance from the base less than the first distance. The device stores potential energy that returns the control bar to the unstressed position upon removal of the applied load.

In one or more embodiments of the device, the base is connected to the first side arm at a first joint, and the base is connected to the second side arm at a second joint. The joints may be referred to herein as hinged joints, or as a hinged junction.

The device, including the control bar and the base, may be a single, unitary, one-piece component. For example, in one or more embodiments, the control bar has an arced shape, and the base has an arced shape. Accordingly, the control bar and the base are configured as a full elliptical leaf spring.

In one or more embodiments of the device, the base has a center segment, a first base arm, and a second base arm all disposed in a common plane. The first base arm is spaced apart from the second base arm and both extend from the center segment of the base. The first base arm and the first side arm are connected at the first joint. The second base arm and the second side arm are connected at the second joint. The first side arm and the second side arm extend at an acute angle to the common plane of the base when the control bar is in the unloaded position. The first side arm and the second side arm extend at a second acute angle to the common plane of the base when the control bar is depressed. The second acute angle is less than the first acute angle.

In one or more embodiments of the device, the first side arm and the second side arm bow apart from one another when the control bar is in the loaded position. With a footwear upper attached to the side arms, a foot-receiving cavity of the footwear upper is opened wider when the side arms bow apart, thus further easing foot entry into the foot-receiving cavity.

In one or more embodiments of the device, one of the control bar and the base has an extension that extends toward the other of the control bar and the base. The extension is spaced apart from the other of the control bar and the base when the control bar is in the unstressed position, and contacts the other of the control bar and the base when the control bar is in the loaded position, limiting further depression of the control bar. The extension thus limits the amount of deformation, such as by preventing the second angle from becoming too small, thereby preventing plastic deformation.

In one or more embodiments of the device, the center segment of the control bar has an extension extending toward the base, and the base has a recess. The extension is spaced apart from the base when the control bar is in the unloaded position, and protrudes into the recess when the control bar is depressed to the loaded position. Interfacing the control bar and the base via the extension and the recess also limits side-to-side movement of the control bar relative to the base.

In one or more embodiments of the device, the center segment of the control bar has a ramped surface that declines toward an inner periphery of the center segment between the first side arm and the second side arm. The ramped surface helps direct the foot downward and forward into the foot-receiving cavity during application of the downward force on the control bar.

In one or more embodiments of the device, the first side arm and the second side arm are each twisted outwardly along their respective longitudinal axis from the base to the center segment of the control bar. The outward twist helps to encourage the down and back movement of the center segment during loading by the foot.

In one or more embodiments of the device, the first side arm and the second side arm are asymmetrical about a longitudinal axis extending between the first side arm and the second side arm through the base. For example, the first side arm may be a medial side arm and the second side arm may be a lateral side arm. The medial side arm may be shorter than the lateral side arm and may have a greater lateral curvature than the lateral side arm, similar to the shape of a typical heel region of a foot.

In one or more embodiments of the device, the base has an inwardly-extending flange. For example, the flange may be seated in the recess and secured to the foot-receiving surface of a footwear sole structure in a heel region of the sole structure.

In one or more embodiments of the device, a footwear sole structure may have an outer wall with a recess in the heel region, and the base of the device may at least partially nest in the recess and be secured to the outer wall of the sole structure.

In one or more embodiments of the device, the base may underlie the control bar with the first side arm at a medial side of a footwear upper that defines at least a portion of an ankle opening, the second side arm at a lateral side of the footwear upper, and the center segment of the control bar rearward of the ankle opening of a footwear upper.

In one or more embodiments of the device, a forwardmost portion of an inner surface of the first side arm includes a medial recess such that the first side arm is thinner at the medial recess than rearward of the medial recess, and a forwardmost portion of an inner surface of the second side arm includes a lateral recess such that the second side arm is thinner at the lateral recess than rearward of the lateral recess. The upper may be secured to the first side arm at the medial recess and to the second side arm at the lateral recess.

In one or more embodiments of the device, the center segment has an aperture, and the footwear upper includes a tab that extends through the aperture. The tab may be secured to a rear portion of the footwear upper. A pin may be secured to the tab rearward of the aperture. The tab with the pin thereon may be wider than the aperture such that the tab is anchored to the center segment by the pin.

In one or more embodiments of the device, a lever may extend outward from the control bar. The lever may facilitate depression of the control bar.

In one or more embodiments, the heel device comprises a bladder element including one or more fluid-filled interior cavities. The one or more fluid-filled interior cavities may include cavities extending along the center segment. The cavities extending along the center segment may also extend along either or both of the first side arm or the second side arm, and may be tubular or other shapes. The one or more fluid-filled interior cavities may also include one or more reservoirs disposed at either or both of the first side arm and the second side arm and in fluid communication with the cavities extending along the center segment. The one or more reservoirs expand with fluid displaced from the cavities extending along the center segment when the heel spring device resiliently deforms under the applied force.

The base of the device may be secured to a flexible footwear upper that defines at least a portion of an ankle opening such that the base underlies the control bar with the first side arm at a medial side of the footwear upper, the second side arm at a lateral side of the footwear upper, and the center segment of the control bar rearward of the ankle opening. The base may extend around a rearmost portion of the footwear upper from the lateral side to the medial side. The control bar may be embedded within the footwear upper.

The flexible footwear upper may define a foot-receiving void (also referred to as a foot-receiving cavity), and the base may underlie the foot-receiving void. The base may couple to forwardmost portions of the first side arm and the second side arm. The base may extend rearward from the control bar, the base may extend forward from the control bar, or the base may extend both rearward from and forward from the control bar.

In one or more embodiments, the base has a forward-extending protrusion underlying the foot-receiving void adjacent the medial side of the footwear upper, and a rearward extending protrusion underlying the foot-receiving void along the lateral side of the footwear upper.

In one or more embodiments, a sole structure is secured to the footwear upper and underlies the foot-receiving void. The sole structure has a foot-facing surface with a recess, the base has a main portion and a protrusion extending from the main portion, and the protrusion is configured to seat within the recess.

In one or more embodiments of the device, the center segment of the control bar has an aperture. A heel pull tab of a footwear upper may extend through the aperture to further secure the footwear upper to the device. The device may have thinned portions that enable stitching of the device to the footwear upper through the thinned portions.

In one or more embodiments of the device, the control bar is embedded within the footwear upper. For example, the device may be covered by and between layers of a flexible covering of the footwear upper.

In one or more embodiments of the device, the base of the device is a sole structure of an article of footwear. In another embodiment of the device, the base is a flexible footwear upper. In such an embodiment, the upper provides resilient flexing at the junction with the control bar.

In one or more embodiments of the device, the first side arm and the second side arm each have at least one slot extending therethrough. In one or more embodiments, the at least one slot extending through the first side arm may extend through the first side arm along a length of the first side arm, and the at least one slot extending through the second side arm may through the second side arm along a length of the second side arm. In an alternative embodiment, the at least one slot extending through the first side arm extends transverse to a length of the first side arm, and the at least one slot extending through the second side arm extends transverse to a length of the second side arm.

Within the scope of the present disclosure, a heel spring device for easing foot entry into an article of footwear is configured to surround a portion of a foot-receiving cavity at a heel region of an article of footwear and comprises a control bar and a base underlying the control bar. In one or more embodiments, the control bar includes a series of slats. Each slat has a center segment, a medial side arm extending from the center segment to a medial end connected to a medial side of the base, and a lateral side arm extending from the center segment to a lateral end connected to a lateral side of the base. The control bar is biased to an unloaded position and elastically bends under an applied force to a loaded position in which at least one center segment is closer to the base than in the unloaded position, storing potential energy that returns the control bar to the unloaded position upon removal of the applied load. For example, the control bar and the base may be configured as a full elliptical leaf spring.

The device stores potential energy, such as elastic energy and/or spring energy, which returns the control bar to the unstressed position upon removal of the applied load. As used herein, elastic bending may also be referred to as resilient bending, and entails resilient deformation or elastic deformation. For example, a foot can press down on the control bar, and slip into the foot-receiving cavity of an attached footwear upper without requiring the use of a hand or of any tool to adjust the upper for foot entry.

In one or more embodiments of the device, the control bar defines slots extending between the slats. The slats are spaced apart from one another by the slots when the control bar is in the unloaded position. The slots may close between the slats so that one or more adjacent center segments contact one another in the loaded position. The slots may be parallel with one another, and exterior sides of the slats may be flush with one another in the unloaded position.

In one or more embodiments of the device, a lowermost one of the slats closest to the base at the center segment is shorter from the medial end to the lateral end than an uppermost one of the slats furthest from the center segment. In one or more embodiments, the lowermost one of the slats is thinner than the uppermost one of the slats. In one or more embodiments of the device, a lowermost one of the slats has a tab extending from a lower edge of the center segment. The outer surface of the base may have a peripheral recess extending from a lower edge of the base. For example, the peripheral recess may receive a flange of a sole structure.

In one or more embodiments of the device, a resilient insert at least partially fills the slots. The resilient insert may comprise a resiliently compressible material, such as at least one of rubber or thermoplastic polyurethane, and may be a foam, but is not limited to these materials. The resilient insert may include a sleeve extending along an inner side of the slats, and spaced protrusions extending from the sleeve into the slots. In one or more embodiments of the device, the resilient insert is configured as bellows that extend outward between the slats from an inner side of the slats.

Within the scope of the present disclosure, a heel spring device for easing foot entry into an article of footwear is configured to surround a portion of a foot-receiving cavity at a heel region of an article of footwear and comprises an elastic corrugated body including a center segment, a medial side arm extending forwardly from the center segment, and a lateral side arm extending forwardly from the center segment. The corrugated body may include alternating ridges and grooves that extend lengthwise along the medial side arm, the center segment, and the lateral side arm. The corrugated body is biased to an unloaded position and compresses under an applied force to a loaded position in which adjacent ones of the alternating ridges are closer to one another than in the unloaded position, storing elastic energy that returns the corrugated body to the unloaded position upon removal of the applied load.

For example, the corrugated body may comprise bellows. The ridges may be pleats of the bellows and the grooves may be folds of the bellows. The corrugated body may be an elastically deformable material, such as at least one of rubber or thermoplastic polyurethane, and may be a resilient foam (e.g., a polymer foam material, etc.), but is not limited to these materials.

In one or more embodiments of the device, a first set of the ridges and grooves extend from the medial side arm to the lateral side arm, and a second set of the ridges and grooves extend only along the center segment.

The device may include an upper flange extending along an upper edge of the corrugated body at the center segment, and may further comprise a lower flange extending along a lower edge of the corrugated body at the medial arm, the center segment, and the lateral arm.

Within the scope of the present teachings, an article of footwear comprises an upper defining at least a portion of an ankle opening, a sole structure secured to and underlying the upper, and a heel spring device. The heel spring device may comprise a center segment secured to the upper rearward of the ankle opening, a medial side arm extending downwardly and forwardly from the center segment, a lateral side arm extending downwardly and forwardly from the center segment, and a base connected to both of the medial side arm and the lateral side arm. The base may be secured to the sole structure. The center segment is biased to an unloaded position and the heel spring device elastically deforms under an applied force to a loaded position in which the center segment is closer to the base than in the unloaded position. The heel spring device stores elastic energy that returns the center segment to the unloaded position upon removal of the applied load, and the upper moves with the center segment such that the ankle opening is closer to the sole structure when the center segment is in the loaded position than when the center segment is in the unloaded position.

In one or more embodiments of the article of footwear, the sole structure includes a midsole, and the base is partially recessed into the midsole.

In one or more embodiments of the article of footwear, the medial side arm is secured to a medial side of the upper, and the lateral side arm is secured to a lateral side of the upper. The medial side arm and the lateral side arm may bow laterally outward and apart from one another when the center segment is in the loaded position, widening the ankle opening.

In one or more embodiments of the article of footwear, the center segment is spaced apart from the base in the unloaded position, and the device is characterized by the absence of a rigid heel counter between the center segment and the base aft of a junction of the medial side arm and the base, and aft of a junction between the lateral side arm and the base.

In one or more embodiments of the article of footwear, the medial side arm and the lateral side arm are each twisted outwardly along their respective longitudinal axis from the base to the center segment.

In one or more embodiments of the article of footwear, one of the center segment and the base has an extension that extends at least partially toward the other of the center segment and the base. The extension is spaced apart from the other of the center segment and the base when the center segment is in the unloaded position. The extension may extend from the center segment at least partially toward the base. The base may have a recess. The extension may be spaced apart from the base when the center segment is in the unloaded position, and may protrude into the recess when the center segment is in the loaded position.

In one or more embodiments of the article of footwear, the extension extends from the center segment at least partially toward the base, and the article of footwear further comprises a strap having a proximal end secured to the upper and a pocket at a distal end. The extension is disposed in the pocket. The strap may be outward of the center segment.

In one or more embodiments of the article of footwear, an outer surface of the base has a peripheral recess extending from a lower edge of the base. The sole structure has a flange seated in the peripheral recess.

In one or more embodiments of the article of footwear, the heel spring device comprises a bladder element including one or more fluid-filled interior cavities. The one or more fluid-filled interior cavities may include cavities extending along the center segment. The cavities extending along the center segment may also extend along either or both of the medial side arm or the lateral side arm, and may be tubular or other shapes. The one or more fluid-filled interior cavities may also include one or more reservoirs disposed at either or both of the medial side arm and the lateral side arm and in fluid communication with the cavities extending along the center segment. The one or more reservoirs expand with fluid displaced from the cavities extending along the center segment when the heel spring device resiliently deforms under the applied force.

In one or more embodiments of the article of footwear, the center segment has a ramped surface that declines toward an inner periphery of the center segment between the medial side arm and the lateral side arm. In one or more embodiments, the heel spring device is a single, unitary, one-piece component.

In one or more embodiments, a footwear upper comprises a flexible covering defining at least a portion of an ankle opening. The footwear upper includes a heel spring device comprising a control bar having a center segment secured to the flexible covering rearward of the ankle opening, a medial side arm extending from the center segment and secured to a medial side of the flexible covering, and a lateral side arm extending from the center segment and secured to a lateral side of the flexible covering. The heel spring device may further comprise a continuous base supporting the control bar and connected to both of the medial side arm and the lateral side arm. The control bar is biased to an unloaded position with the center segment a first distance from the base, the control bar elastically deforms under an applied force to a loaded position with the center segment a second distance from the base less than the first distance, and the device stores potential energy that returns the control bar to the unloaded position upon removal of the applied load.

In one or more embodiments of the footwear upper, the flexible covering is an elastically stretchable fabric, and the footwear upper further comprises a collar secured to the flexible covering and defining a front portion of the ankle opening. The collar is stiffer than the elastically stretchable fabric.

In one or more embodiments, the footwear upper further comprises a heel pull tab secured to the flexible covering. The center segment of the control bar has an aperture, and the heel pull tab extends through the aperture.

In one or more embodiments of the footwear upper, the medial side arm and the lateral side arm bow laterally outward and apart from one another when the center segment is in the loaded position, widening the ankle opening of the flexible covering.

In one or more embodiments, the footwear upper is characterized by the absence of a rigid heel counter between the control bar and the base aft of a junction between the control bar and the base.

In one or more embodiments of the footwear upper, the medial side arm and the lateral side arm are each twisted outwardly along their respective longitudinal axis from the base to the center segment of the control bar.

In one or more embodiments of the footwear upper, one of the control bar and the base has an extension that extends toward the other of the control bar and the base. The extension is spaced apart from the other of the control bar and the base when the control bar is in the unloaded position, and contacts the other of the control bar and the base when the control bar is in the loaded position, limiting further depression of the control bar.

In one or more embodiments of the footwear upper, the center segment of the control bar has an extension extending toward the base, the base has a recess. The extension is spaced apart from the base when the control bar is in the unstressed position, and protrudes into the recess when the control bar is in the loaded position.

In one or more embodiments, the footwear upper comprises a bladder element including one or more fluid-filled interior cavities. The one or more fluid-filled interior cavities may include cavities extending along the center segment. The cavities extending along the center segment may also extend along either or both of the medial side arm or the lateral side arm, and may be tubular or other shapes. The one or more fluid-filled interior cavities may also include one or more reservoirs disposed at either or both of the medial side arm and the lateral side arm and in fluid communication with the cavities extending along the center segment. The one or more reservoirs expand with fluid displaced from the cavities extending along the center segment when the heel spring device resiliently deforms under the applied force.

In one or more embodiments of the footwear upper, the center segment of the control bar has a ramped surface that declines toward an inner periphery of the center segment between the medial side arm and the lateral side arm.

In one or more embodiments of the footwear upper, the heel spring device is a single, unitary, one-piece component.

In one or more embodiments, an article of footwear comprises a footwear upper that includes a flexible covering defining at least a portion of an ankle opening. The article of footwear further comprises a sole structure secured to and underlying the footwear upper, and a heel spring device. The heel spring device may comprise a control bar having a center segment secured to the flexible covering rearward of the ankle opening, a medial side arm extending downwardly and forwardly from the center segment, and a lateral side arm extending downwardly and forwardly from the center segment and. The heel spring device may further comprise a continuous base supporting the control bar and connected to both of the medial side arm and the lateral side arm. The base may be secured to the sole structure. The control bar is biased to an unloaded position with the center segment a first distance from the base, the control bar elastically bends under an applied force to a loaded position with the center segment a second distance from the base less than the first distance, and the device stores elastic energy that returns the control bar to the unloaded position upon removal of the applied load. The flexible covering moves with the control bar.

In one or more embodiments of the article of footwear, the sole structure includes a midsole, and the base is partially recessed into the midsole. In one or more embodiments of the article of footwear, the medial side arm is secured to a medial side of the flexible covering, and the lateral side arm is secured to a lateral side of the flexible covering. In one or more embodiments of the article of footwear, the medial side arm and the lateral side arm bow laterally outward and apart from one another when the center segment is in the loaded position, widening the ankle opening of the flexible covering. In one or more embodiments of the article of footwear, the article of footwear is characterized by the absence of a rigid heel counter between the control bar and the base aft of a junction between the control bar and the base.

In one or more embodiments of the article of footwear, the medial side arm and the lateral side arm are each twisted outwardly along their respective longitudinal axis from the base to the center segment of the control bar. In one or more embodiments of the article of footwear, one of the control bar and the base has an extension that extends toward the other of the control bar and the base. The extension is spaced apart from the other of the control bar and the base when the control bar is in the unloaded position, and contacts the other of the control bar and the base when the control bar is in the loaded position, limiting further depression of the control bar.

In one or more embodiments of the article of footwear, the extension extends from the center segment of the control bar toward the base, the base has a recess, and the extension is spaced apart from the base when the control bar is in the unloaded position, and protrudes into the recess when the control bar is in the loaded position. In one or more embodiments of the article of footwear, the center segment of the control bar has a ramped surface that declines toward an inner periphery of the center segment between the medial side arm and the lateral side arm. In one or more embodiments of the article of footwear, the device is a single, unitary, one-piece component.

In one or more embodiments, an article of footwear comprises a footwear upper including a flexible covering defining at least a portion of an ankle opening, a sole structure secured to and underlying the footwear upper, and a heel spring device. The heel spring device may comprise a control bar having a center segment secured to the flexible covering rearward of the ankle opening, a medial side arm extending downwardly and forwardly from the center segment along a medial side of the footwear upper, and a lateral side arm extending downwardly and forwardly from the center segment along a medial side of the footwear upper. The heel spring device may further comprise a mechanical spring operatively connected to the control bar and biasing the control bar to an unloaded position. The control bar may pivot rearward under an applied force to a loaded position, storing potential energy in the spring that returns the control bar to the unloaded position upon removal of the applied load, the flexible covering moving with the control bar.

In one or more embodiments of the article of footwear, a pin is connected to both of the medial side arm and the lateral side arm and extends through the sole structure. The spring is wound around the pin and has an end fixed to pivot with the control bar and another end fixed relative to the control bar.

In one or more embodiments, an article of footwear comprises a footwear upper including a flexible covering defining at least a portion of an ankle opening, and a sole structure secured to and underlying the footwear upper. The article of footwear may further comprise a heel spring device. The heel spring device may comprise a rear control bar that has a center segment secured to the flexible covering rearward of the ankle opening, a medial side arm extending downwardly and forwardly from the center segment along a medial side of the footwear upper, and a lateral side arm extending downwardly and forwardly from the center segment along a medial side of the footwear upper. The heel spring device may further comprise a front bar that has a center segment secured to the flexible covering forward of the ankle opening, a medial side arm extending downwardly and rearwardly from the center segment along a medial side of the footwear upper, and a lateral side arm extending downwardly and rearwardly from the center segment along a medial side of the footwear upper. The front bar and the rear control bar may cross at and be fixed to one another at the lateral side of the footwear upper and at the medial side of the footwear upper. The rear control bar pivots rearward under an applied force to a loaded position, storing potential energy that returns the front bar to the unloaded position upon removal of the applied load, the flexible covering moving with the rear control bar.

Within the scope of the present teachings, an article of footwear comprises a footwear upper including a flexible covering defining at least a portion of an ankle opening, a sole structure secured to and underlying the footwear upper, and a heel spring device. The heel spring device may comprise a control bar and a continuous base. The control bar may have a center segment secured to the flexible covering rearward of the ankle opening, a medial side arm extending from the center segment and secured to a medial side of the flexible covering, and a lateral side arm extending from the center segment and secured to a lateral side of the flexible covering. The base may support the control bar and may be connected to both of the medial side arm and the lateral side arm and secured to the sole structure. The control bar is biased to an unloaded position with the center segment a first distance from the base, and elastically bends under an applied force to a loaded position with the center segment a second distance from the base less than the first distance. The device stores potential energy, such as elastic energy and/or spring energy, potential energy, such as elastic energy and/or spring energy that returns the control bar to the unloaded position upon removal of the applied load, the flexible covering moving with the control bar.

Figure 5:
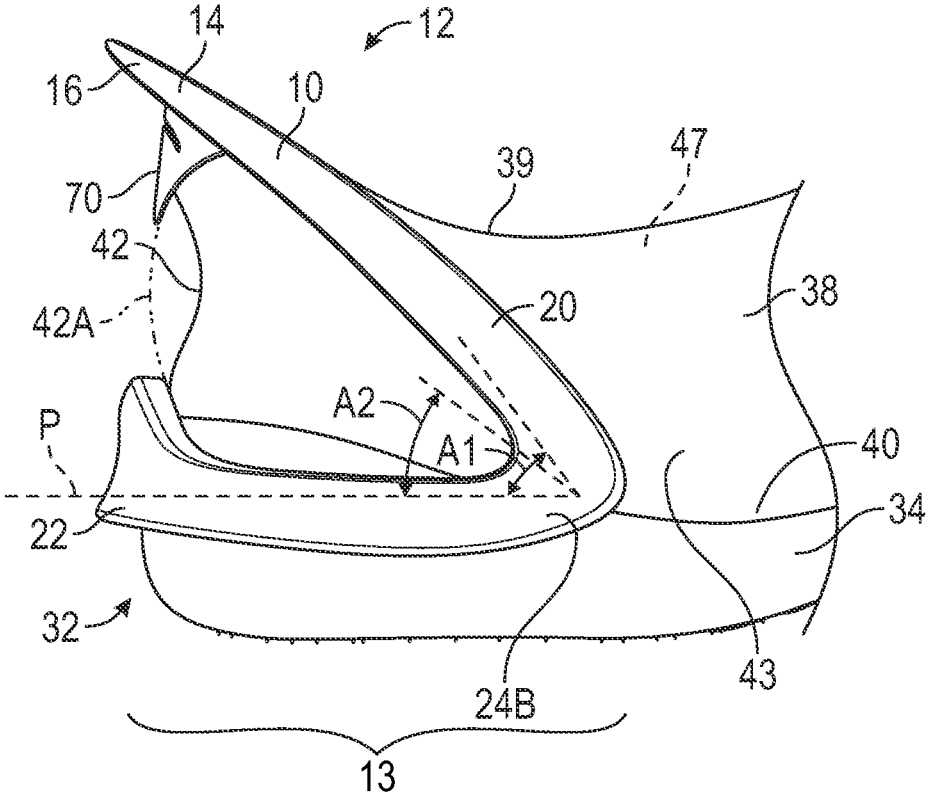
FIG. 5 is a schematic illustration in fragmentary side view of a lateral side of an article of footwear including the device, the footwear upper, and the sole layer of FIG. 4.
Figure 6:
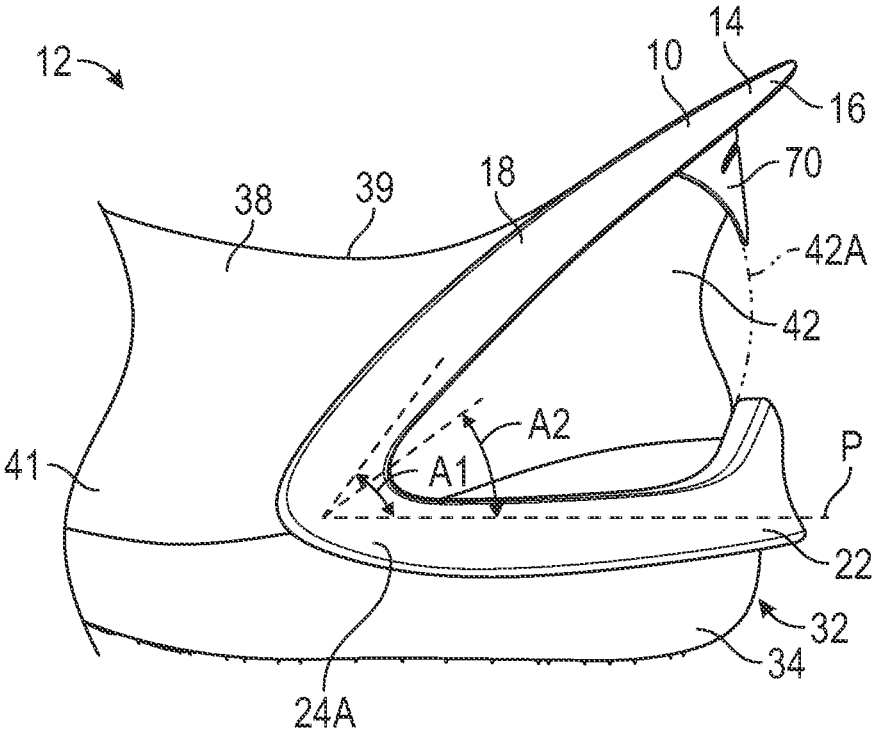
FIG. 6 is a schematic illustration in fragmentary side view of a medial side of the article of footwear of FIG. 5.

Referring to the drawings, wherein like reference numbers refer to like components, FIG. 1 shows a device 10 for easing foot entry into an article of footwear 12 shown in FIGS. 5 and 6. The footwear herein is depicted as leisure shoes and athletic shoes, but the present teachings also include an article of footwear that is a dress shoe, a work shoe, a sandal, a slipper, a boot, or any other category of footwear.

The device 10 is configured to surround a portion of a foot-receiving cavity 47 at a heel region 13 of an article of footwear 12, as shown in FIG. 5. The heel region 13 generally includes portions of the article of footwear 12 corresponding with rear portions of a human foot, including the calcaneus bone, when the human foot is supported on the sole structure 32 in the foot-receiving cavity 47 and is a size corresponding with the article of footwear 12. A forefoot region 15 of the article of footwear 12 (best shown with respect to article of footwear 312, 3212, and 3312 in FIGS. 10, 80, and 87) generally includes portions of the article of footwear 12 corresponding with the toes and the joints connecting the metatarsals with the phalanges of the human foot (interchangeably referred to herein as the "metatarsal-phalangeal joints" or "MPJ" joints). A midfoot region 17 of the article of footwear 12 (best shown with respect to article of footwear 312, 3212, and 3312 in FIGS. 10, 80, and 87) is disposed between the heel region 13 and the forefoot region 15 and generally includes portions of the article of footwear 12 corresponding with an arch area of the human foot, including the navicular joint.

The device 10 includes a control bar 14 that has a center segment 16, a first side arm 18 extending downwardly and forwardly from the center segment 16, and a second side arm 20 spaced from the first side arm 18 and also extending downwardly and forwardly from the center segment 16. The first side arm 18 is a medial side arm and the second side arm 20 is a lateral side arm.

Figure 2:
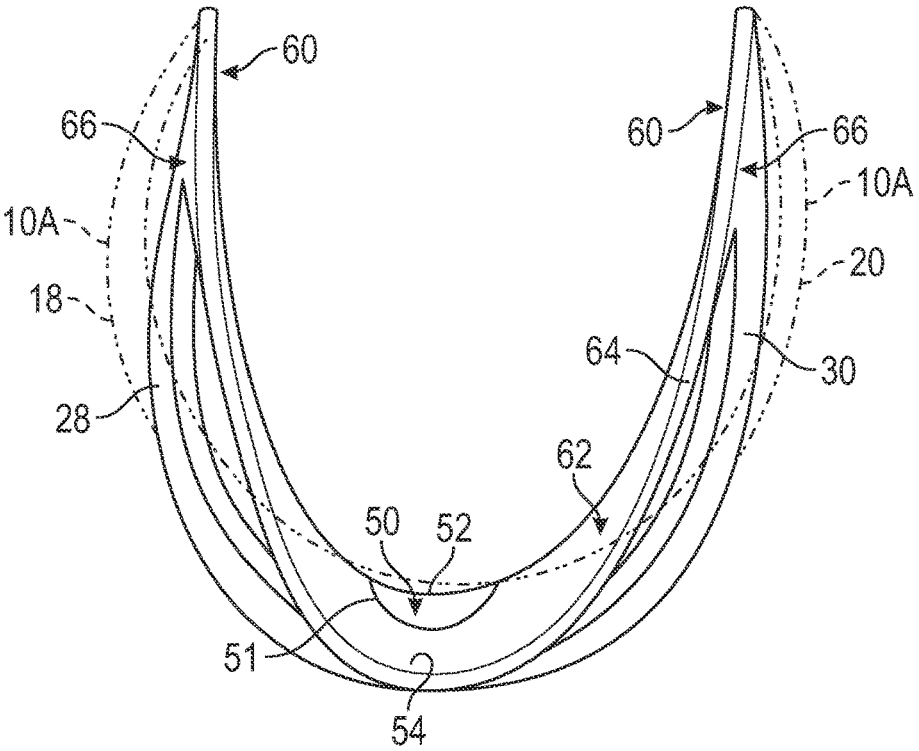
FIG. 2 is a schematic illustration in plan view of the device of FIG. 1 with a loaded position of the device shown in phantom.
Figure 3:
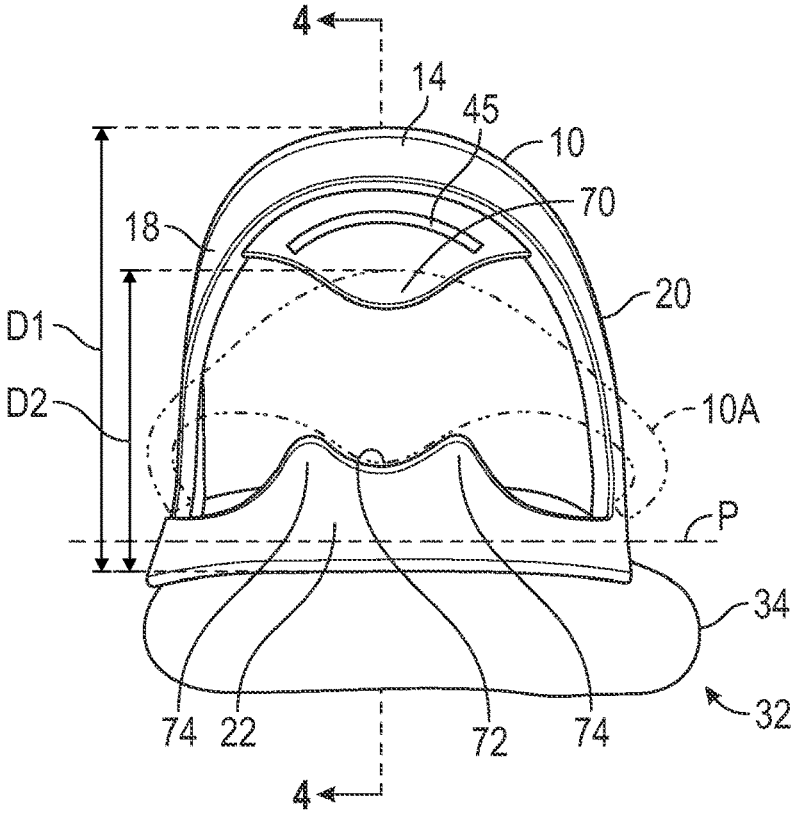
FIG. 3 is a schematic illustration in rear view of the device of FIG. 1 secured to a sole layer, and showing the loaded position in phantom.

The device 10 also includes a base 22 supporting the control bar 14 and connected to the control bar 14 at a resiliently bendable junction 24A, 24B. The base 22 is continuous and extends between and connects to the first side arm 18 and the second side arm 20. The base 22 is continuous, in that it is without breaks or connections through other components in extending from the first side arm 18 to the second side arm 20. The base 22 has a center segment 26, a first base arm 28, and a second base arm 30 all disposed in a common plane. The common plane P is parallel with a horizontal surface when the base 22 of the device 10 rests on a horizontal surface, and is best indicated in FIG. 3 by the phantom line P that represents the plane perpendicular to the page of the drawing. The first base arm 28 is spaced apart from the second base arm 30 and both extend from the center segment 26 of the base 22. As shown in FIG. 2, the base 22 is slightly under the control bar 14, lending stability to the device 10 during depression.

The junction 24A, 24B includes a first joint 24A at which the base 22 and the first side arm 18 connect, and a second joint 24B at which the base 22 and the second side arm 20 connect. The first joint 24A is the connection of the first base arm 28 to the first side arm 18. The second joint 24B is the connection of the second base arm 30 to the second side arm 20.

The control bar 14 has an arced shape from the first joint 24A to the second joint 24B. Similarly, the base 22 has an arced shape from the first joint 24A to the second joint 24B. With this arrangement, the control bar 14 and the base 22 are configured as a full elliptical leaf spring as described herein. The device may be referred to as a heel spring. Additionally, the device 10 is a single, unitary, one-piece component. For example, the device 10 may be injection molded as a single, unitary, one-piece component.

Figure 4:
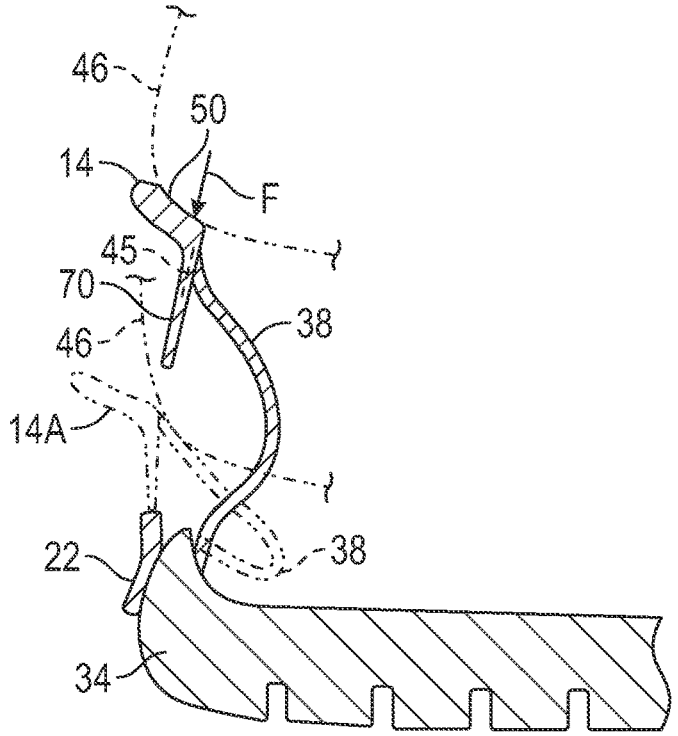
FIG. 4 is a schematic illustration in fragmentary cross-sectional view of the device and sole layer of FIG. 3 taken at lines 4-4 in FIG. 3, and showing a flexible covering of a footwear upper secured to the device.

The control bar 14 is biased to an unloaded position shown in FIGS. 1, 2 and 3. The unloaded position is also referred to herein as an unstressed position. The control bar 14 is internally biased to the unstressed position by its material in its formed state. Stated differently, the material of the control bar 14 is sufficiently rigid that it remains in the unstressed position in its natural state without external loads applied to it, and will return to the unstressed position after elastic bending due to its resiliency. In the unstressed position, the center segment 16 is a first distance D1 from the base 22, as indicated in FIG. 3 by a distance D1 from the top of the center segment 16 to the bottom of the base 22. The unstressed position is the position of the device 10 in a relaxed, unloaded state (i.e., without a vertical force applied to the control bar 14). The control bar 14 can be depressed under an applied force F shown in FIG. 4, representing the force applied by a foot 46 during insertion of the foot 46 into a foot-receiving cavity 47 (see FIGS. 5 and 6) of the article of footwear 12. When loaded in this manner, the control bar 14 elastically bends to a loaded position in which the center segment 16 is a second distance D2 from the base 22. The device 10 is indicated with phantom lines and reference number 10A in FIG. 3 when in the loaded position. The second distance D2 is less than the first distance D1. The difference between the distances D1, D2, is the deflection of the device 10, which may be but is not limited to a deflection of 30 mm. The device 10 is configured so that when it is depressed under the force to the loaded position D2, it elastically bends at the junction 24A, 24B, storing elastic energy. When the force F is removed, the stored elastic energy returns the control bar 14 to the unstressed position. In FIG. 3, only the device 10 and the sole structure 32 are shown. The upper 38 described herein is removed for clarity in showing the positions of the device 10, 10A.

As shown in FIGS. 5 and 6, the article of footwear 12 includes a sole structure 32 and an upper 38 secured to the sole structure 32. The sole structure 32 includes one or more sole components that may be sole layers 34, such as an outsole, a midsole, or a unitary combination of an outsole and a midsole that may be referred to as a unisole. In FIGS. 5 and 6, the sole layer 34 may be a midsole or a unisole. The sole layer 34 underlies the upper 38. A lower portion 40 of the footwear upper 38 is secured to the sole layer 34, such as by adhesive or otherwise. The base 22 is secured to the sole layer 34 such as by bonding with adhesive, thermal bonding, or otherwise. The sole layer 34 may be formed with slight recesses on the outer surface shaped to allow the base 22 and junction 24A, 24B to partially nest in the recesses, thus being further supported by the sole layer 34.

The flexible footwear upper 38 defines at least a portion of an ankle opening 39. The base 22 underlies the control bar 14 and is secured to the footwear upper 38 with the first side arm 18 secured to a medial side 41 of the footwear upper 38, and the second side arm 20 secured to a lateral side 43 of the footwear upper 38. As best indicated in FIGS. 5 and 6, the base 22 extends around a rearmost portion of the footwear upper from the lateral side 43 to the medial side 41. The center segment 16 of the control bar 14 is secured to the footwear upper 38 rearward of the ankle opening 39. The device 10 may have a thinned portion 45 (best shown in FIG. 3) that enables machine stitching of the upper 38 to the device at the thinned portion 45.

The upper 38 may include a flexible covering 42 (also referred to as a flexible cover layer) for receiving and covering a foot 46 (indicated in FIG. 4) to be supported on the sole layer 34. For example, the flexible covering 42 may be a stretchable fabric, such as a 4-way stretch nylon fabric, lending a light, breathable feel. The article of footwear 12 is characterized by the absence of a rigid heel counter between the control bar 14 and the base 22 aft of the junction 24A, 24B between the control bar 14 and the base 22. The device 10 functions at least in some respects as a heel counter in that it helps to retain a wearer's heel in position atop a heel portion of the sole structure, preventing medial or lateral displacement during use. Because the device 10 is secured to the flexible covering 42, the device 10 together with the flexible covering 42 of the upper 38 can together be referred to as a footwear upper. In other words, the device 10 can be considered a component of a multicomponent footwear upper that also includes the flexible covering 42 and other components of the article of footwear. The multicomponent footwear upper may also be referred to as a footwear upper assembly.

Traditionally, slipping a foot into an upper often requires the use of one or both hands to stretch the ankle opening and hold the rear portion during foot insertion, especially in the case of a relatively soft upper and/or an upper that does not have a heel counter secured to the flexible fabric rearward of the ankle opening. The device 10 alleviates these issues, and allows the foot 46 to enter into a foot-receiving cavity 47 formed by the upper 38 without the use of hands or other tools. Only the foot 46 is used to gain entry. Specifically, using the bottom of the foot 46, a force F is applied to press on the control bar 14 as shown in FIG. 4, resiliently bending the device at the joints 24A, 24B moving the control bar 14 from the unstressed position to the loaded position, which is represented by the control bar in position 14A. The upper 38 is attached to the center segment 16, and moves down with the control bar 14. The stored elastic energy due to the bias of the device 10 automatically returns the device 10 to the unstressed position when the foot 46 moves fully into the foot-receiving cavity 47, causing the upper 38 to be automatically pulled up over the back of the foot 46. The position of the stretchable flexible covering 42 prior to inserting the foot is shown in FIG. 5. The flexible covering 42 stretches over the back of the heel of the foot 46 to the position 42A represented in phantom in FIG. 5 when the device 10 returns to the unstressed position.

To further ease entry of the foot 46 into the foot-receiving cavity 47 of the upper 38, the center segment 16 of the control bar 14 has a ramped surface 50 that declines toward an inner periphery 52 of the center segment 16, as indicted in FIGS. 2 and 4. There is a change in slope of the center segment 16 at a transition line 51, between an upper portion 54 of the foot contact surface of the control bar 14 and the ramped surface 50. The ramped surface 50 has a steeper declining slope than the upper portion 54, helping the foot 46 to slide down and inward.

With reference to FIGS. 5 and 6, the first side arm 18 and the second side arm 20 extend at a first acute angle A1 to the common plane P of the base 22 when the control bar 14 is in the unstressed position. The angle A1 may be measured along a longitudinal axis of each side arm. Although shown with the same angle A1, each of the first side arm 18 and the second side arm 20 could have a first acute angle with a different numerical value. The first side arm 18 and the second side arm 20 extend at a second acute angle A2 to the common plane P of the base 22 when the control bar 14 is depressed so that the device 10 is in the position 10A of FIG. 3. The angle A2 may be measured along a longitudinal axis of each side arm. The second acute angle A2 is less than the first acute angle A1. Although shown with the same angle A2, each of the first side arm 18 and the second side arm 20 could have a second acute angle with a different numerical value.

The material of the device 10 is selected to provide the ability to elastically deform by elastic bending as described, and store potential energy, such as elastic energy, that returns the device 10 to the unstressed position. Example materials include plastics (such as thermoplastics), composites, and nylon. Another example material is a polyether block amide such as PEBAX® available from Arkema, Inc. in King of Prussia, Pennsylvania USA. Another example material is a fiberglass reinforced polyamide. An example fiberglass reinforced polyamide is RISLAN® BZM 7 0 TL available from Arkema, Inc. in King of Prussia, Pennsylvania USA. Such a fiberglass reinforced polyamide may have a density of 1.07 grams per cubic centimeter under ISO 1183 test method, an instantaneous hardness of 75 on a Shore D scale under ISO 868 test method, a tensile modulus of 1800 MPa under ISO 527 test method (with samples conditioned 15 days at 23 degrees Celsius with 50% relative humidity), and a flexural modulus of 1500 MPa under ISO 178 test method (with samples conditioned 15 days at 23 degrees Celsius with 50% relative humidity).

Additionally, the relative dimensions and shape of the device at the joints and at the side arms 18, 20 contributes to the spring-biased nature of the device 10, and its ability to elastically deform under a desired amount of loading and return to its original unstressed position. The device 10 may be configured to elastically bend under a maximum force of 160N. For example, with reference to FIG. 1, the first side arm 18 and the second side arm 20 each have a thickness T1 greater than a width WI at the respective joint 24A, 24B. The thickness T1 is measured in the fore-aft (longitudinal) direction of the footwear 12. The width WI is measured in the medial-lateral (transverse) direction of the footwear 12. The greater thickness T1 increases the required force to resiliently bend the device 10 to the loaded position.

Additionally, the side arms 18 and 20 are each twisted outwardly along their respective longitudinal axis 23A, 23B from the joints 24A, 24B at the base to the center segment 16. Stated differently, the inward-facing surfaces 60 of the side arms 18, 20 flow continually into a slightly upward-facing surface 62 as a ridge 64 along the side arm 18 or 20 turns from an upward extending ridge to a partially rearward extending ridge at the back of the center segment 16, as best shown in FIG. 2. Similarly, a side surface 66 at the arms 18 or 20 flows into a slightly downward facing surface 68 under the ridge 64 at the center segment 16, as best shown in FIG. 1. This twist in the side arms 18, 20 helps encourage the down and back movement of the center segment 16 during loading by the foot 46.

The device 10 is also configured to widen as it is moved from the unstressed position to the loaded position. This helps ease insertion of the foot 46 into a flexible upper 38, as the first side arm 18 and the second side arm 20 bow apart from one another when the control bar 14 is depressed, pulling the upper 38 attached to the inward-facing surfaces 60 outward. The bowing of the device 10 in the loaded position 10A is indicated in the plan view of FIG. 2.

While the device 10 is thus configured to ease foot entry with its ability to resiliently deform and store elastic energy, it is also configured to limit the amount of deformation to prevent plastic deformation. More specifically, the control bar 14 has an extension 70 that extends generally toward the base 22. The extension 70 is spaced apart from the base 22 when the control bar 14 is in the unstressed position of FIG. 1, and contacts the base 22 when the control bar 14 is depressed and the device is in the loaded position 10A. In FIG. 3, the extension 70 is indicated as 70A with the device 10 in the loaded position 10A. Contact of the extension 70 with the base 22 limits further depression of the control bar 14. Alternatively, the base 22 could have an extension instead of or in addition to the control bar 14, with the extension on the base extending toward the control bar 14.

In the embodiment of FIGS. 1-6, the control bar 14 and the base 22 have complementary features that interface to limit movement of the device during depression of the control bar 14. For example, the extension 70 interfaces with the base 22, limiting depression of the control bar 14, and limiting tilting of the control bar 14 toward the lateral or medial side during loading. More specifically, the base 22 has a recess 72, and the extension 70 protrudes into the recess 72 and contacts the base 22 when the control bar 14 is depressed and the device 10 elastically deforms to the loaded position 10A. When in the recess 72, side protrusions 74 on either side of the recess 72 prevent sideways movement of the extension 70. Because the control bar 14 generally comes down along an arc when the joints 24A, 24B bend, the extension 70 is positioned so that it will interface with the base 22 in the recess 72 when it descends along such an arc.

Figure 7:
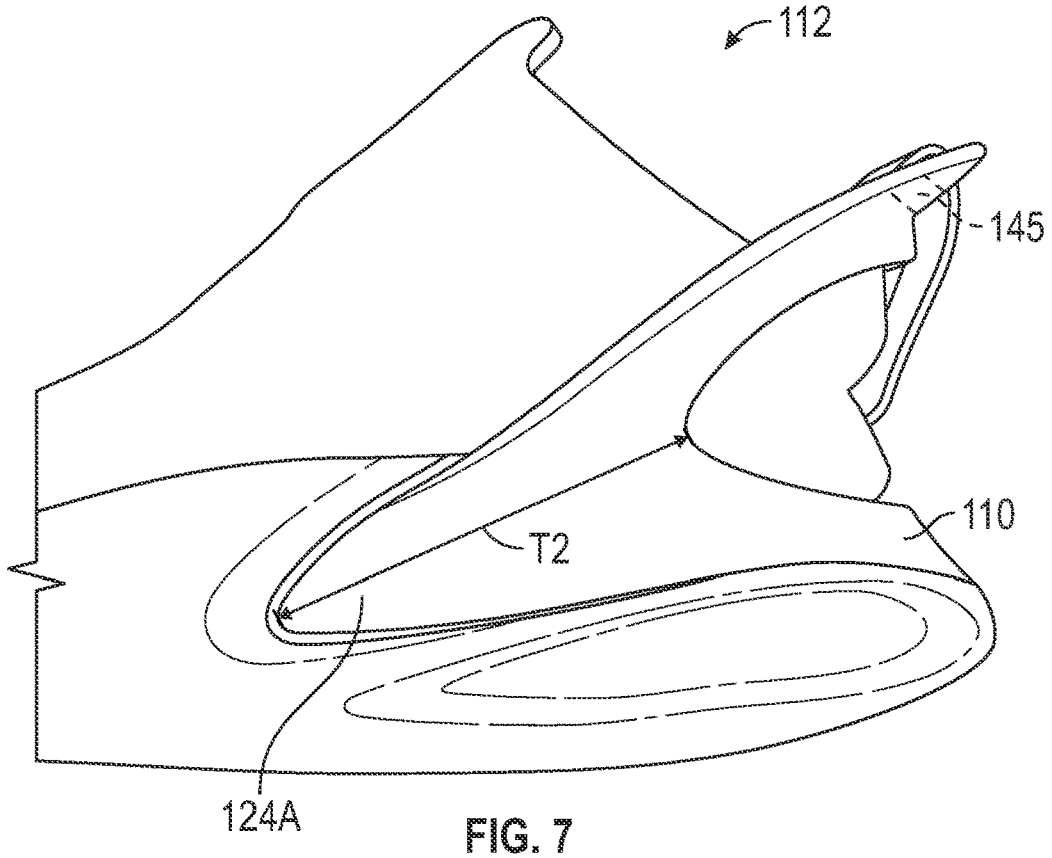
FIG. 7 is a schematic illustration in fragmentary side view of a medial side of an alternative embodiment of an article of footwear including an alternative heel spring device.
Figure 8:
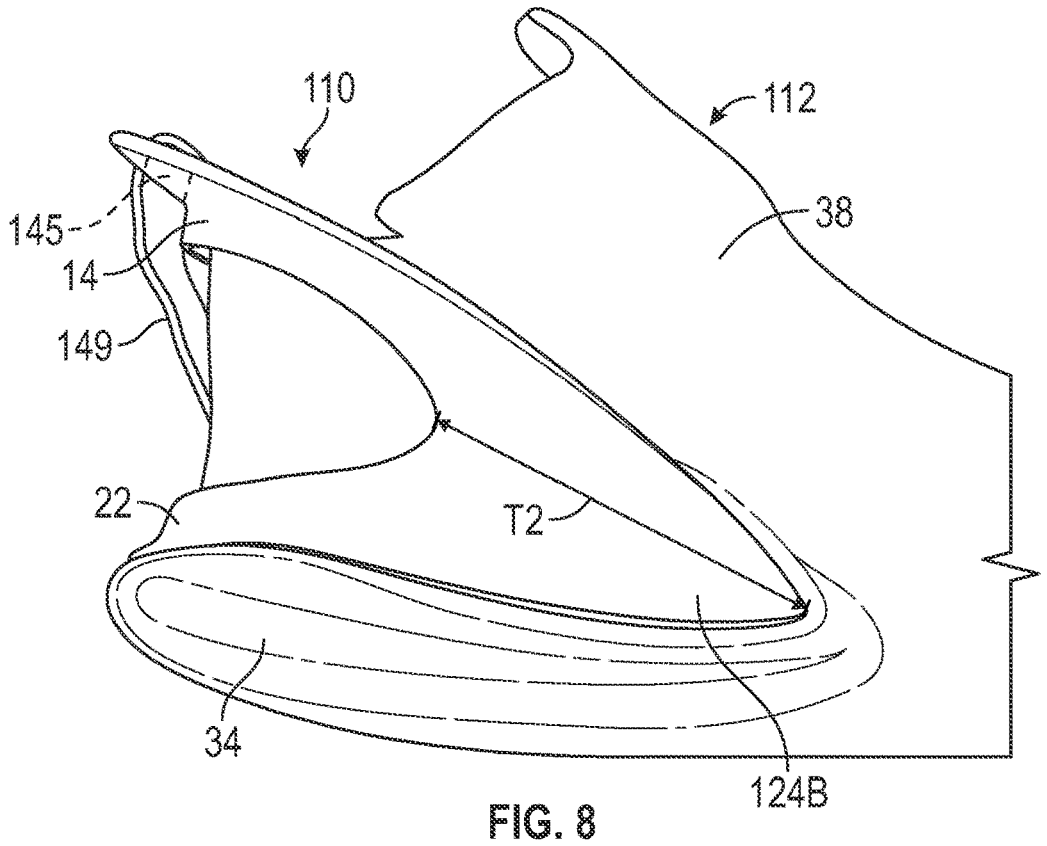
FIG. 8 is a schematic illustration in fragmentary side view of a lateral side of the article of footwear of FIG. 7.

FIGS. 7 and 8 show another embodiment of an article of footwear 112 with a heel spring device 110. The heel spring device 110 has similar function and features as heel spring device 10. Joints 124A, 124B have a greater thickness T2 than the thickness T1 of joints 24A, 24B and thus may provide greater resistance to depression of the control bar 14 lessening the need for an extension 70 to limit bending. The center segment 16 has an aperture 145, and the upper 38 has a heel pull tab 149 that extends through the aperture 145, further securing the upper 38 to the device 110. After insertion through the aperture 145, the heel pull tab 149 can wrap around the device 110, could be left hanging loose, or could be stitched or fastened to the upper 38 or to itself to secure the upper 38 to the device 10.

Figure 9:
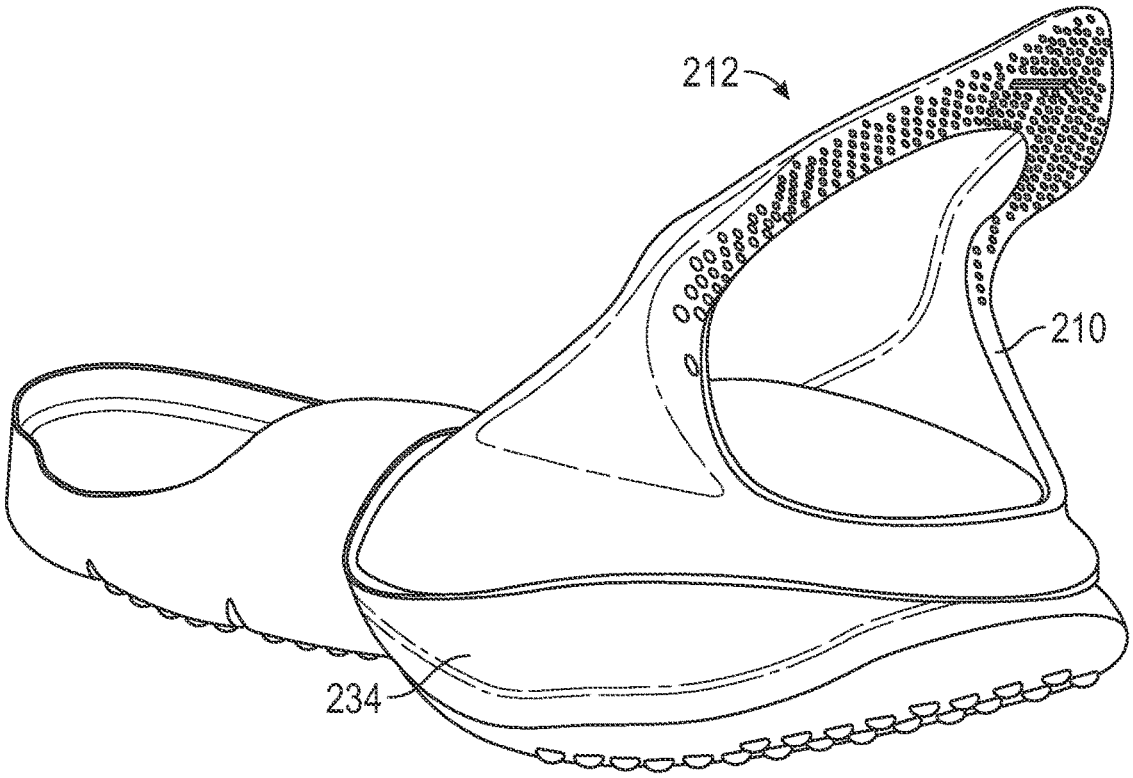
FIG. 9 is a schematic illustration in perspective view of an alternative embodiment of an article of footwear including an alternative heel spring device.

FIG. 9 shows another embodiment of an article of footwear 212 with a heel spring device 210 secured to a sole layer 234. The heel spring device 210 has similar function and features as heel spring device 10. An upper is not shown, but would be secured to the sole layer 234 and to the device 210 as described with respect to device 10.

Figure 10:
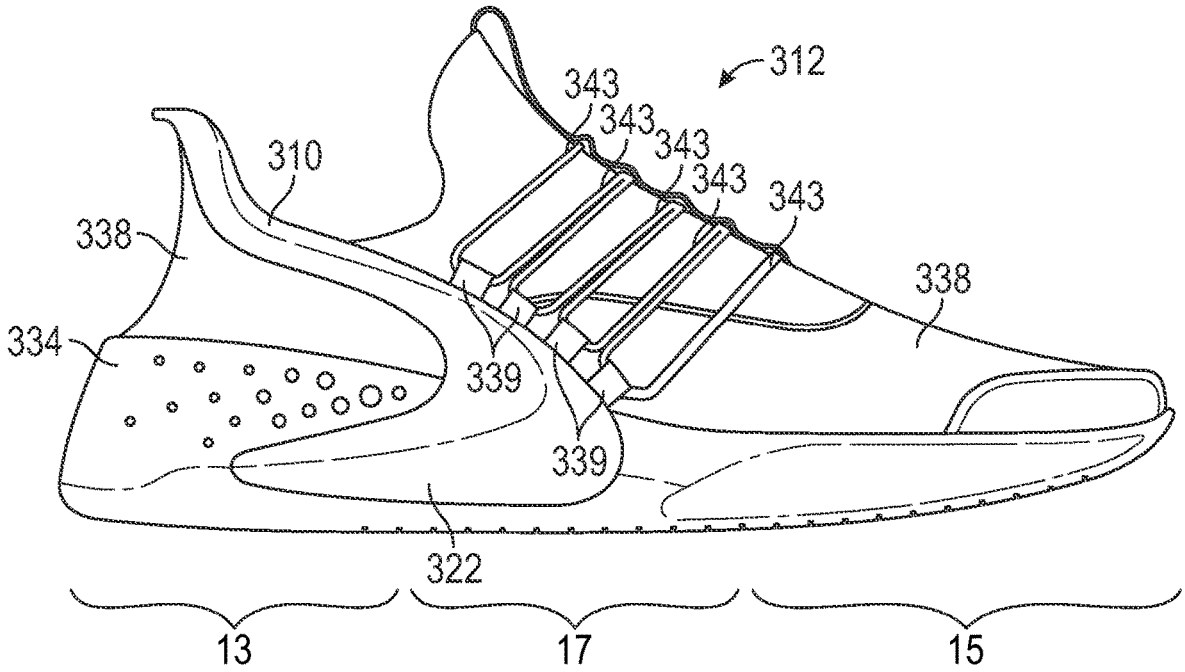
FIG. 10 is a schematic illustration in side view of a medial side of an alternative embodiment of an article of footwear including an alternative heel spring device.
Figure 11:
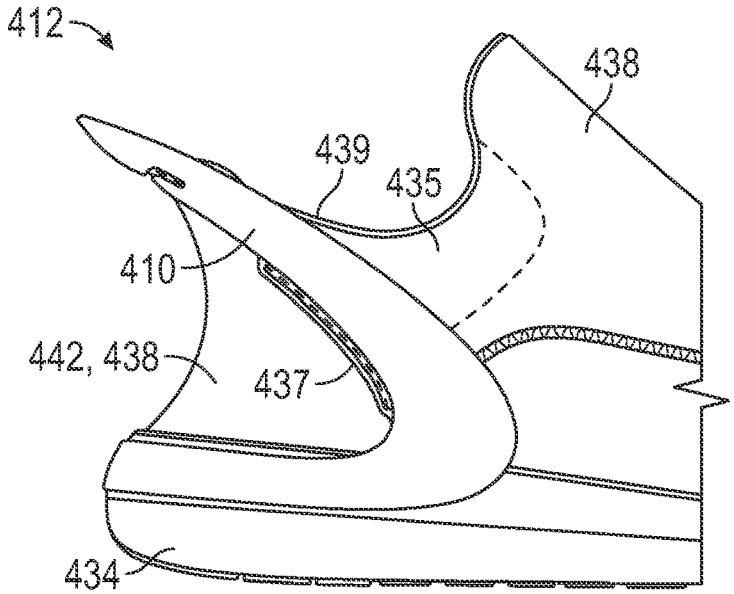
FIG. 11 is a schematic illustration in fragmentary side view of a lateral side of an alternative embodiment of an article of footwear including an alternative heel spring device.

FIG. 10 shows another embodiment of an article of footwear 312 with a heel spring device 310 secured to a sole structure 334 that is a midsole, and to an upper 338 that has a flexible cover layer with an elastically stretchable material in the heel region. The heel spring device 310 has similar function and features as heel spring device 10. The heel spring device 310 may include a base 322 similar to base 22 but that passes through the sole structure 334, or the base arms may terminate on the sole structure 334 and be sufficiently secured to the sole structure 334 so that the sole structure serves as the base. The device 310 is integrated into a fastening system of the upper 338, as the device has loops 339 secured to the side arms that serve as anchors for fastener cables 343.

FIGS. 11-14 show another embodiment of an article of footwear 412 that has a heel spring device 410 with similar function and features as heel spring device 10. The heel spring device 410 is secured to a sole layer 434 and to an upper 438 that has a flexible covering 442 with an elastically stretchable material in the heel region for receiving and covering a foot supported on the sole layer 434. For example, the flexible covering 442 may be an elastically stretchable fabric, such as a 4-way stretch nylon fabric. A foam collar 435 is secured to the flexible covering 442 and defines a front portion of an ankle opening 439 in the upper 438. The foam collar is stiffer than the elastically stretchable fabric of the flexible covering 442. The collar 435 may include foam padding 435A. The foam padding 435A at a rear portion of the collar may protrude inward into the ankle opening 439. Because the foam is compressible, this enables the size of the opening to be adjustable to different ankle girths.

Figure 12:
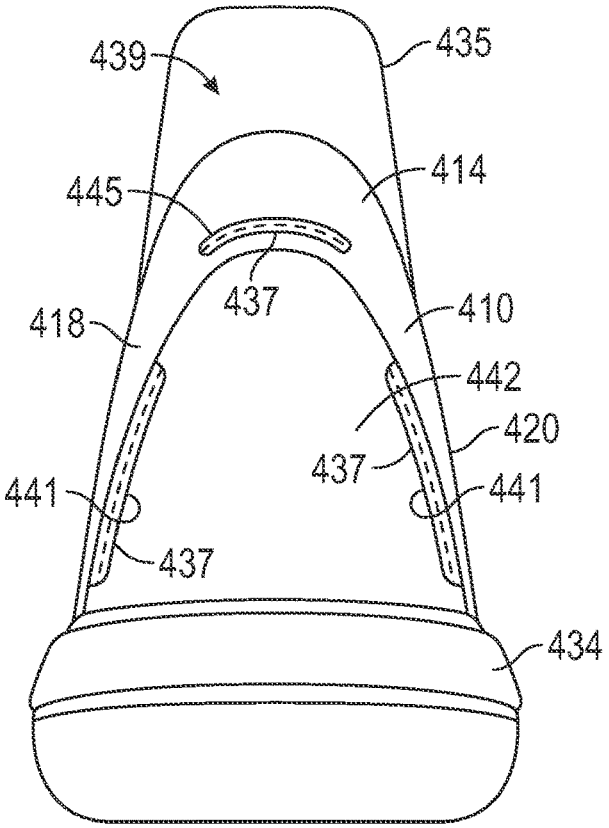
FIG. 12 is a schematic illustration in rear view of the article of footwear of FIG. 11.
Figure 13:
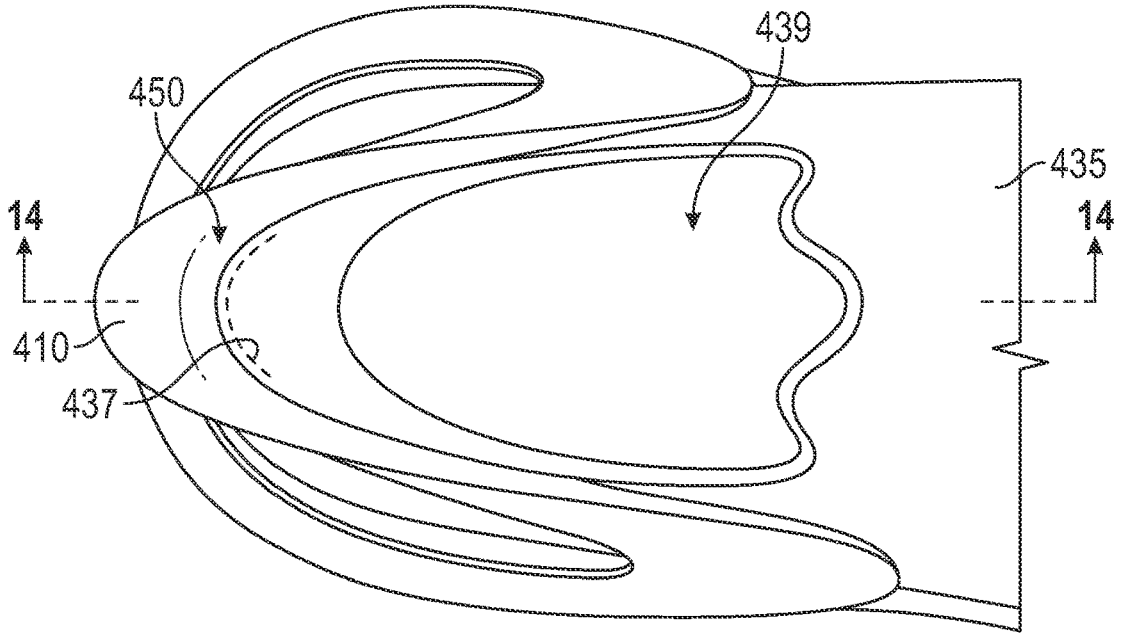
FIG. 13 is a schematic illustration in fragmentary plan view of the article of footwear of FIG. 11.
Figure 14:
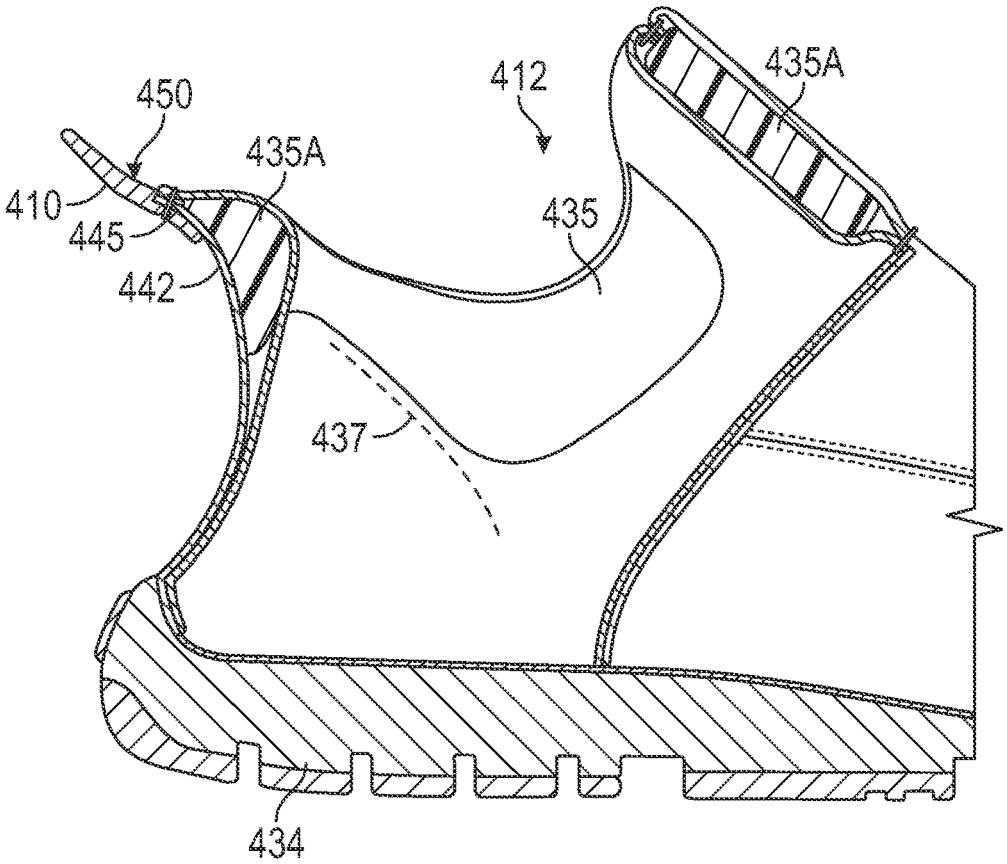
FIG. 14 is a schematic illustration in fragmentary cross-sectional view of the article of footwear of FIG. 13 taken at lines 14-14 in FIG. 13.

A center segment of the control bar 414 of the device 410 has a thinned portion 445 where the flexible covering 442 of the upper 438 is stitched to the device 410. The foam collar 435 is also stitched to the device 410 at the thinned portion 445 as shown in FIG. 14. Additional thin extensions 441 of the device 410 run along the side arms 418, 420, as shown in FIG. 12, and are sufficiently thin to allow stitching of the upper 438 through the thin extensions 441 to the device 410. The stitching 437 through the thinned portion 445 and through the extensions 441 is shown in FIGS. 13 and 14. The upper 438 is characterized by the absence of a rigid heel counter. The device 410 functions at least in some respects as a heel counter in that it helps to retain a wearer's heel in position atop a heel portion of the sole structure, preventing medial or lateral displacement during use. Similar to device 10, the device 410 has a ramped surface 450 for easing foot entry.

Figure 15:
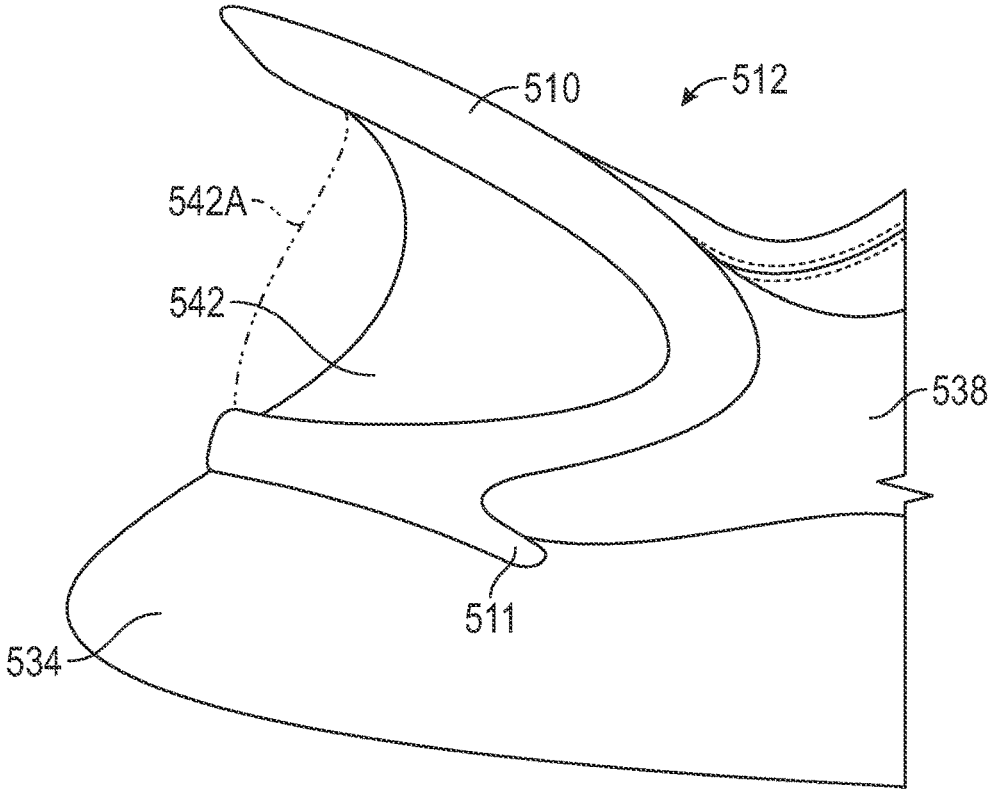
FIG. 15 is a schematic illustration in fragmentary side view of a lateral side of an alternative embodiment of an article of footwear including an alternative heel spring device.

FIG. 15 shows another embodiment of an article of footwear 512 that has a heel spring device 510 with similar function and features as heel spring device 10. The heel spring device 510 is secured to a sole layer 534 and to an upper 538 that has a flexible covering 542 with an elastically stretchable material in the heel region for receiving and covering a foot supported on the sole layer 534. The covering 542 stretches to position 542A when the foot is inserted. For example, the flexible covering 542 may be an elastically stretchable fabric, such as a 4-way stretch nylon fabric. The device 510 includes forward extending supports 511. The joints of the device 510 are higher than in other embodiments, as they are at the sides of the upper 538 above the sole layer 534 as shown.

Figure 16:
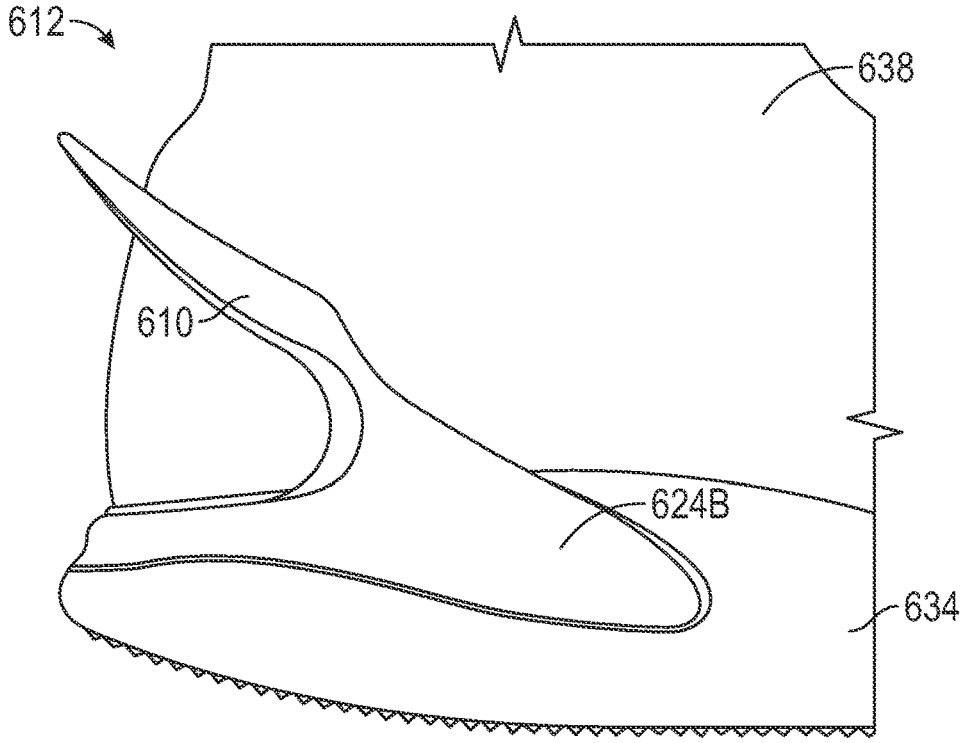
FIG. 16 is a schematic illustration in fragmentary side view of a lateral side of an alternative embodiment of an article of footwear including an alternative heel spring device.

FIG. 16 shows another embodiment of an article of footwear 612 that has a heel spring device 610 with similar function and features as heel spring device 10. The heel spring device 610 is secured to a sole layer 634 and to an upper 638 that has a flexible covering with an elastically stretchable material in the heel region for receiving and covering a foot supported on the sole layer 634. For example, the flexible covering may be an elastically stretchable fabric, such as a 4-way stretch nylon fabric. The sole layer 634 has molded recesses on its medial and lateral sides in which the base of the device 610 and the joints, such as joint 624B partially nest.

Figure 17:
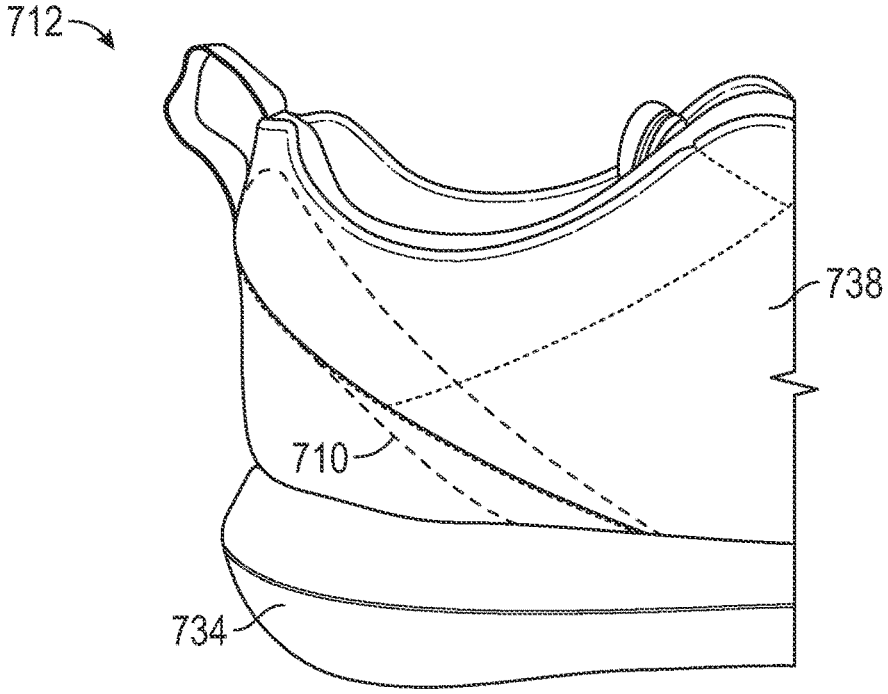
FIG. 17 is a schematic illustration in fragmentary side perspective view of a lateral side of an alternative embodiment of an article of footwear including an alternative heel spring device.
Figure 18:
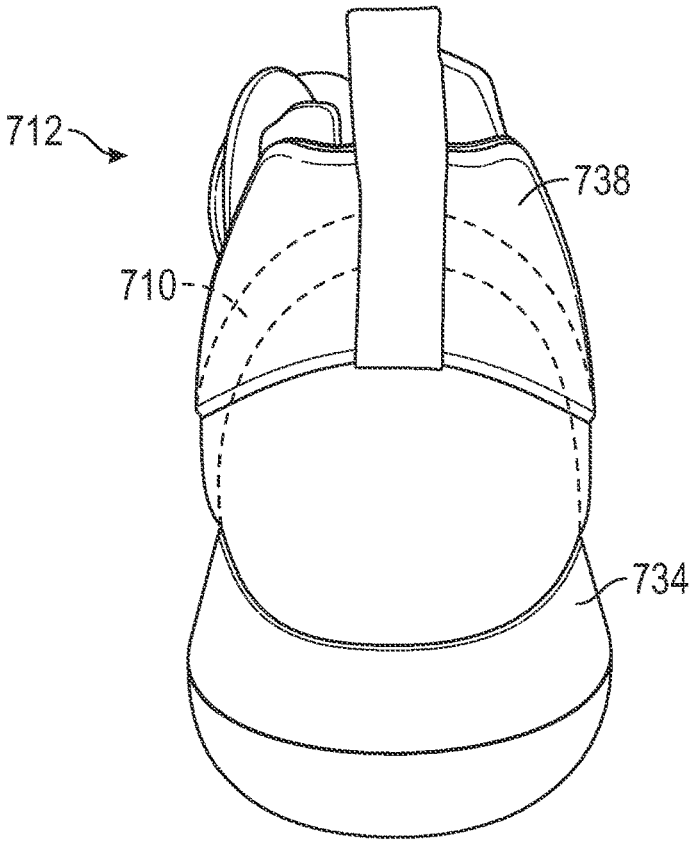
FIG. 18 is a schematic illustration in rear perspective view of the article of footwear of FIG. 17.

FIGS. 17-18 show another embodiment of an article of footwear 712 that includes a heel spring device 710 with similar function and features as heel spring device 10. The heel spring device 710 is embedded in a flexible covering of an upper 738, and is either secured to a sole layer 734 at its base by bonding with adhesive or otherwise, or is simply trapped between the midsole and a strobel or upper materials to reduce the need for adhesive.

Figure 19:
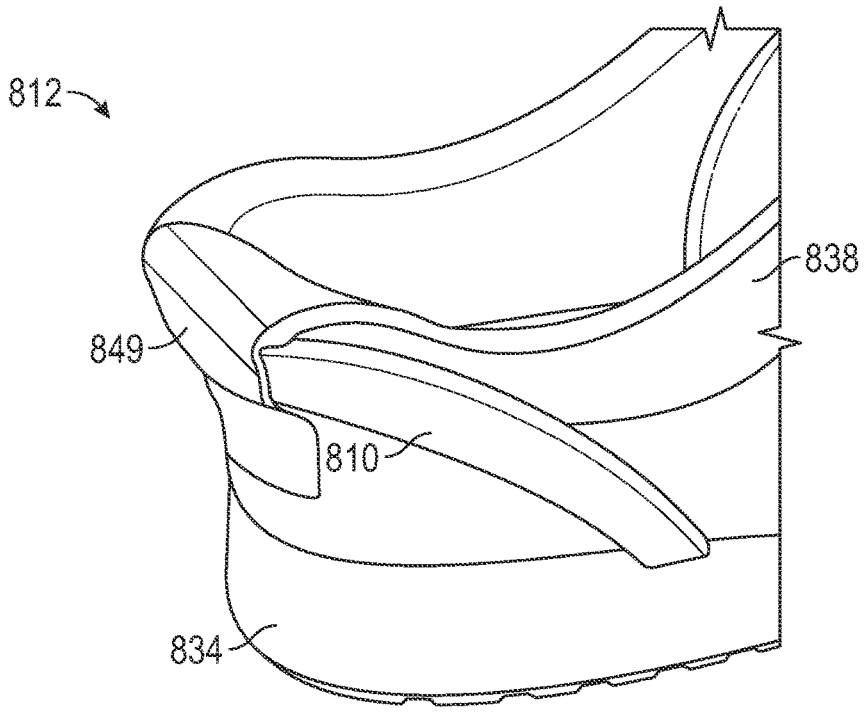
FIG. 19 is a schematic illustration in fragmentary perspective view of an alternative embodiment of an article of footwear including an alternative heel spring device.

FIG. 19 shows another embodiment of an article of footwear 812 that includes a heel spring device 810 with similar function and features as heel spring device 10. The heel spring device 810 is secured to a sole layer 834 at its base, and to a flexible covering of an upper 838. A heel pull tab 849 secured to the upper forms a loop through which the device 810 passes rearward of an ankle opening, helping to secure the upper 838 for movement with the device 810.

Figure 20:
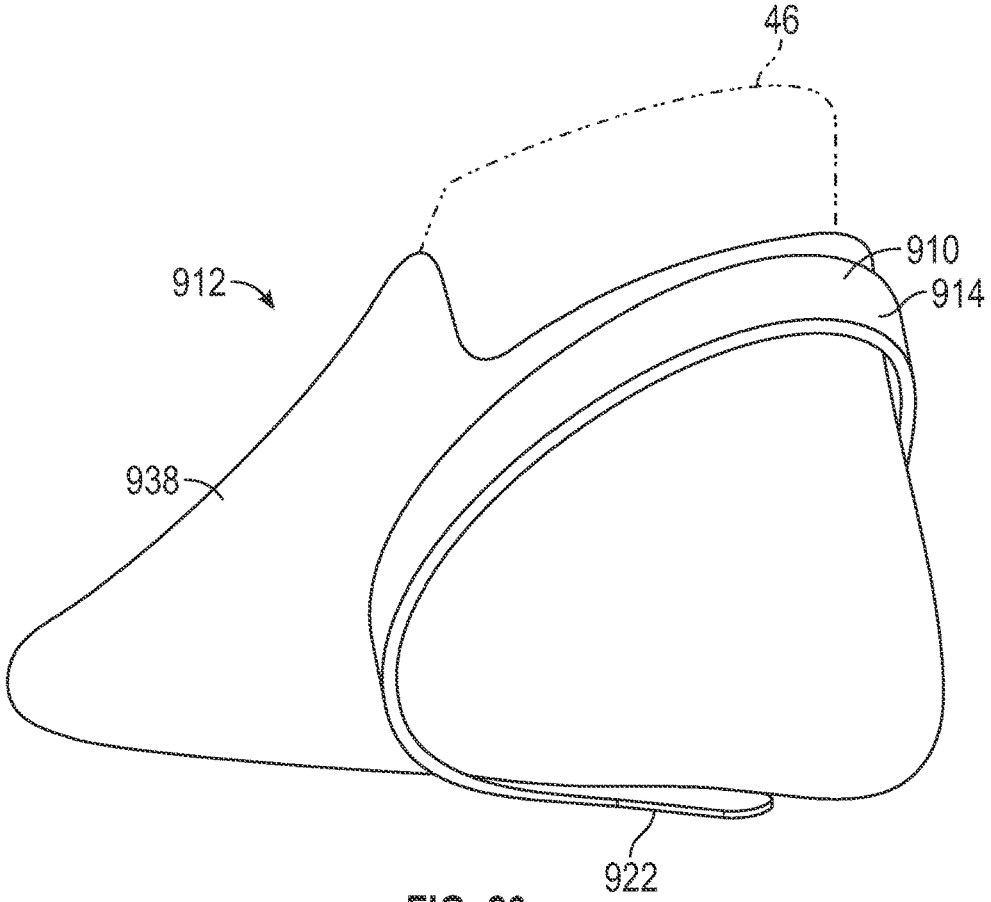
FIG. 20 is a schematic illustration in perspective view of an alternative embodiment of an article of footwear including an alternative heel spring device.
Figure 21:
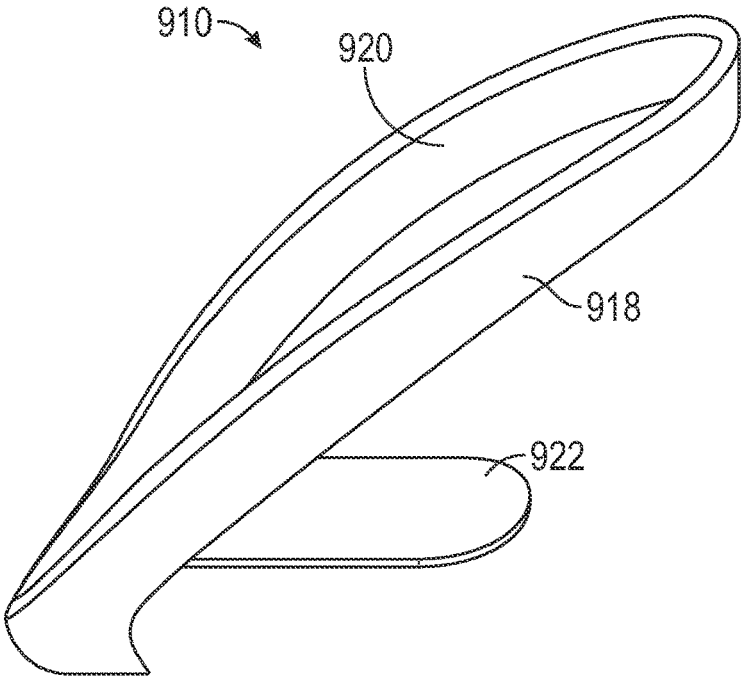
FIG. 21 is a schematic illustration in perspective view of the heel spring device of FIG. 20.
Figure 22:
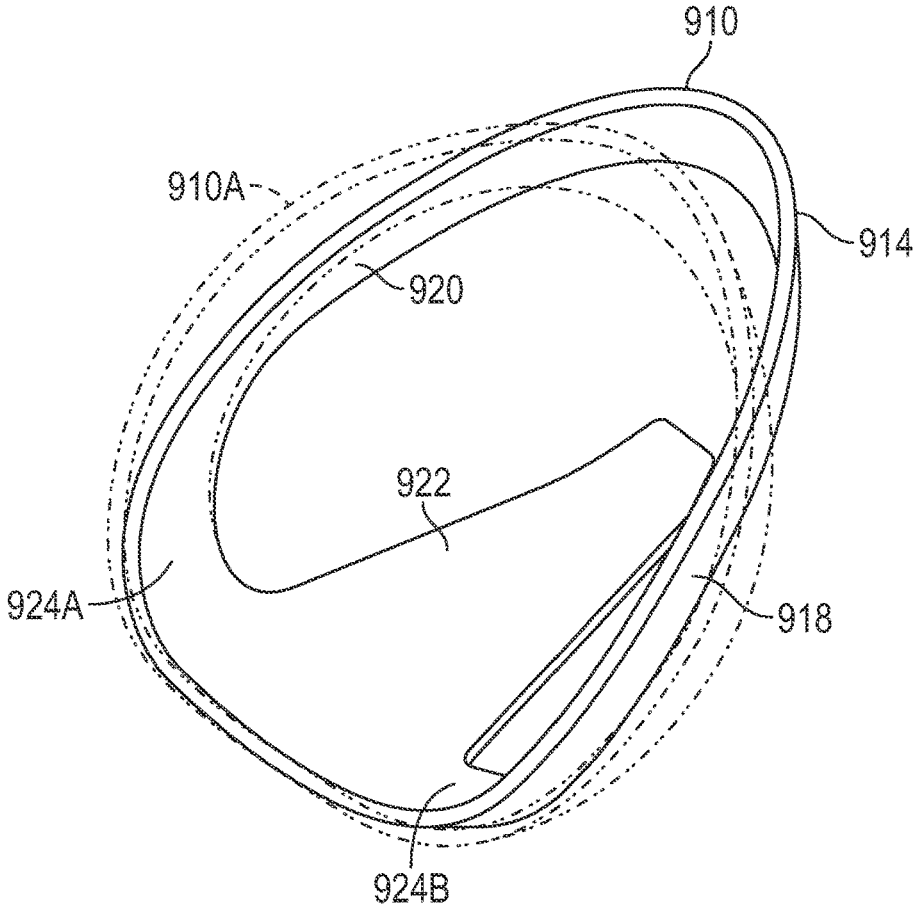
FIG. 22 is a schematic illustration in another perspective view of the heel spring device of FIG. 21 and showing a loaded position in phantom.

FIGS. 20-22 show another embodiment of an article of footwear 912 that includes a heel spring device 910 with similar function and features as heel spring device 10. The heel spring device 910 is secured to a sole layer (not shown) at its base, and to a flexible covering of an upper 938. The device 910 has a control bar 914 with side arms 918, 920, and has a base 922 that connects the side arms 918, 920 and underlies the control bar 914. The base 922 extends rearward from a junction 924A, 924B of the control bar 914 with the base 922 to function as a support. The base 922 will underlie a foot-receiving void in an upper to which the heel spring device 910 is secured, and may underlie a strobel in the article of footwear 912. The base 922 may be secured to a sole layer by bonding with adhesive or otherwise, or may simply be trapped between the sole layer and a strobel or upper materials to reduce the need for adhesive. The device 910 widens laterally outward when the control bar 914 is depressed, as indicated by the device 910 in a loaded position 910A.

Figure 23:
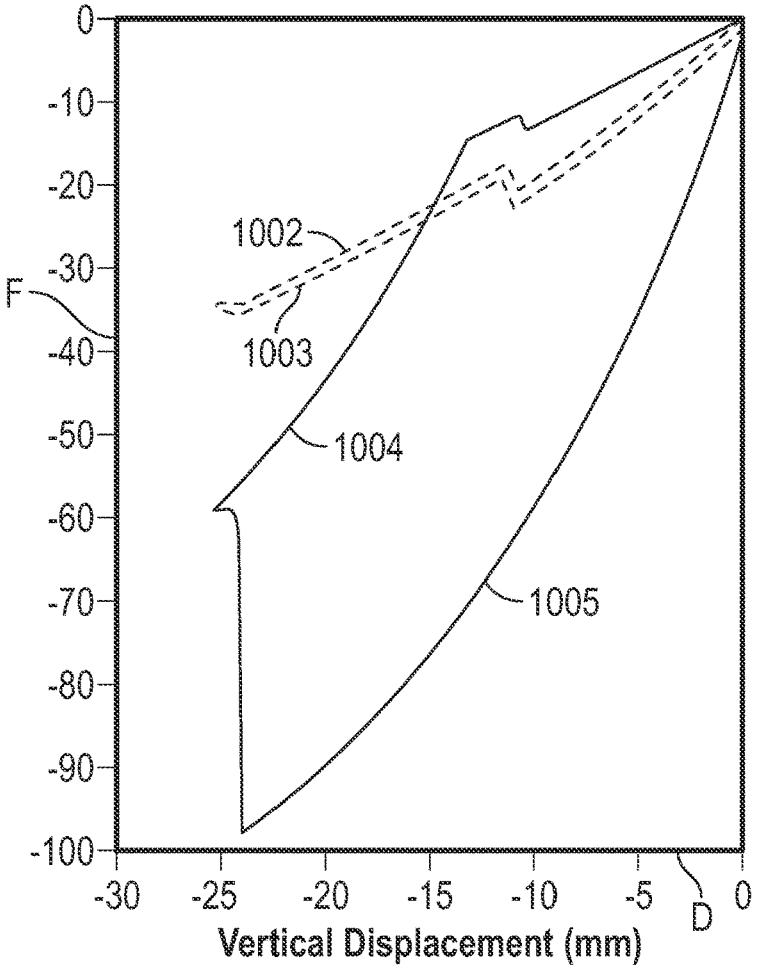
FIG. 23 shows representative plots of force in Newtons versus displacement in millimeters during loading and unloading of heel spring devices within the scope of the present teachings.

FIG. 23 shows an example diagram of vertical force F in Newtons on the vertical axis versus displacement D in millimeters on the horizontal axis schematically representing the elastic bending and energy-returning behavior of any of the heel spring devices shown and described herein. The displacement D is, for example, the difference between the distances D1 and D2 in FIG. 3. A first example representation of the behavior of a heel spring device is shown by a loading curve 1003 (placement of the force F of FIG. 4 on the control bar of the device (the vertical component of which is represented in the plots)) followed by an unloading curve 1002 (behavior when the force F is removed). A second example representation of the behavior of a heel spring device is shown by a loading curve 1005 followed by an unloading curve 1004.

Figure 24:
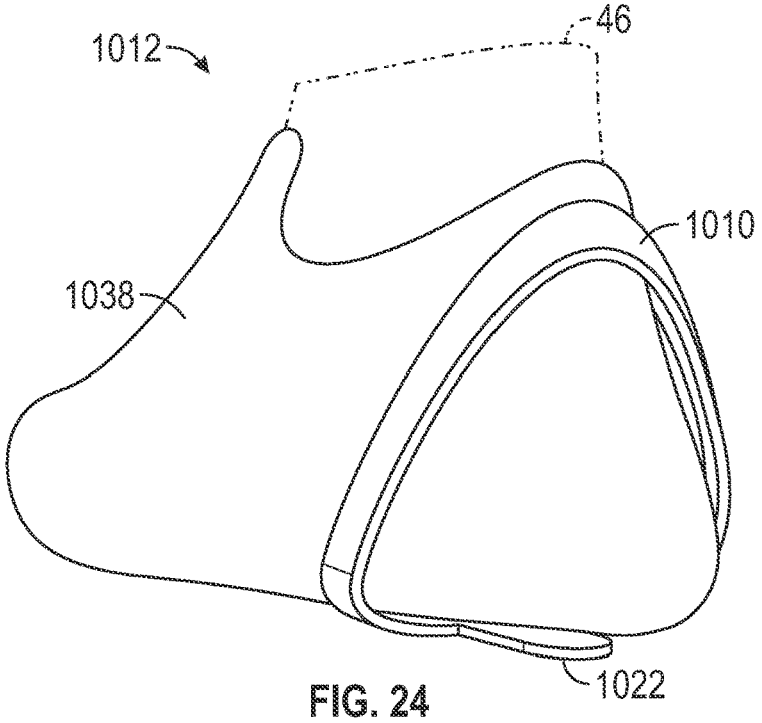
FIG. 24 is a schematic illustration in perspective view of an alternative embodiment of an article of footwear including an alternative heel spring device.
Figure 25:
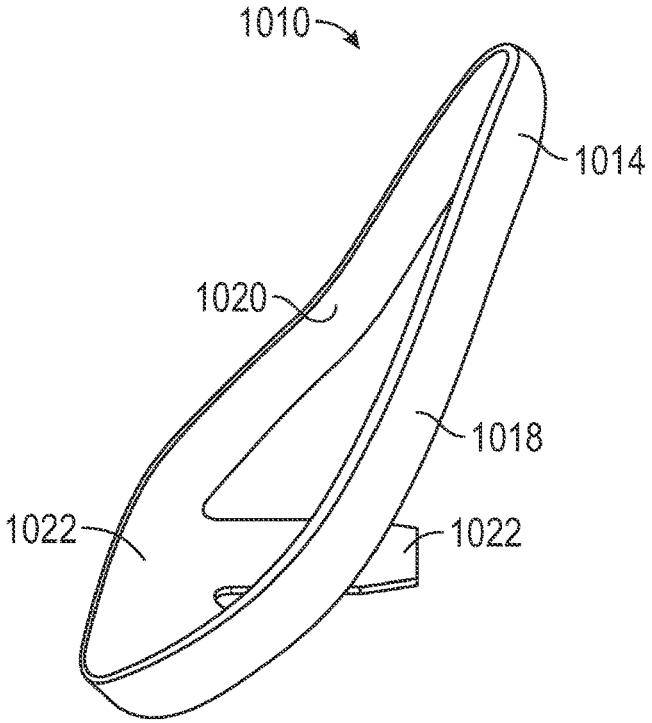
FIG. 25 is a schematic illustration in perspective view of the heel spring device of FIG. 24.

FIGS. 24-25 show another embodiment of an article of footwear 1012 that includes a heel spring device 1010 with similar function and features as heel spring device 10. The heel spring device 1010 is secured to a sole layer (not shown) at its base, and to a flexible covering of an upper 1038. The device 1010 has a control bar 1014 with side arms 1018, 1020, and has a base 1022 that connects the side arms 1018, 1020 and underlies the control bar 1014. The base 1022 extends rearward from a junction of the control bar 1014 with the base 1022 to function as a support. The base 1022 may underlie a strobel in the article of footwear 1012, may be secured to a sole layer by bonding with adhesive or otherwise, or may simply be trapped between the sole layer and a strobel or upper materials to reduce the need for adhesive. The side arms 1018, 1020 of the device 1010 are similar to the side arms 918, 920 of the device 910 except that the side arms 918, 920 extend from the base 922 to the center segment of the control bar 914 with a gradually decreasing slope as best shown in FIG. 21, while the side arms 1018, 1020 extend from the base 1022 to the center segment of the control bar 1014 with a gradually increasing slope as best shown in FIG. 25.

Figure 26:
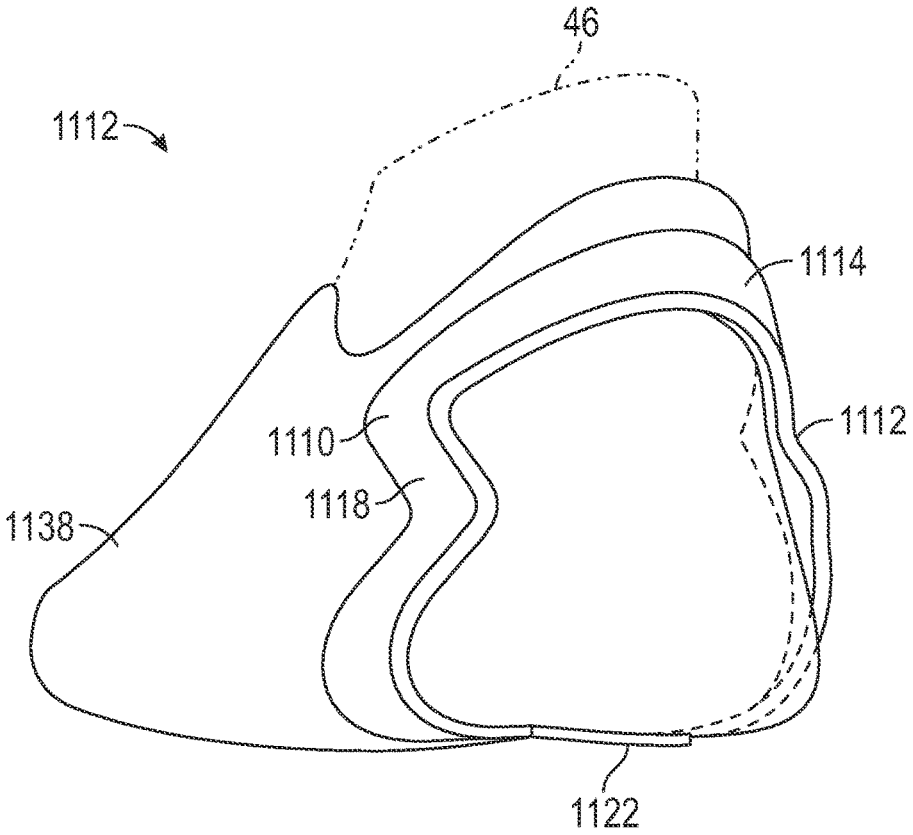
FIG. 26 is a schematic illustration in perspective view of an alternative embodiment of an article of footwear including an alternative heel spring device.
Figure 27:
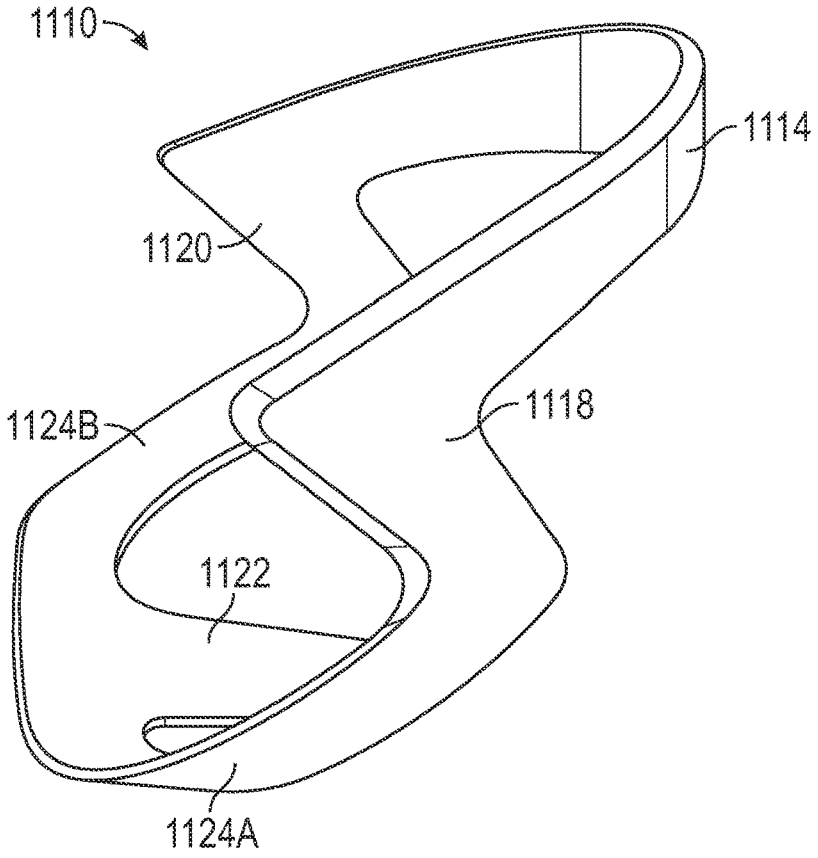
FIG. 27 is a schematic illustration in perspective view of the heel spring device of FIG. 26.

FIGS. 26-27 show another embodiment of an article of footwear 1112 that includes a heel spring device 1110 with similar function and features as heel spring device 10. The heel spring device 1110 is secured to a sole layer (not shown) at its base, and to a flexible covering of an upper 1138. The base 1122 may underlie a strobel in the article of footwear 1112, may be secured to a sole layer by bonding with adhesive or otherwise, or may simply be trapped between the sole layer and a strobel or upper materials to reduce the need for adhesive. The device 1110 has a control bar 1114 with side arms 1118, 1120, and has a base 1122 that connects the side arms 1118, 1120 and underlies the control bar 1114. The first side arm 1118 and the second side arm 1120 each have a Z shape, as best shown in FIG. 27 as they first extend rearward, then forward, then rearward again in progressing from the joint 1124A, 1124B to the center segment of the control bar 1114. The junctions of the rearward extending portions with the forward extending portions of the side arms 1118, 1120 may serve as additional junctions for resilient bending during loading of the device 1110 by a downward force on the center segment of the control bar 1114. The base 1122 extends rearward from a junction of the control bar 1114 with the base 1122 to function as a support.

Figure 28:
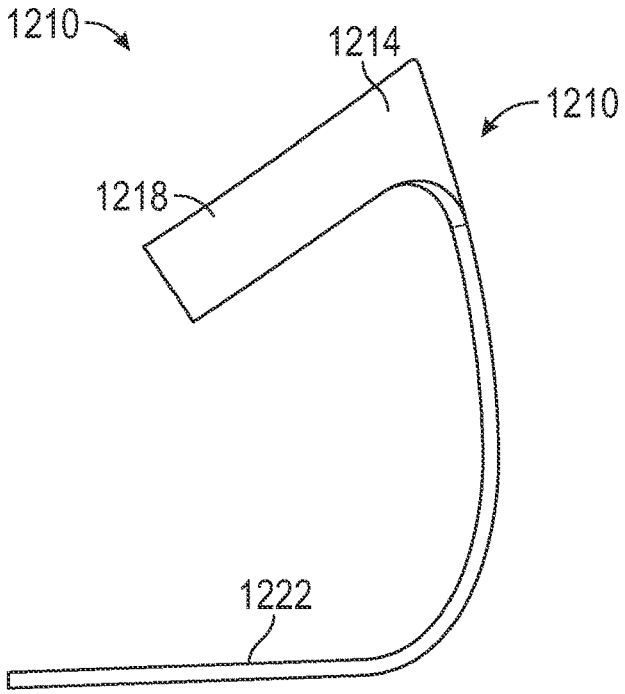
FIG. 28 is a schematic illustration in side view of a medial side of an alternative embodiment of a heel spring device for an article of footwear.
Figure 29:
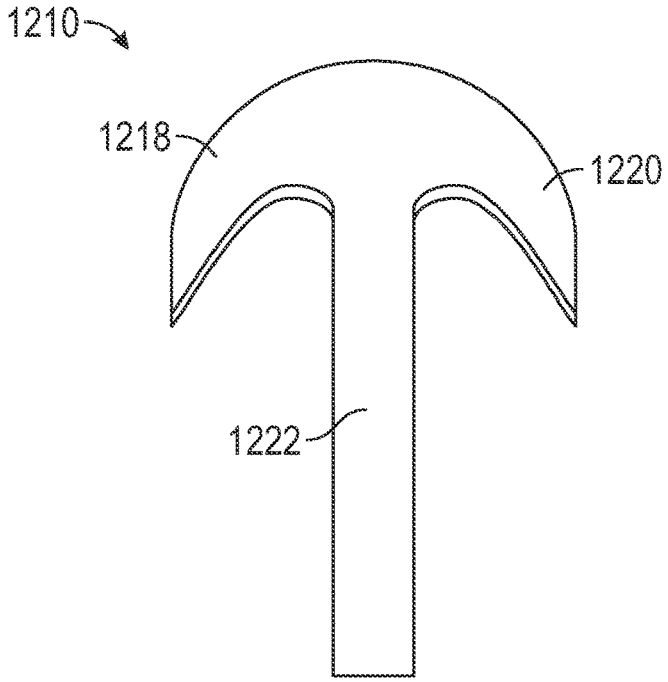
FIG. 29 is a schematic illustration in rear view of the heel spring device of FIG. 28.

FIGS. 28-29 show another embodiment of a heel spring device 1210 for an article of footwear. The heel spring device 1210 has a control bar 1214 that includes medial and lateral side arms 1218, 1220. The control 1214 bar is attachable to a flexible footwear upper. A base 1222 that extends from and supports the control bar 1214. Unlike the other embodiments of heel spring devices disclosed herein, the base 1222 extends from the center segment of the control bar 1214, and the junction is between generally vertical and generally horizontal portions of the base 1222.

Figure 30:
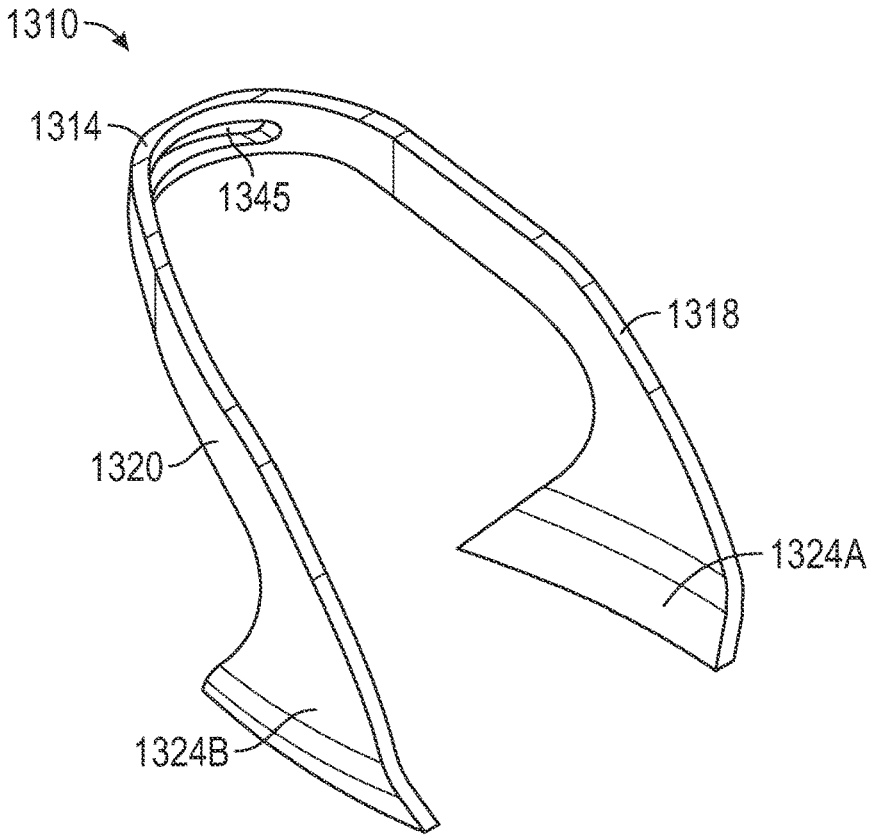
FIG. 30 is a schematic illustration in perspective view of an alternative embodiment of a heel spring device for an article of footwear.
Figure 31:
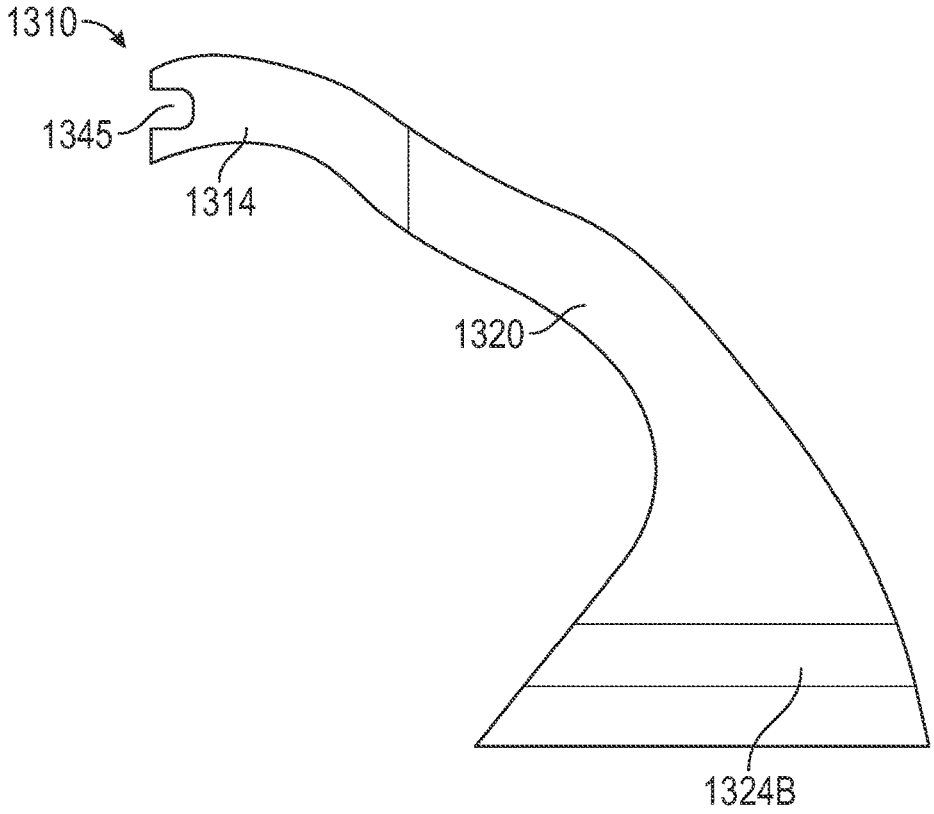
FIG. 31 is a schematic illustration in side view of a lateral side of the heel spring device of FIG. 30.

FIGS. 30-31 show another embodiment of a heel spring device 1310 for an article of footwear. The device 1310 has a control bar 1314 that includes medial and lateral side arms 1318, 1320 extending from a center segment of the control bar 1314. The control 1314 bar is attachable to a flexible footwear upper. The center segment has an aperture 1345 for receiving a heel pull tab of a flexible footwear upper or for stitching the control bar 1314 to a footwear upper. Ends of the side arms 1318, 1320 widen in the longitudinal direction and serve together with a sole layer to which they will be attached as the base and junction 1324A, 1324B of the device 1310.

Figure 32:
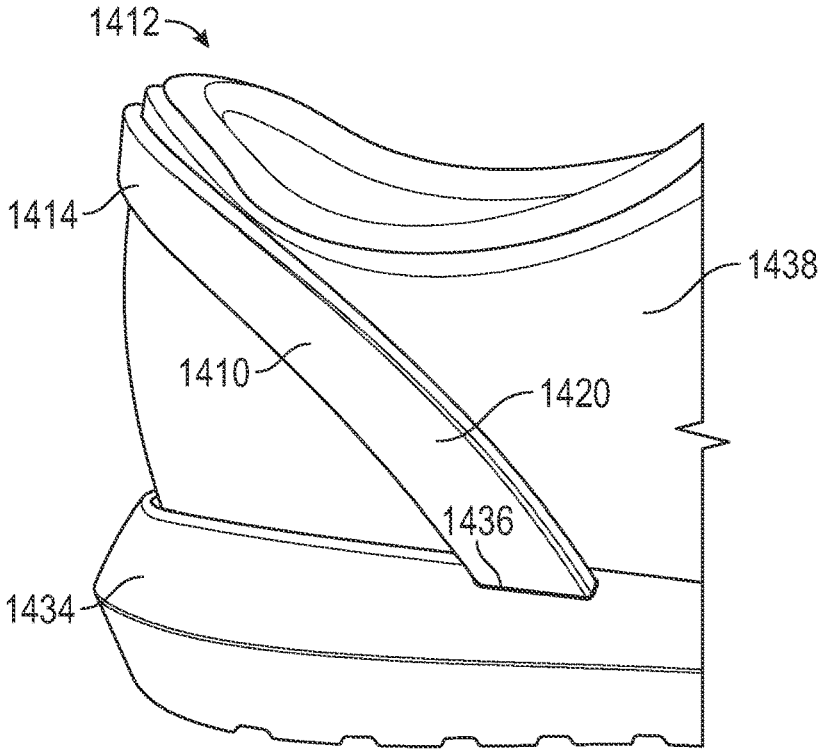
FIG. 32 is a schematic illustration in fragmentary side perspective view of a lateral side of an alternative embodiment of an article of footwear including an alternative heel spring device.

FIG. 32 shows another embodiment of an article of footwear 1412 that includes a heel spring device 1410 with similar function and features as heel spring device 10. The heel spring device 1410 has a control bar 1414 secured to a flexible covering of a footwear upper 1438. The control bar 1414 includes medial and lateral side arms (one side arm 1420 shown). The device 1410 includes a base (not shown) that connects the side arms and extends through openings 1436 in the sole layer 1434 and is secured to or embedded in the sole layer 1434. The base may underlie a strobel in the article of footwear 1412, may be secured to the sole layer 1434 by bonding with adhesive or otherwise, or may simply be trapped between the sole layer 1434 and a strobel or upper materials to reduce the need for adhesive. The sole layer 1434 thus partly serves as the base and junction with the control arm 1314.

Figure 33:
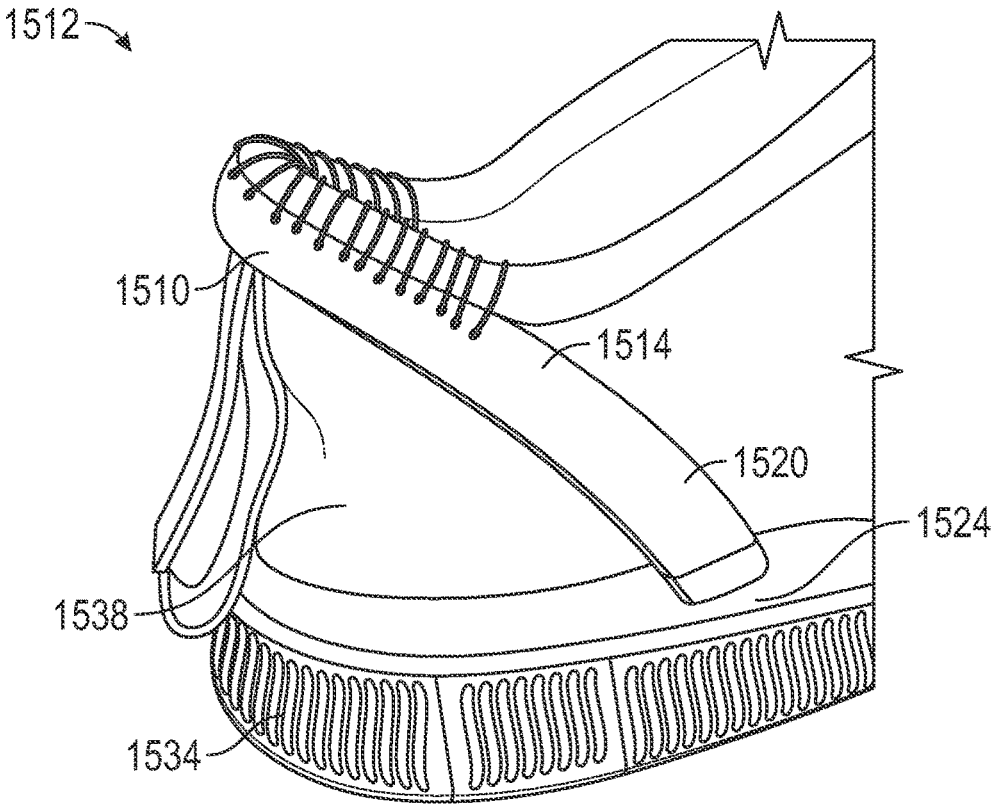
FIG. 33 is a schematic illustration in fragmentary perspective view of an alternative embodiment of an article of footwear including an alternative heel spring device.

FIG. 33 shows another embodiment of an article of footwear 1512 that includes a heel spring device 1510 with similar function and features as heel spring device 10. The heel spring device 1510 has a control bar 1514 stitched to a flexible covering of a footwear upper 1538. The control bar 1514 includes medial and lateral side arms (one side arm 1520 shown). The device 1510 includes a base (not shown) that connects the side arms and extends through openings in the sole layer 1534 and is embedded in or otherwise secured to the sole layer 1534. The base may underlie a strobel in the article of footwear 1512, may be secured to the sole layer 1534 by bonding with adhesive or otherwise, or may simply be trapped between the sole layer 1534 and a strobel or upper materials to reduce the need for adhesive. The sole layer 1534 thus partly serves as a base for the control arm and as a junction 1524 with the control arm.

Figure 34:
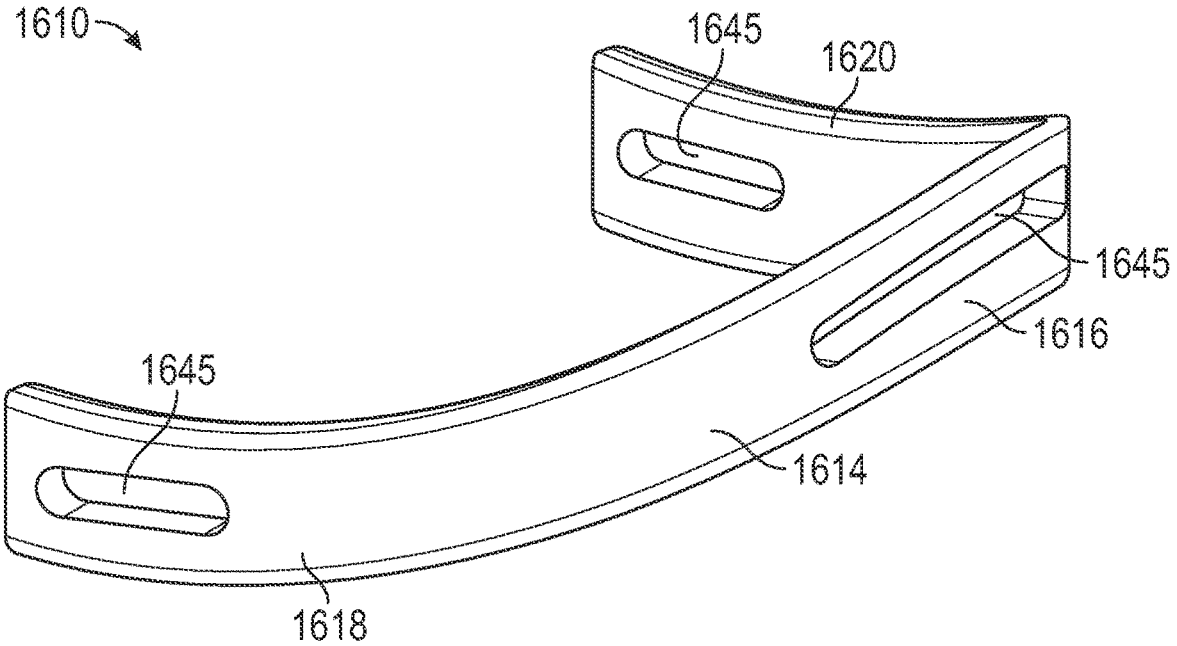
FIG. 34 is a schematic illustration in perspective view of an alternative embodiment of a heel spring device for an article of footwear.
Figure 35:
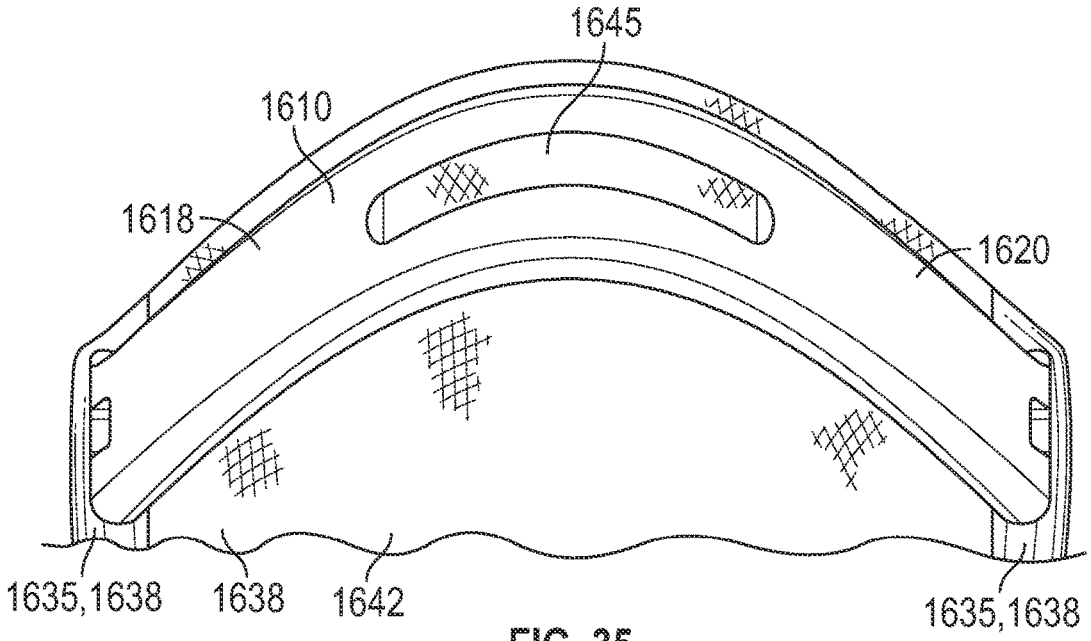
FIG. 35 is a schematic illustration in rear view of the heel spring device of FIG. 34 secured to a footwear upper.

FIGS. 34-35 show another embodiment of a heel spring device 1610 for an article of footwear. The device 1610 has a control bar 1614 that includes medial and lateral side arms 1618, 1620 extending from a center segment 1616 of the control bar 1614. The control 1614 bar is attachable to a flexible footwear upper. The center segment 1616 and the side arms 1618, 1620 have apertures 1645 for stitching the device 1610 to flexible footwear upper rearward of an ankle opening such as at a rear collar of the ankle opening to prevent a heel tab in that area from folding inward during foot insertion. The device 1610 has no base. However, the side arms 1618, 1620 may secure near their distal ends to portions of an upper 1638, such as slightly stiffer but resiliently flexible portions 1635 forward of a 4-way stretch fabric 1642 in the heel region as shown in FIG. 35. In this manner, the stiffer portions 1635 of the upper effectively serve as a base for the device 1610 and form junctions with the side arms 1618, 1620 to provide a resilient return of the device 1610 to an unstressed position after a downward force is applied during foot insertion.

Figure 36:
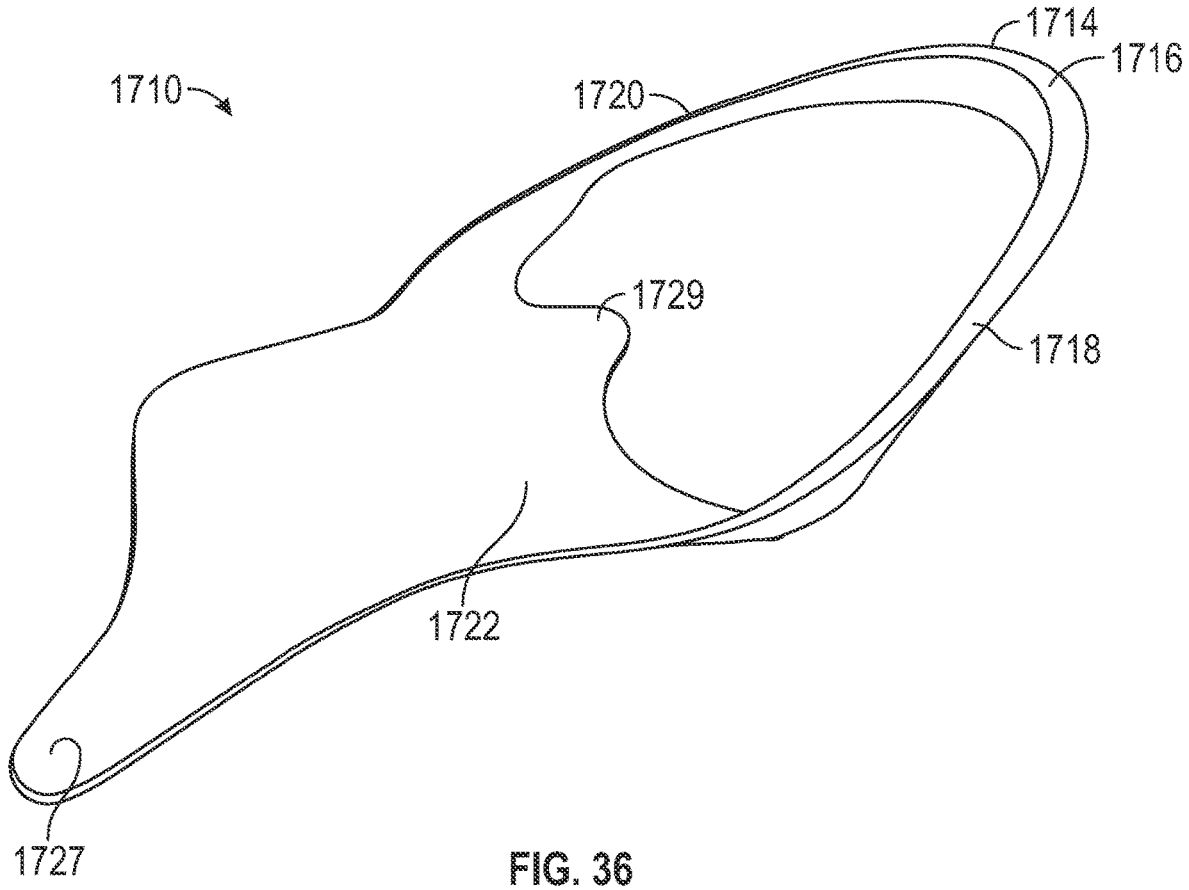
FIG. 36 is a schematic illustration in perspective view of an alternative embodiment of a heel spring device for an article of footwear.
Figure 37:
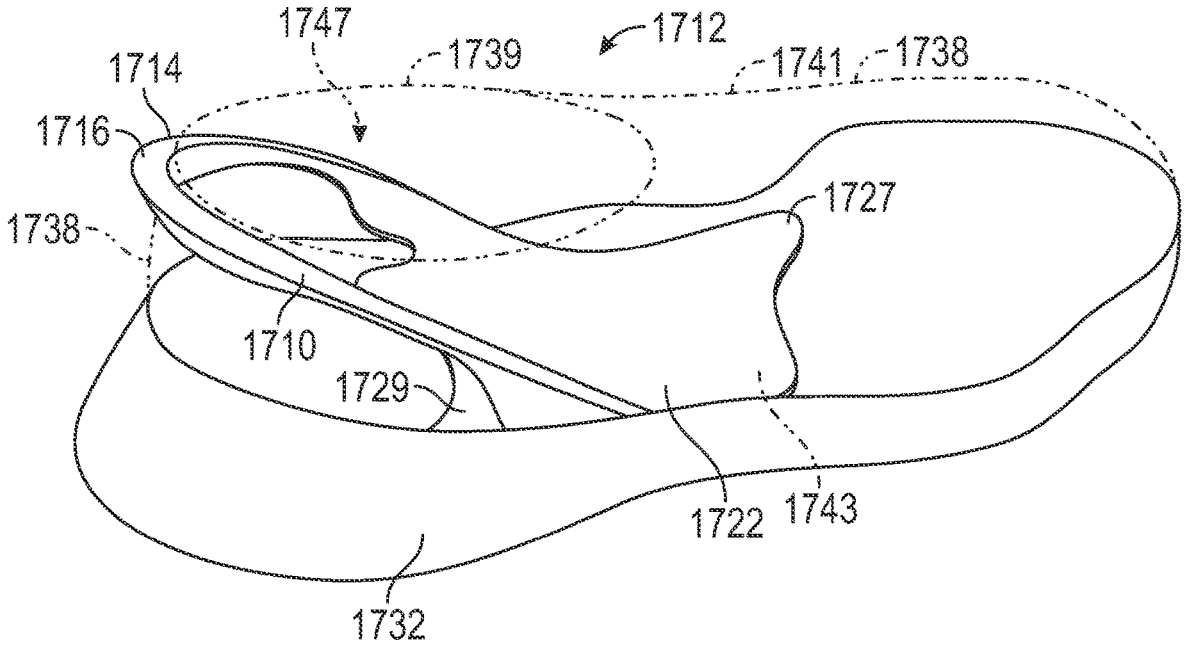
FIG. 37 is a schematic illustration in perspective view an article of footwear with the heel spring device of FIG. 36 in an unloaded position.
Figure 38:
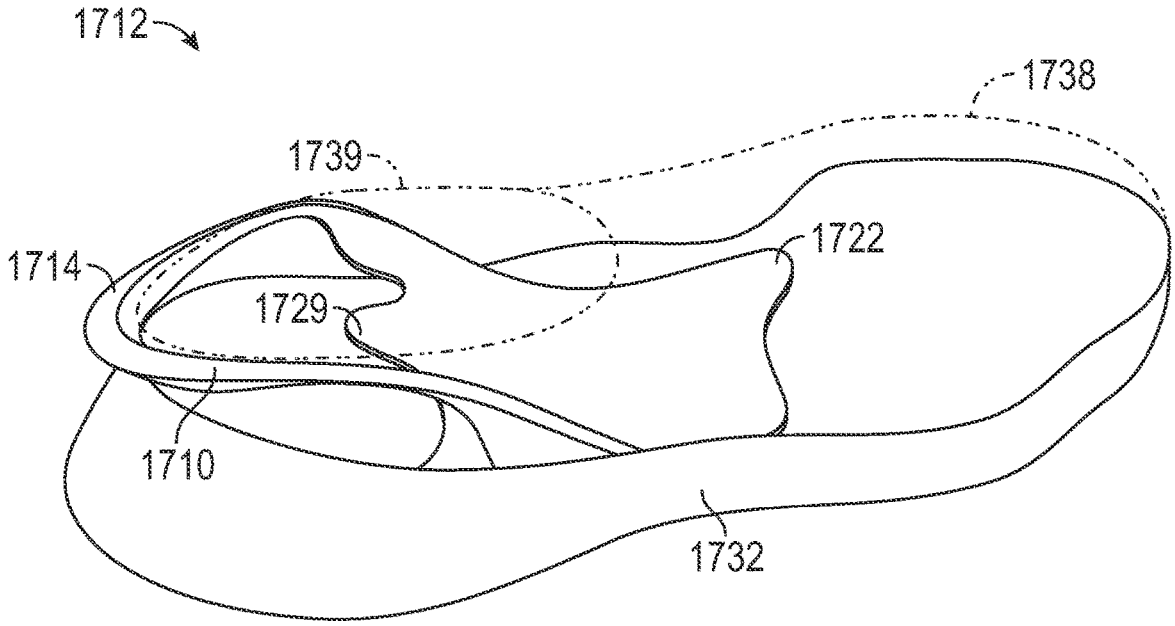
FIG. 38 is a schematic illustration in perspective view of the article of footwear of FIG. 37 with the heel spring device in a loaded position.

FIG. 36 shows another embodiment of a heel spring device 1710 for an article of footwear 1712 shown in FIGS. 37-38. The heel spring device 1710 has similar function and features as heel spring device 10. The device 1710 has a control bar 1714 with a center segment 1716, a medial side arm 1718 and a lateral side arm 1720. The device 1710 has a continuous base 1722 that connects the side arms 1718, 1720 and extends forward from a junction of the control bar 1714 with the base 1722.

As shown in FIG. 37, the heel spring device 1710 is secured to a sole structure 1732 at its base 1722, and to a flexible covering of a footwear upper 1738 (shown in phantom). The upper 1738 defines at least a portion of an ankle opening 1739 and a foot receiving void 1747. The base 1722 underlies the foot-receiving void 1747, may underlie a strobel in the article of footwear 1712, may be secured to the sole structure 1732 by bonding with adhesive or otherwise, or may simply be trapped between sole structure 1732 and a strobel or upper materials to reduce the need for adhesive. The base 1722 extends both slightly rearward from a junction of the control bar 1714 with the base 1722 as well as forward from the junction with the control bar 1714 to function as a support. The base 1722 has a forward-extending protrusion 1727 underlying the foot-receiving void adjacent the medial side 1741 of the footwear upper, and a rearward extending protrusion 1729 underlying the foot-receiving void along the lateral side 1743 of the footwear upper.

FIG. 37 shows the control bar 1714 biased to an unstressed position. FIG. 38 shows the control bar 1714 elastically bent under an applied force to a loaded position, widening the ankle opening 1739. The device 1710 stores elastic energy that returns the control bar 1714 to the unstressed position upon removal of the applied load.

Figure 39:
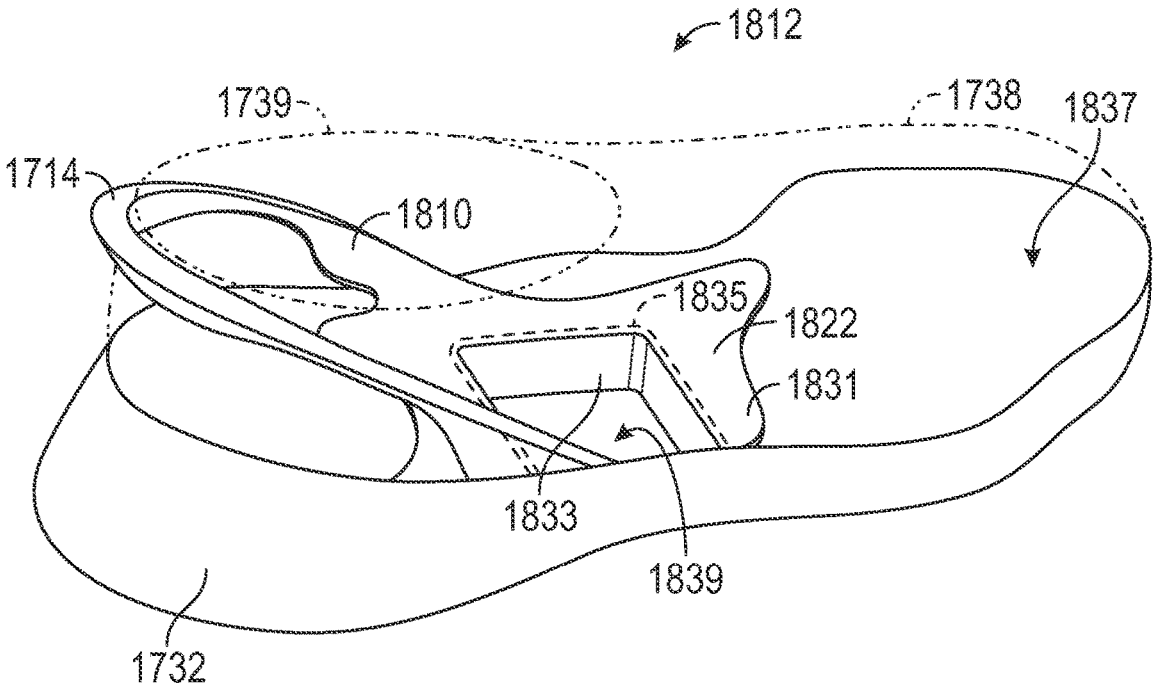
FIG. 39 is a schematic illustration in perspective view of an article of footwear with an alternative embodiment of a heel spring device in an unloaded position.
Figure 40:
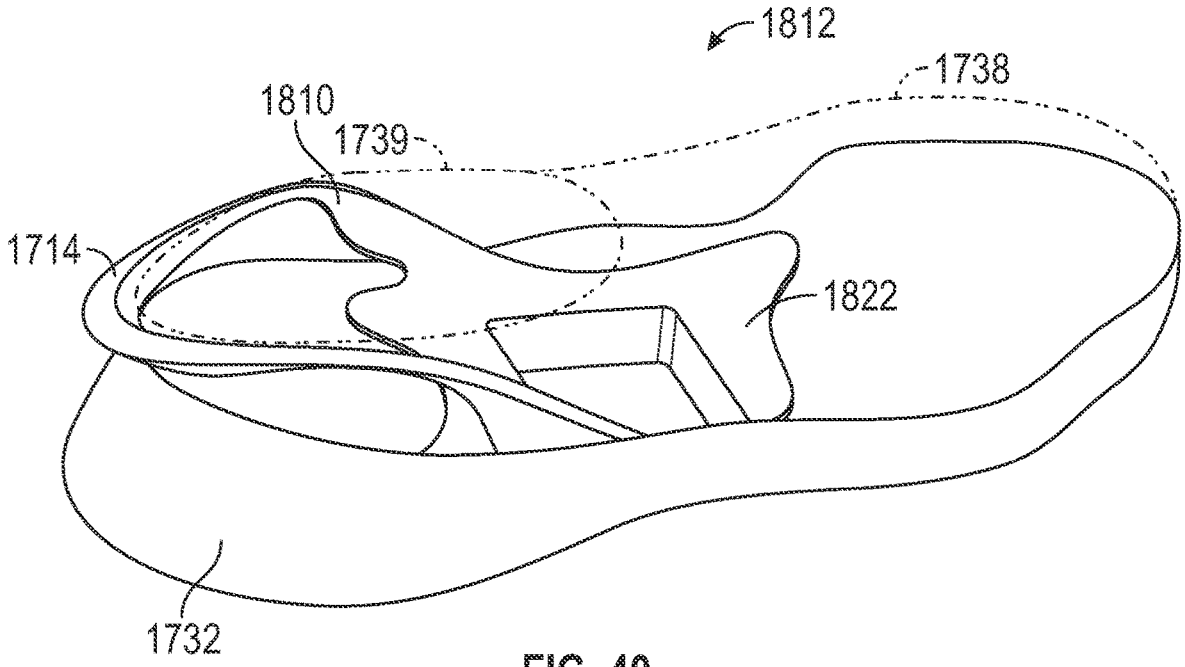
FIG. 40 is a schematic illustration in perspective view of the article of footwear of FIG. 39 with the heel spring device in a loaded position.

FIGS. 39-40 show an article of footwear 1812 with a heel spring device 1810. The article of footwear 1812 and the heel spring device 1810 are alike in many aspects to article of footwear 1712 and heel spring device 1710, and like reference numbers are used to refer to like components. The heel spring device 1810 is alike in all aspects to heel spring device 1710 except that the heel spring device 1810 has a continuous base 1822 with a main portion 1831 and a protrusion 1833 extending downward from the main portion into a recess 1835 in the foot-facing surface 1837 of the sole structure 1732. The protrusion 1833 is configured to seat in the recess 1835. Walls of the protrusion 1833 interface with walls of the sole structure 1732 at the recess 1835, lending stability to the base 1822. Additionally, the protrusion 1833 forms a cavity 1839 in the recess 1835, and the cavity may be used to house various footwear components or accessories, such as electronic accessories.

Figure 41:
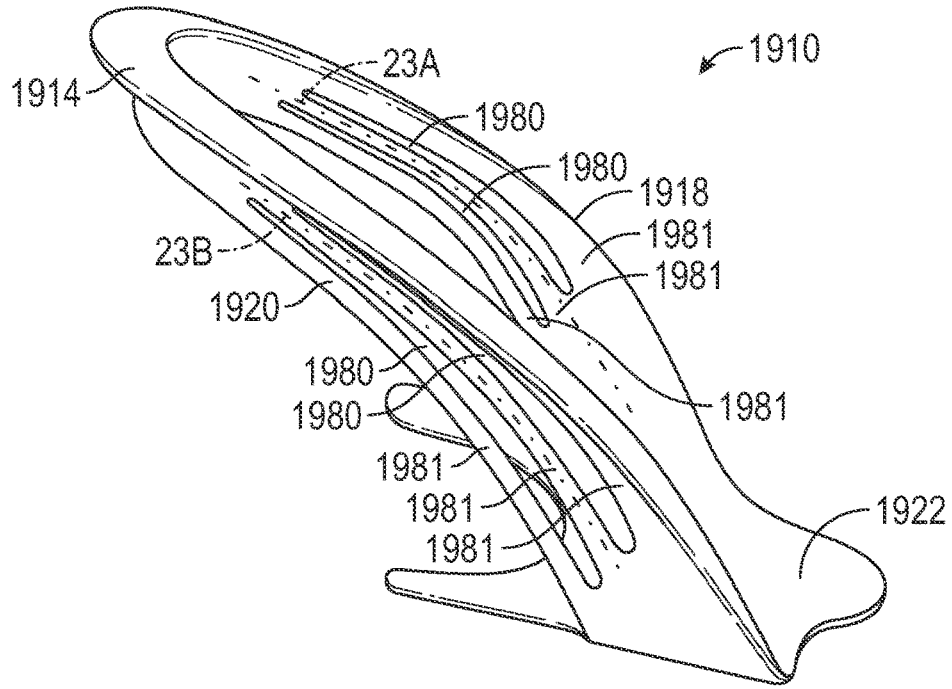
FIG. 41 is a schematic illustration in perspective view of an alternative embodiment of a heel spring device for an article of footwear.
Figure 42:
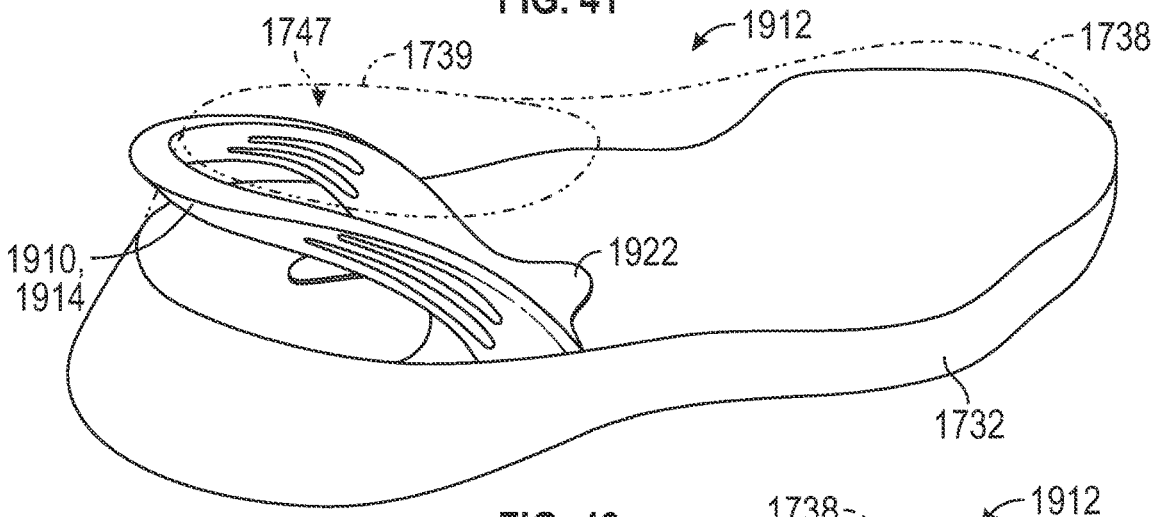
FIG. 42 is a schematic illustration in perspective view of an article of footwear with the heel spring device of FIG. 41 in an unloaded position.
Figure 43:
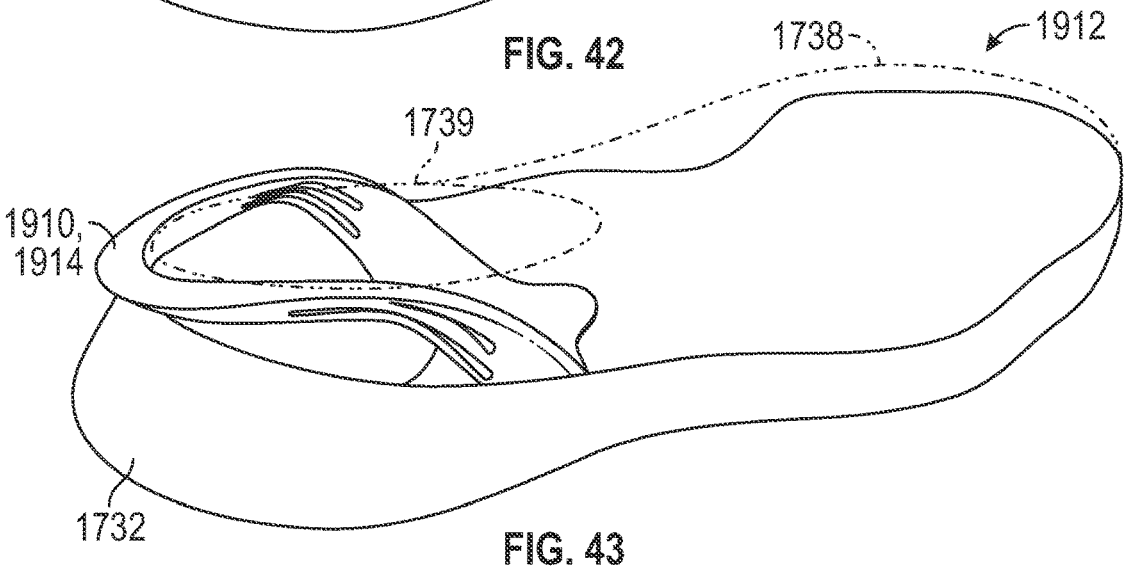
FIG. 43 is a schematic illustration in perspective view of the article of footwear of FIG. 42 with the heel spring device in a loaded position.

FIG. 41 shows another embodiment of a heel spring device 1910 for an article of footwear 1912 shown in FIGS. 42-43. The heel spring device 1910 has similar function and features as heel spring device 10. The device 1910 has a control bar 1914 with a medial side arm 1918 and a lateral side arm 1920. The device 1910 has a continuous base 1922 that connects the side arms 1918, 1920 and extends both forward and rearward from a junction of the control bar 1914 with the base 1922.

As shown in FIG. 42, the heel spring device 1910 is secured to the sole structure 1732 at its base 1922, and to the flexible covering of a footwear upper 1738 (shown in phantom), both of which are described with respect to FIG. 37. The base 1922 underlies the foot-receiving void 1747, may underlie a strobel in the article of footwear 1912, may be secured to the sole structure 1732 by bonding with adhesive or otherwise, or may simply be trapped between sole structure 1732 and a strobel or upper materials to reduce the need for adhesive.

The medial side arm 1918 and the lateral side arm 1920 each have at least one slot 1980 extending therethrough, and in the embodiment shown have multiple slots 1980. The slots 1980 extend through the first side arm 1918 and lengthwise along a longitudinal axis of the medial side arm 1918 (i.e., along the length of the side arm 1918). Separate slots 1980 extend through the lateral side arm 1920 and lengthwise along a longitudinal axis of the lateral side arm 1920 (i.e., along the length of the side arm 1920). The slots 1980 reduce the thickness of the side arms 1918, 1920, and accordingly reduce the force required to bend the side arms 1918, 1920. More specifically, with the slots 1980, each side arm is separated into multiple slats 1981 at the slots. The slats 1981 function as multiple thinner side arms that bend along their lengths in the region of the slots 1980. FIG. 42 shows the control bar 1914 biased to an unstressed position. FIG. 43 shows the control bar 1914 elastically bent under an applied force to a loaded position, widening the ankle opening 1739 and tilting the ankle opening downward and rearward in comparison to the unloaded position. A shown in FIG. 43, in the loaded position, the side arms 1918, 1920 may be configured so that at least portions of the slots 1980 close, causing the slats 1981 to contact one another, increasing stiffness and resistance to further bending. The device 1910 stores elastic energy that returns the control bar 1914 to the unstressed position upon removal of the applied load.

Figure 44:
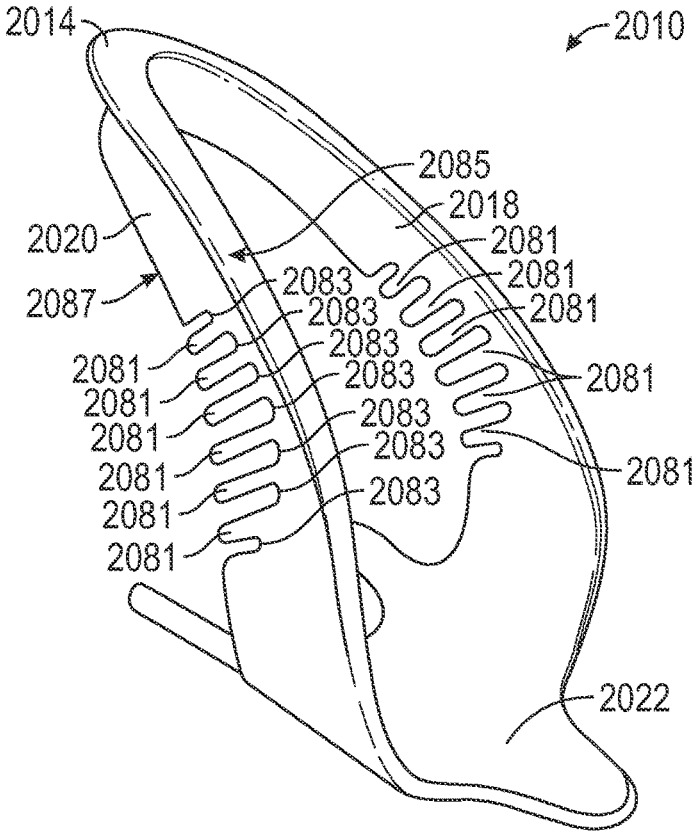
FIG. 44 is a schematic illustration in perspective view of an alternative embodiment of a heel spring device for an article of footwear.
Figure 45:
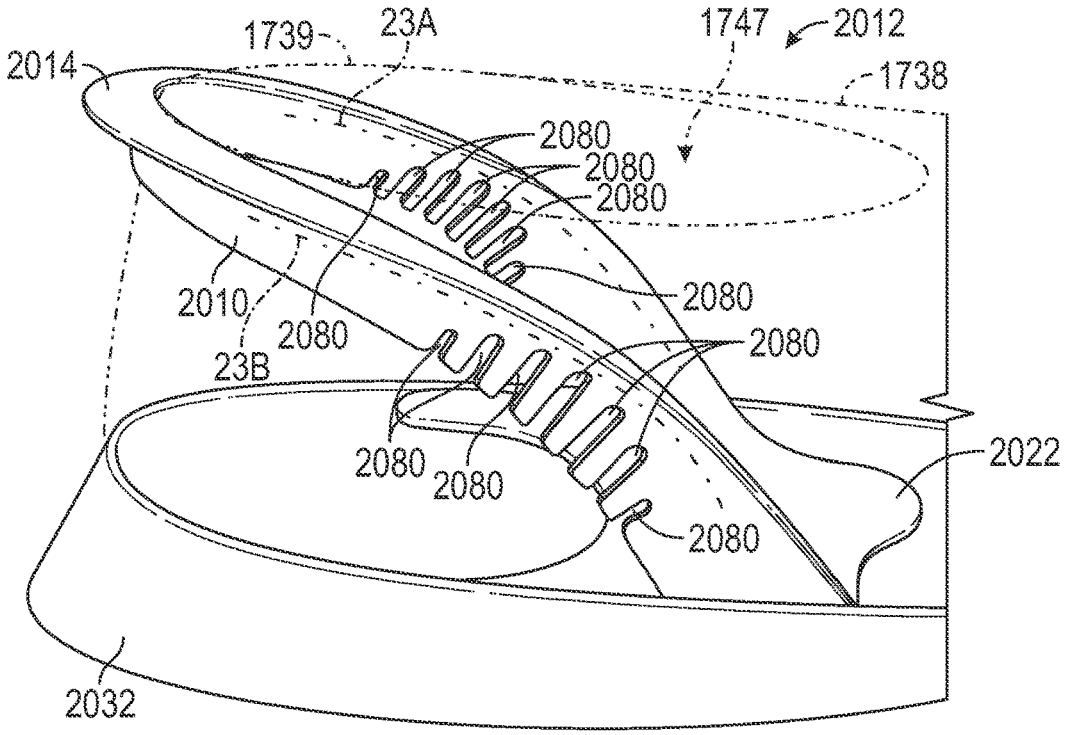
FIG. 45 is a schematic illustration in fragmentary perspective view of an article of footwear with the heel spring device of FIG. 44 in an unloaded position.
Figure 46:
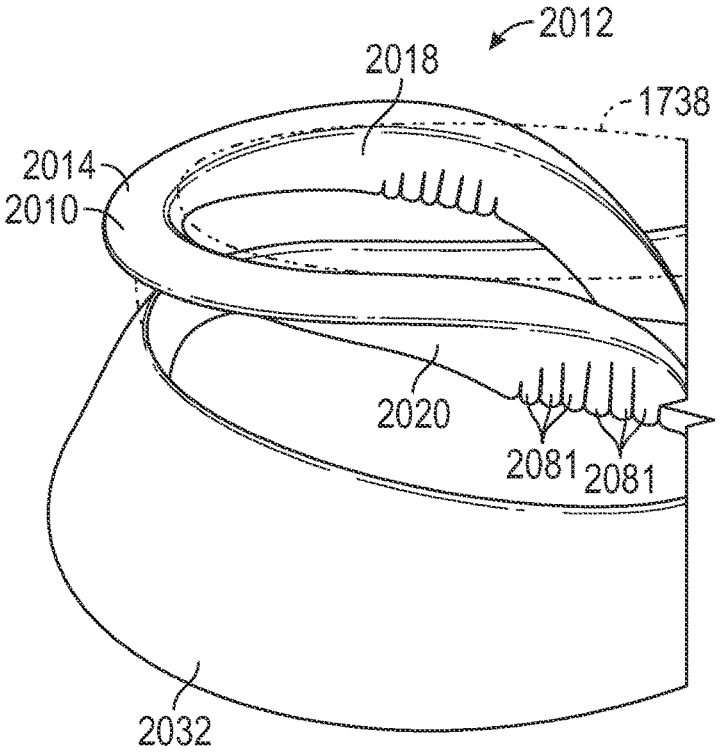
FIG. 46 is a schematic illustration in fragmentary perspective view of the article of footwear of FIG. 45 with the heel spring device in a loaded position.

FIG. 44 shows another embodiment of a heel spring device 2010 for an article of footwear 2012 shown in FIGS. 45-46. The heel spring device 2010 has similar function and features as heel spring device 10. The device 2010 has a control bar 2014 with a medial side arm 2018 and a lateral side arm 2020. The device 2010 has a continuous base 2022 that connects the side arms 2018, 2020 and extends both forward and rearward from a junction of the control bar 2014 with the base 2022.

As shown in FIG. 45, the heel spring device 2010 is secured to the sole structure 2032 at its base 2022, and to the flexible covering of a footwear upper 1738 (shown in phantom), both of which are described with respect to FIG. 37. The base 2022 underlies the foot-receiving void 1747, may underlie a strobel in the article of footwear 2012, may be secured to the sole structure 2032 by bonding with adhesive or otherwise, or may simply be trapped between sole structure 2032 and a strobel or upper materials to reduce the need for adhesive.

The medial side arm 2018 and the lateral side arm 2020 each have at least one slot 2080 extending therethrough, and in the embodiment shown have multiple slots 2080. The slots 2080 extend through the medial side arm 2018 and are transverse to a longitudinal axis 23A of the medial side arm 2018 (i.e., transverse to the length of the side arm 2018). Separate slots 2080 extend through the lateral side arm 2020 and are transverse to a longitudinal axis 23B of the lateral side arm 2020 (i.e., transverse to the length of the side arm 2020). The slots 2080 reduce the thickness of the side arms 2018, 2020, and accordingly reduce the force required to bend the side arms 2018, 2020. More specifically, with the slots 2080, each side arm is separated into multiple fingers 2081 at the slots 2080. The fingers 2081 function to reduce the thickness of the bending portion of the side arms 2018, 2020 to that of the thickness between the end 2083 of each slot 2080 and the upper surface 2085 of each of the side arms 2018, 2020, rather than the full thickness of the side arm from the upper surface 2085 to the lower surface 2087. The fingers 2081, ends 2083, and surfaces 2085, 2087 are labelled in FIG. 44 with respect to lateral side arm 2020 and apply equally to like features of medial side arm 2018. FIG. 45 shows the control bar 2014 biased to an unstressed position. FIG. 46 shows the control bar 2014 elastically bent under an applied force to a loaded position, widening the ankle opening 1739 in comparison to the unloaded position. A shown in FIG. 46, in the loaded position, the side arms 2018, 2020 may be configured so that at least portions of the slots 2080 close, causing the fingers 2081 to contact one another, increasing stiffness and resistance to further bending. The device 2010 stores elastic energy that returns the control bar 2014 to the unstressed position upon removal of the applied load.

Figure 47:
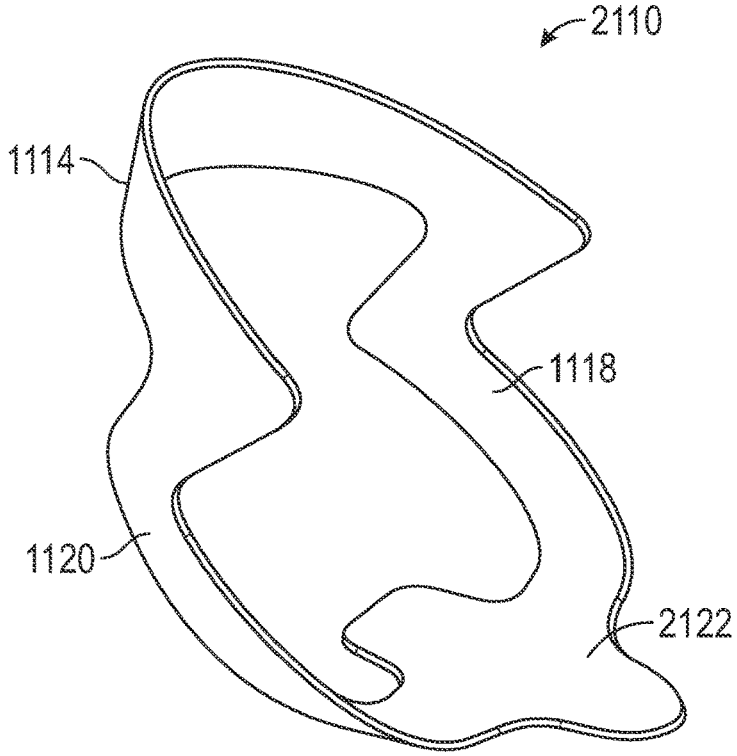
FIG. 47 is a schematic illustration in fragmentary perspective view of an alternative embodiment of a heel spring device for an article of footwear.
Figure 48:
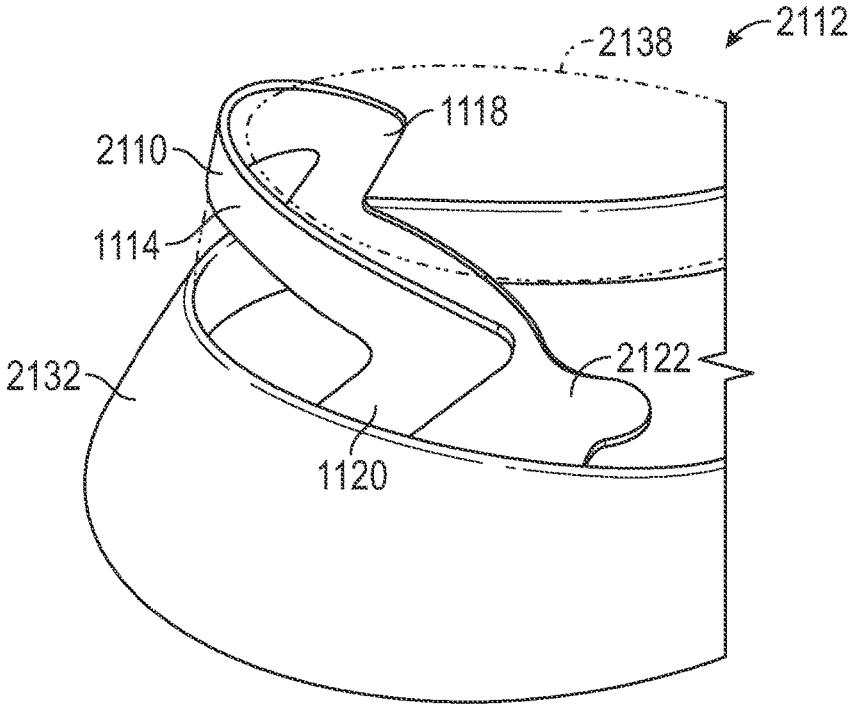
FIG. 48 is a schematic illustration in fragmentary perspective view of an article of footwear with the heel spring device of FIG. 47 in an unloaded position.

FIGS. 47-48 show another embodiment of a heel spring device 2110 with similar function and features as heel spring device 10 and as the heel spring device of FIG. 27. In FIG. 48, the device 2110 is shown in an article of footwear 2112 secured to a sole structure 2132 and to the flexible covering of a footwear upper 2138 (shown in phantom), both of which are similar to those described with respect to FIG. 37. The heel spring device 2110 is alike in all aspects to heel spring device 1110 except that it has a base 2122 that extends both forward and rearward from the side arms 1118, 1120 of the control bar 1114, unlike base 1122 that extends only rearward.

Figure 49:
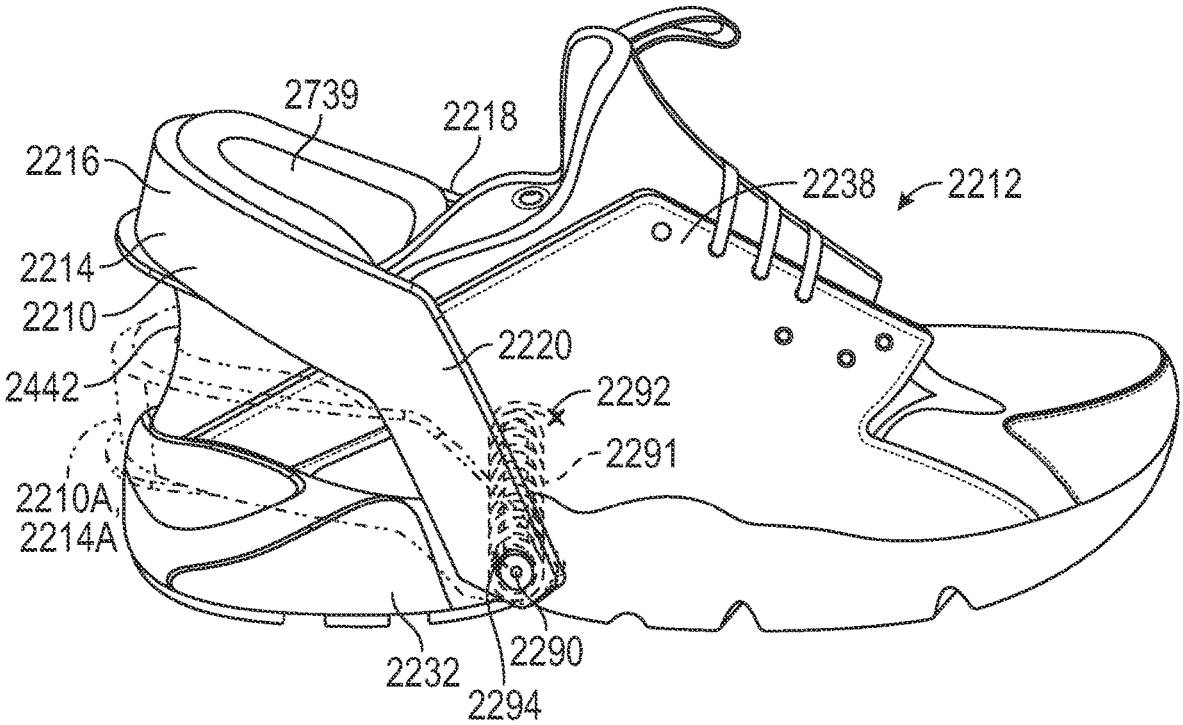
FIG. 49 is a schematic illustration in perspective view of an article of footwear with an alternative embodiment of a heel spring device in an unloaded position and showing the loaded position in phantom.

FIG. 49 shows an article of footwear 2212 with another embodiment of a heel spring device 2210. The heel spring device 2210 has similar function and features as heel spring device 10. The device 2210 has a control bar 2214 with a medial side arm 2218, a lateral side arm 2220, and a center segment 2216 connecting the side arms 2218, 2220 and from which the side arms extend generally downwardly and forwardly. The device 2210 is secured to a flexible footwear upper 2238 and to a sole structure 2232 similarly as described with respect to device 10 and article of footwear 12.

A pin 2290 is disposed substantially horizontally when the footwear 2212 is in the position of FIG. 49 resting on the sole structure. The pin 2290 extends transversely through the sole structure 2232 and serves as a continuous base and connects to the side arms 2218, 2220 at first and second joints. The pin 2290 is connected to the medial side arm 2218 and the lateral side arm 2220 where they interface with the sole structure 2232. The pin 2290 establishes a pivot axis along the length of the pin 2290 (transverse to the sole structure 2232) about which the control arm 2214 pivots between the unstressed position and the loaded position. A biasing element such as a torsion spring 2291 is wrapped around the pin 2290 with one end fixed to the pin 2290 and another end fixed to the sole structure 2232. For example, the pin 2290 has a first end 2292 fixed at the medial side of the sole structure and a second end 2294 fixed to the pin 2290. Pivoting of the control bar 2214 to the loaded position winds the torsion spring 2291, storing potential energy.

The control bar 2214 is biased to an unstressed position shown in solid. The control bar 1714 is shown in phantom as 2214A when the device 2210 is pivoted under an applied force to a loaded position, in which the device is indicated as 2210A. The ankle opening 2739 widens in the loaded position and may tilt downward and rearward relative to the unloaded position, as the flexible covering 2442 (also referred to as a flexible cover layer) of the upper 2238 is secured to the control bar 2214 and moves downward with the control bar 2214. The spring 2291 stores spring energy that returns the control bar 2214 to the unstressed position upon removal of the applied load.

Figure 50:
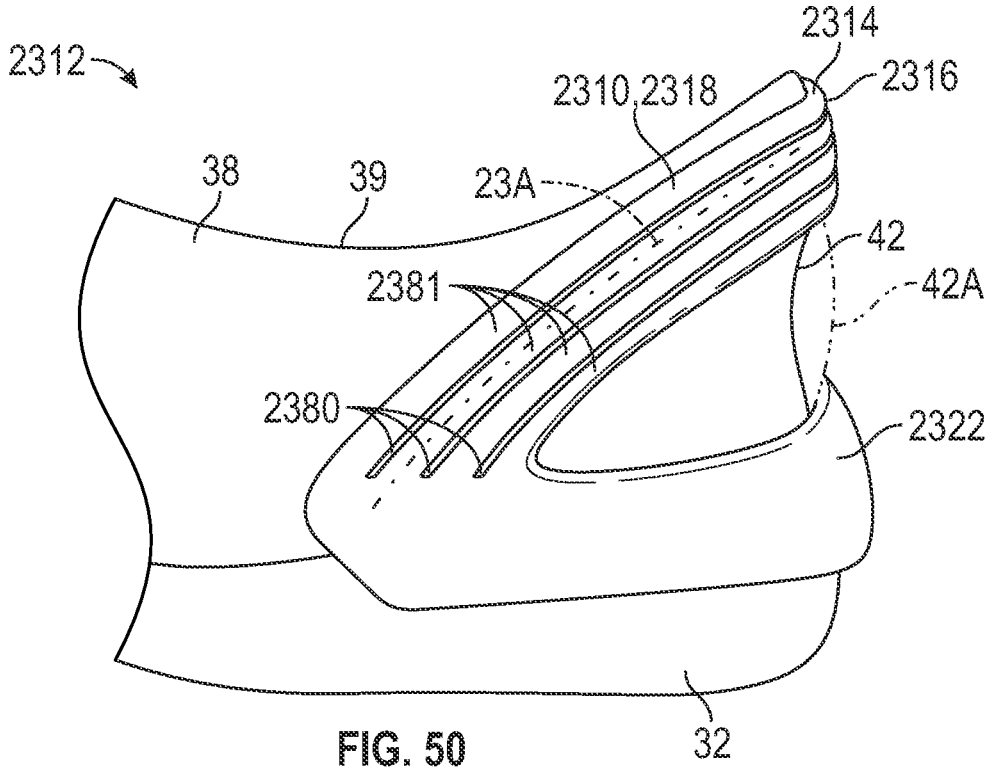
FIG. 50 is a schematic illustration in fragmentary side view of an article of footwear with an alternative embodiment of a heel spring device in an unloaded position.
Figure 51:
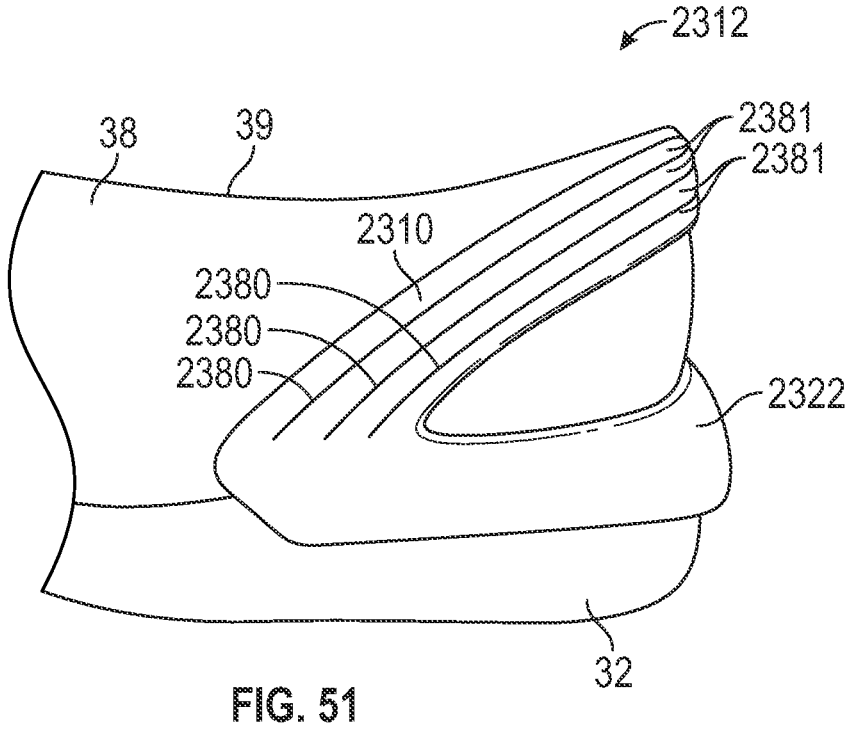
FIG. 51 is a schematic illustration in fragmentary side view of the article of footwear of FIG. 50 with the heel spring device in a loaded position.

FIGS. 50-51 show an article of footwear 2312 with another embodiment of a heel spring device 2310. The heel spring device 2310 has similar function and features as heel spring device 10. The device 2310 has a control bar 2314 with a medial side arm 2318 and a lateral side arm (not shown, but a mirror image of medial side arm 2318). The device 2310 has a continuous base 2322 that connects the side arms and extends both forward and rearward from a junction of the control bar 2314 with the base 2322 similar to base 22 of FIG. 1.

As shown in FIGS. 50-51, the heel spring device 2310 is secured to the sole structure 32 at its base 2322, and to the flexible covering of a footwear upper 38, both of which are described with respect to FIGS. 5-6.

The control bar 2314 has at least one slot 2380 that extends continuously from the first side arm 2318, across the center segment 2316, to the second side arm, and extends through the first side arm 2318, through the center segment 2316, and through the second side arm (mirror image of slots as shown). In the embodiment shown, there are multiple slots 2380. The same slots 2380 that extend through the first side arm 2318 and lengthwise along a longitudinal axis of the first side arm 2318 (i.e., along the length of the side arm 2318) also extend through the second side arm and lengthwise along a longitudinal axis of the second side arm (i.e., along the length of the second side arm). The slots 2380 reduce the thickness of the side arms, and accordingly reduce the force required to bend the side arms. More specifically, with the slots 2380, each side arm is separated into multiple slats 2381 at the slots. The slats 2381 function as multiple thinner side arms that bend along their lengths in the region of the slots 2380.

FIG. 50 shows the control bar 2314 biased to an unstressed position. FIG. 51 shows the control bar 2314 elastically bent under an applied force to a loaded position, widening the ankle opening 39 and tilting the ankle opening downward and rearward in comparison to the unloaded position. A shown in FIG. 51, in the loaded position, the side arms 2318 (and second side arm not shown) may be configured so that at least portions of the slots 2380 close, causing the slats 2381 to contact one another, increasing stiffness. However, the slats 2381 can slide against one another when they come into contact due to the slots 2380 closing. The sliding enables further bending to continue at a reduced stiffness in comparison to a control bar like control bar 2314 but without slots. FIG. 51 shows a slight stagger at the rear of the stacked slats 2381, indicating that they have slid relative to one another with the slots closed. The device 2310 stores elastic energy that returns the control bar 2314 to the unstressed position upon removal of the applied load.

Figure 52:
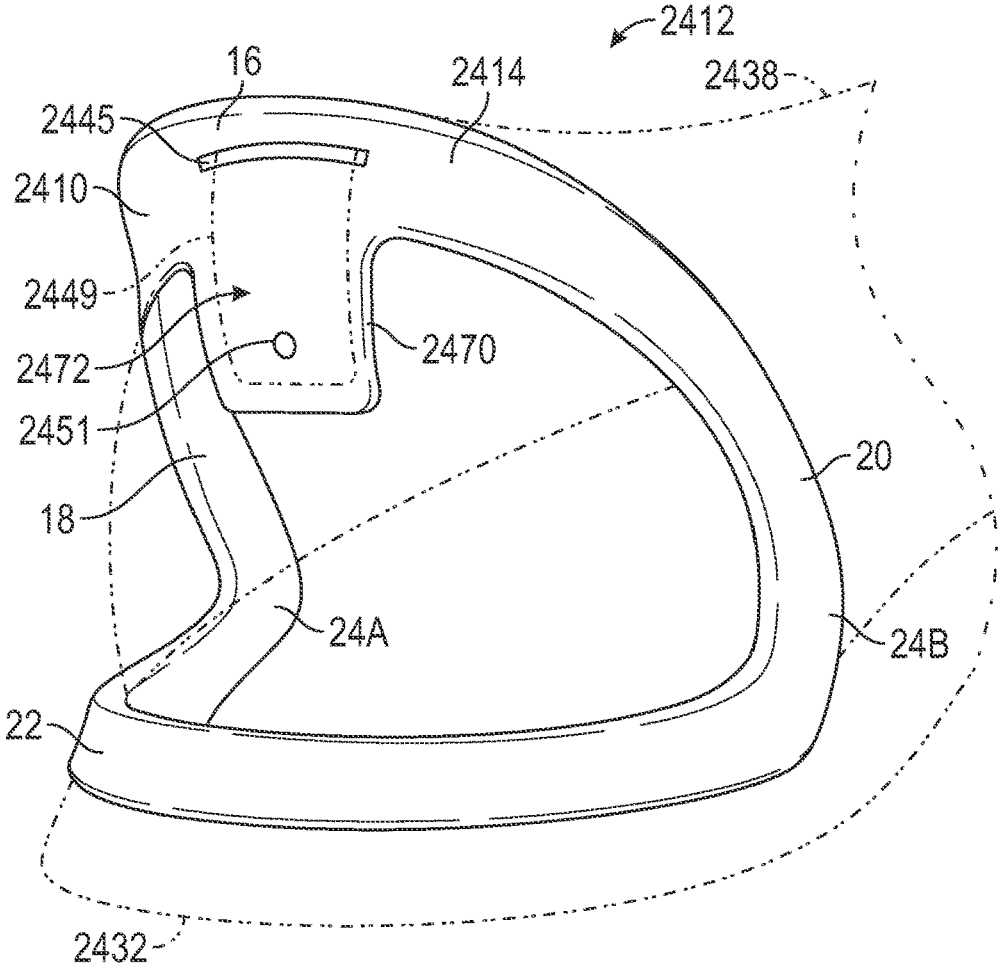
FIG. 52 is a schematic illustration in perspective view of an alternative embodiment of a heel spring device in an unloaded position and showing a fragmentary upper and sole structure in phantom.

FIG. 52 shows an article of footwear 2412 with another embodiment of a heel spring device 2410. The heel spring device 2410 has similar function and features as heel spring device 10. The device 2410 has a control bar 2414 with a medial side arm 18 and a lateral side arm 20, and a center segment 16 connecting the side arms 18, 20 and from which the side arms extend generally downwardly and forwardly. The device 2410 has a continuous base 22 that connects the side arms 18, 20 at first and second joints 24A, 24B, described with respect to FIG. 1. The device 2410 is secured to a flexible footwear upper 2438 and to a sole structure 2432 similarly as described with respect to device 10.

The center segment 16 has an aperture 2445, and the upper 2438 has a heel pull tab 2449 that extends through the aperture 2445, further securing the upper 2438 to the device 2410. The center segment 16 also has an extension 2470 that extends downward from the center segment 16 and may limit bending of the device 10 by interference with the base 22, similarly as described with respect to extension 70. The extension 2470 has a fastener opening 2451 that receives a stud (not shown) that can be used to secure the heel pull tab 2449 to the extension 2470 with a fastener such as a stud, a snap, or a button. Alternatively, or in addition, the heel pull tab 2449 may be secured to a mounting surface 2472 of the extension 2470 with adhesive or otherwise.

Figure 53:
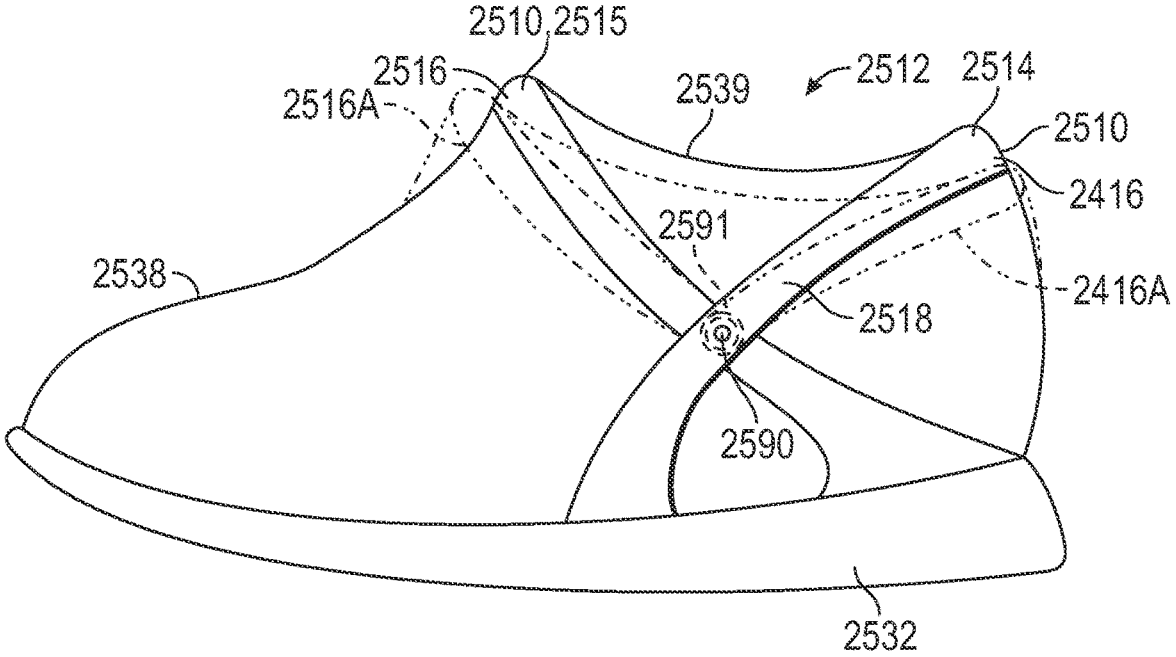
FIG. 53 is a schematic illustration in side view of an article of footwear with an alternative embodiment of a heel spring device in an unloaded position and showing a loaded position in phantom.

FIG. 53 shows an article of footwear 2512 with another embodiment of a heel spring device 2510. The heel spring device 2510 has a rear control bar 2514 with a medial side arm 2518 secured at a medial side of the footwear and a lateral side arm (not shown) that is a mirror image of the medial side arm 2518 but is secured at the lateral side of the footwear 2512. The rear control bar 2514 also has a center segment 2516 connecting the medial and lateral side arms and from which the side arms extend generally downwardly and forwardly. The device has a front bar 2515 that also has a medial side arm, a lateral side arm, and a center segment 2516 connecting the medial and lateral side arms. A flexible footwear upper 2538 is secured to the center segment 2516 of the front bar 2515, to the center segment 2416 of the rear control bar 2514, as well as to the medial and lateral side arms of the rear control bar 2514 and the front bar 2515. The relative positions of the center segments 2416, 2516 thus determine the fore-aft expanse of the ankle opening 2539 formed by the upper 2538.

The bars 2514 and 2515 may be anchored at their ends to the sole structure 2532. The bars 2514, 2515 are positioned to cross one another at both the medial and lateral sides, and are pivotably secured to one another at a connection 2590 (one shown) at both the lateral and medial sides where they cross. The connection 2590 may be a pin joint. A torsion spring 2591 may be operatively secured at the connection. Upper portions of the bars 2514, 2515 may be elastically bendable so that the center segments 2416 and 2516 can move apart from one another when a force is applied on the center segment 2416, such as the force of a foot gaining entry to the upper 2538. Positions of the center segments 2416, 2516 under loading are shown in phantom as 2416A, 2516A. The device 2510 stores potential energy, such as elastic energy and/or spring energy, that returns the rear control bar 2514 to the unstressed position upon removal of the applied force (i.e., after a foot slides into the foot-receiving cavity of the upper 2538).

Figure 54:
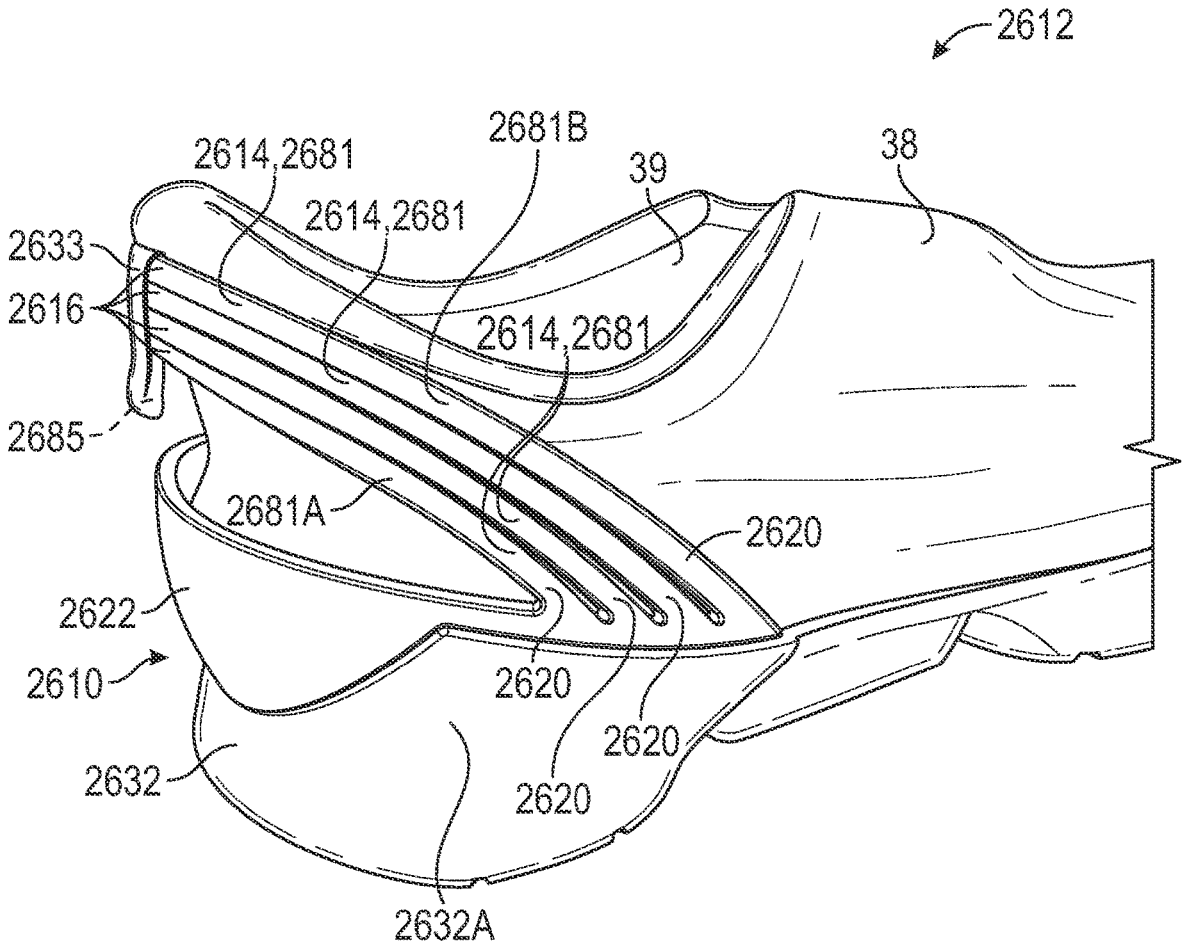
FIG. 54 is a schematic illustration in fragmentary perspective view of an article of footwear with an alternative embodiment of a heel spring device in an unloaded position.

FIG. 54 shows an article of footwear 2612 with another embodiment of a heel spring device 2610. The heel spring device 2610 has similar function and features as heel spring device 2310. The device 2610 has a control bar 2614 with a series of slats 2681, and multiple slots 2680, best shown in FIG. 55. Each slat 2681 has a center segment 2616, a medial side arm 2618 (best shown in FIG. 57) and a lateral side arm 2620. The lateral side arm 2620 and the medial side arm 2618 may be configured as mirror images of each other in one or more embodiments. The device 2610 has a continuous base 2622 that underlies the control bar 2614, and that connects the side arms 2618, 2620 and extends both forward and rearward from a junction of the control bar 2614 with the base 2622 similar to base 22 of FIG. 1. As is evident from FIGS. 57 and 58, the device 2610 has a concave inner surface 2611 with a concavity in both the medial-lateral and vertical directions.

The article of footwear 2612 includes a sole structure 2632 and a footwear upper 38 with a flexible covering which is described with respect to FIGS. 5-6. The heel spring device 2610 is secured to the flexible covering of the footwear upper 38 via a strap 2633 that has a pocket 2635, as described with respect to FIGS. 59-60.

Figure 55:
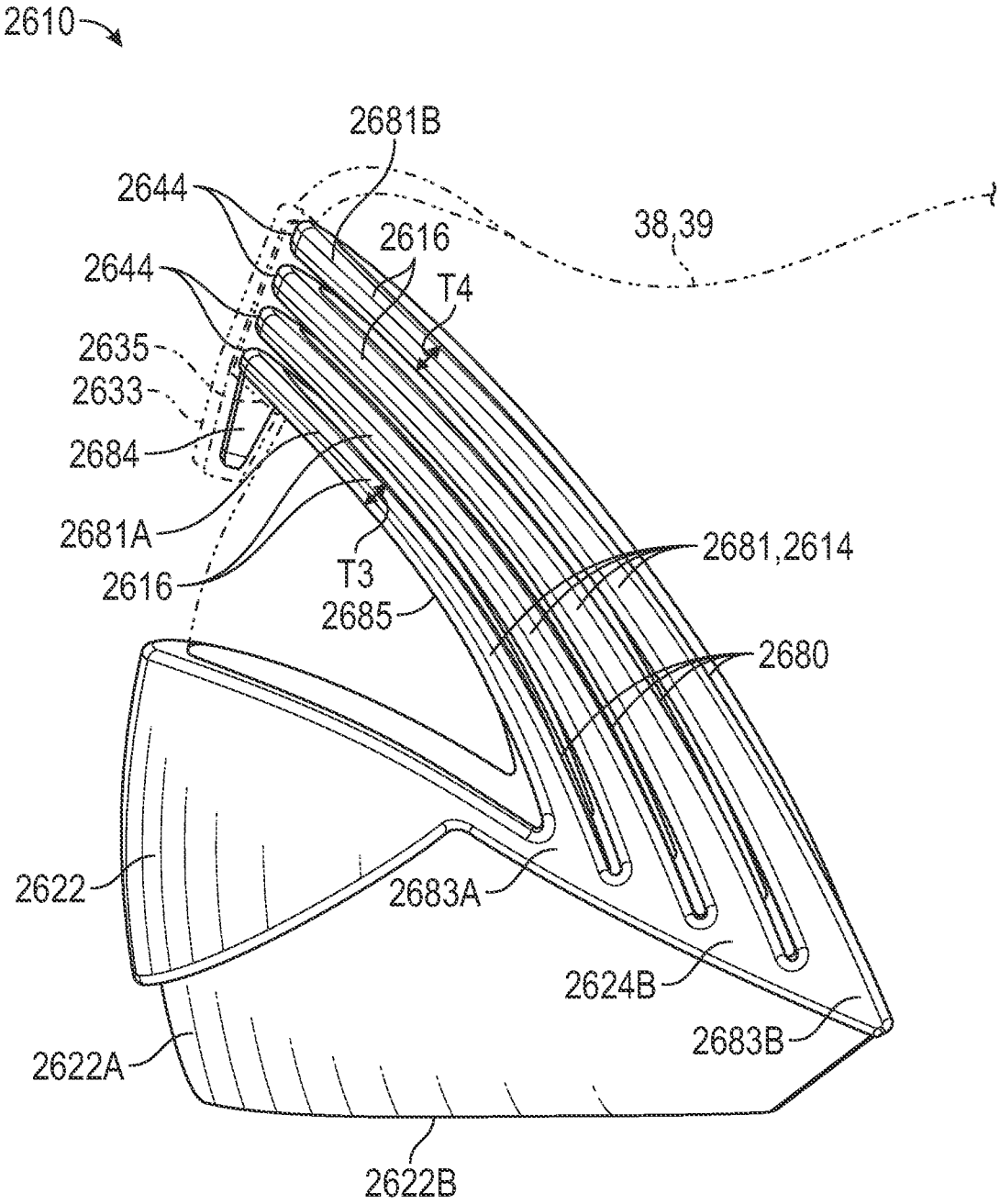
FIG. 55 is a schematic illustration in side perspective view of the lateral side of the heel spring device of FIG. 54 in an unloaded position.
Figure 56:
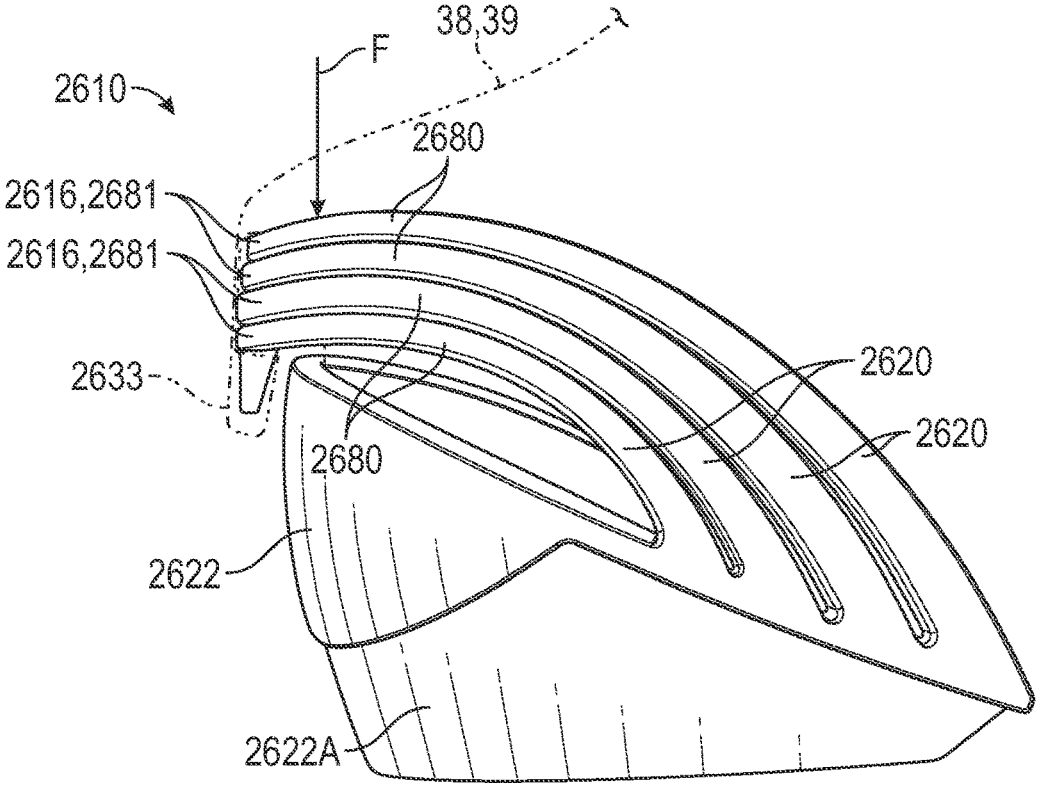
FIG. 56 is a schematic illustration in perspective lateral view of the heel spring device of FIG. 54 in a loaded position.

The heel spring device 2610 is also secured to the sole structure 2632 at the base 2622 of the heel spring device 2610, as shown in FIG. 54. As shown in FIGS. 55-56, the outer surface of the base 2622 of the device 2610 has a peripheral recess 2622A extending from a lower edge 2622B of the base 2622. The peripheral recess 2622A is shown at the lateral side of the base 2622 in FIGS. 55, 56 and extends around to the medial side of the base 2622 in a mirror image of the lateral side. The peripheral recess 2622A is shaped and dimensioned to receive a flange 2632A of the sole structure 2632, shown in FIG. 54. The flange 2632A may be adhered or heat bonded to the base 2622 in the peripheral recess 2622A. The sole structure 2632 thus provides lateral support to the base 2622.

The control bar 2614 is biased to an unloaded position shown in FIG. 55, and elastically bends under an applied force F to a loaded position shown in FIG. 56, in which each center segment 2616 is closer to the base 2622 than in the unloaded position, storing potential energy that returns the control bar 2614 to the unloaded position upon removal of the applied force F. The control bar 2614 and the base 2622 are configured as a full elliptical leaf spring. The device 2610 may be a resiliently bendable nylon or another resiliently bendable material. The center segment 2616 is spaced apart from the base 2622, and the device 2610 is characterized by the absence of a rigid heel counter between the center segment 2616 and the base 2622 aft of a junction 2624A of the medial side arm 2618 and the base 2622 (represented in FIG. 57 and a mirror image of junction 2624B) and aft of a junction 2624B between the lateral side arm 2620 and the base 2622. The device 2610 functions at least in some respects as a heel counter in that it helps to retain a wearer's heel in position atop a heel portion of the sole structure, preventing medial or lateral displacement during use.

Figure 57:
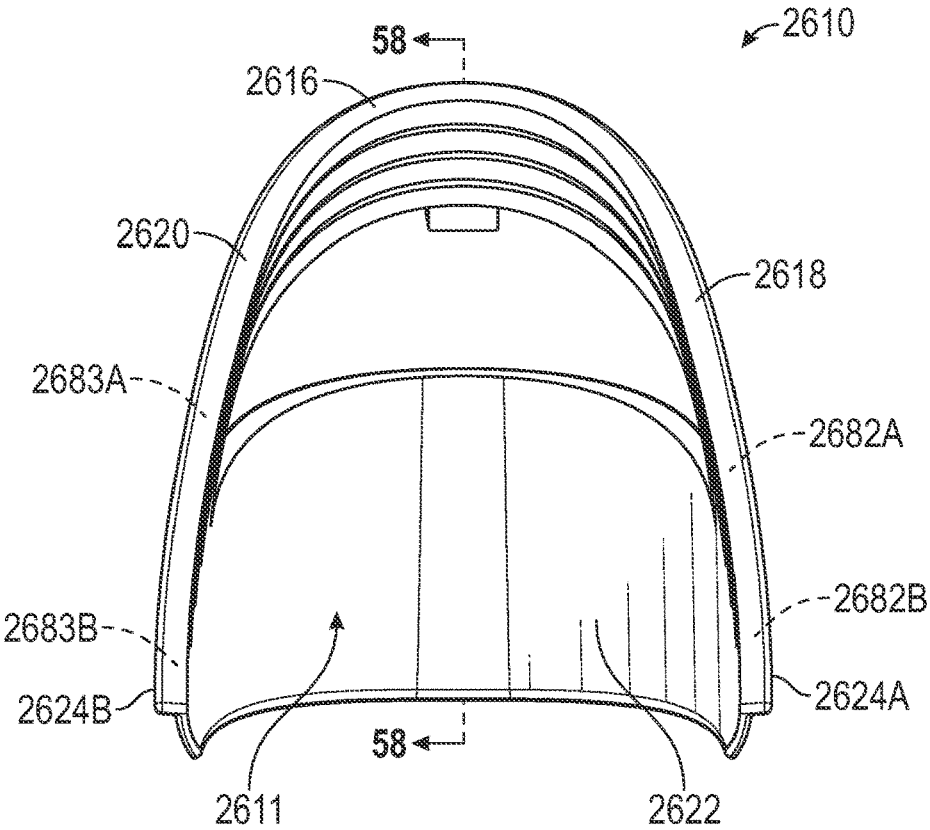
FIG. 57 is a schematic illustration in front view of the heel spring device of FIG. 54.
Figure 58:
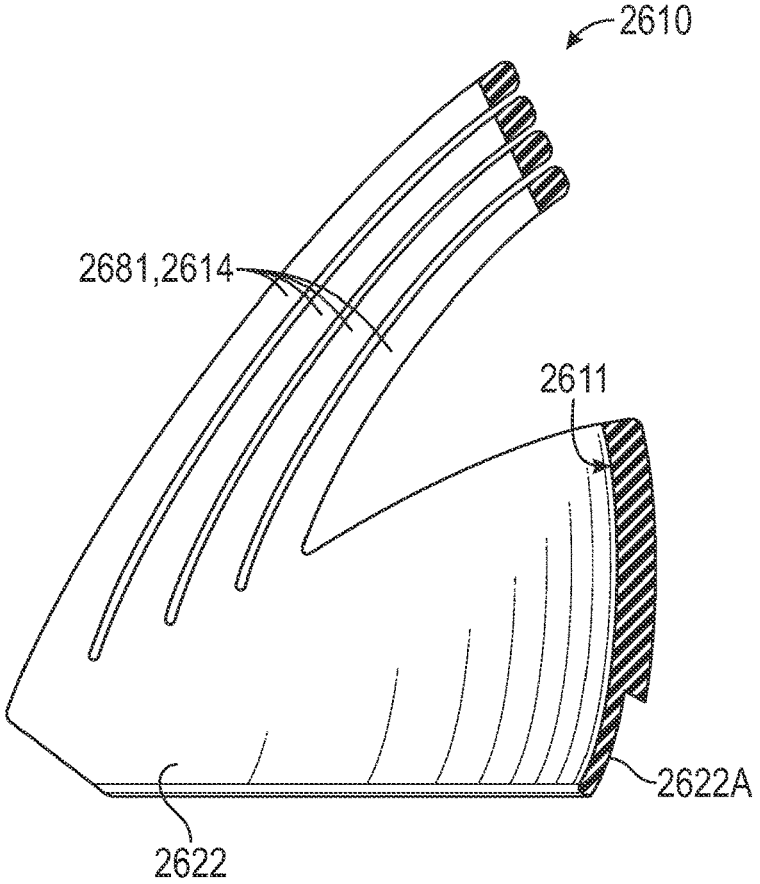
FIG. 58 is a schematic cross-sectional illustration of the heel spring device of FIG. 57 taken at lines 58-58 in FIG. 57.

The slots 2680 reduce the amount of material between an uppermost one 2681B of the slats and a lowermost one 2681A of the slats at the side arms as shown in FIG. 55, and accordingly reduce the force required to bend the side arms. More specifically, with the slots 2680, the slats 2681 function as multiple thinner side arms that bend along their lengths in the region of the slots 2680. A lowermost one 2681A of the slats 2681 closest to the base 2622 at the center segment 2616 is shorter from its medial end 2682A to its lateral end 2683A than is an uppermost one 2681B of the slats 2681 from its medial end 2682B to its lateral end 2683B, where the uppermost slat 2681B is furthest from the base 2622. The medial ends 2682A, 2682B are indicated in FIG. 57 and are a mirror image of lateral ends 2683A, 2683B shown in FIG. 55.

In one or more embodiments, the lowermost one of the slats 2681A is thinner than the uppermost one of the slats 2681B at any location along their lengths between the medial ends and the lateral ends, as is evident by comparing thickness T3 of the lowermost slat 2681A to thickness T4 of the uppermost slat 2681B in the exemplary embodiment of FIG. 55. Stated differently, while the thickness of slat 2681A may vary from its medial end to its lateral end, and the thickness of slat 2681B may vary from its medial end to its lateral end, at any given position between the medial end and the lateral end of slat 2681A, the thickness of slat 2681A will be less than the thickness of slat 2681B along a line perpendicular to the longitudinal axis of slat 2681A.

The slats 2681 are spaced apart from one another by the slots 2680 when the control bar 2614 is in the unloaded position of FIGS. 54-55. The slots 2680 close between the slats 2681 at least at some portion of the slots 2680 so that adjacent center segments 2616 contact one another in the loaded position of FIG. 56. In the embodiment shown, the slots 2680 close at the center segments 2616 in the loaded position, but may remain open at the side arms 2618, 2620. The slots 2680 are parallel with one another, and exterior sides 2644 of the slats 2681 are flush with one another in the unloaded position shown in FIG. 55. The slots 2680 enable the control bar 2614 to bend with less resistance (i.e., lower stiffness) than if the control bar 2614 were of the same overall thickness as the multiple slats 2681 from the uppermost slat 2681B to the lowermost slat 2681A. The slats 2681 can slide against (but not past) one another when they come into contact due to the slots 2680 closing, in a typical embodiment corresponding to FIG. 55. The sliding enables further bending to continue at a reduced stiffness in comparison to a control bar configured in the manner of control bar 2614 but without slots. FIG. 56 shows a slight stagger at the rear of the stacked slats 2681, indicating that they have slid relative to one another with the slots 2680 closed.

FIG. 55 shows the control bar 2614 biased to an unstressed (i.e., unloaded) position. FIG. 56 shows the control bar 2614 elastically bent under an applied force F (such as a force from a foot sliding into the article of footwear) to a loaded position, which will widen the ankle opening 39 of the upper 38 of FIG. 54 in comparison to the unloaded position as the upper 38 moves with the control bar 2614 in the heel region. A heel region of the upper 38 rearward of the ankle opening 39 moves with the center section 2616 of the control bar closer to the base 2622 when the force F is applied, causing the ankle opening 39 to enlarge or at least change the position of the ankle opening such that it may tilt downward and rearward relative to the unloaded position and is accessible for foot entry in a downward and forward direction from the rear, rather than only downward, as best shown by comparing the position of the ankle opening 39 in FIG. 56 to the position of the ankle opening 39 in FIG. 55.

More specifically, the upper 38 is connected to the heel spring device 2610 via an extension 2684 and a strap that has a pocket 2635. With reference to FIG. 55, the lowermost slat 2681A has an extension 2684 extending from a lower edge 2685 of the center segment 2616. The extension 2684 extends at least partially downward from the center segment 2616, at least partially toward the base 2622. As shown in FIG. 55, the extension 2684 extends downward and rearward when the control arm 2614 is in the unloaded position. In the loaded position of FIG. 56, the extension points straighter downward than in the unloaded position. Additionally, the control bar 2614 and the extension 2684 are configured to move clear of the base 2622 such that the extension is rearward of the base 2622 when the control arm 2614 is in the loaded position. No recess is needed in the base 2622 in such an embodiment.

Figure 59:
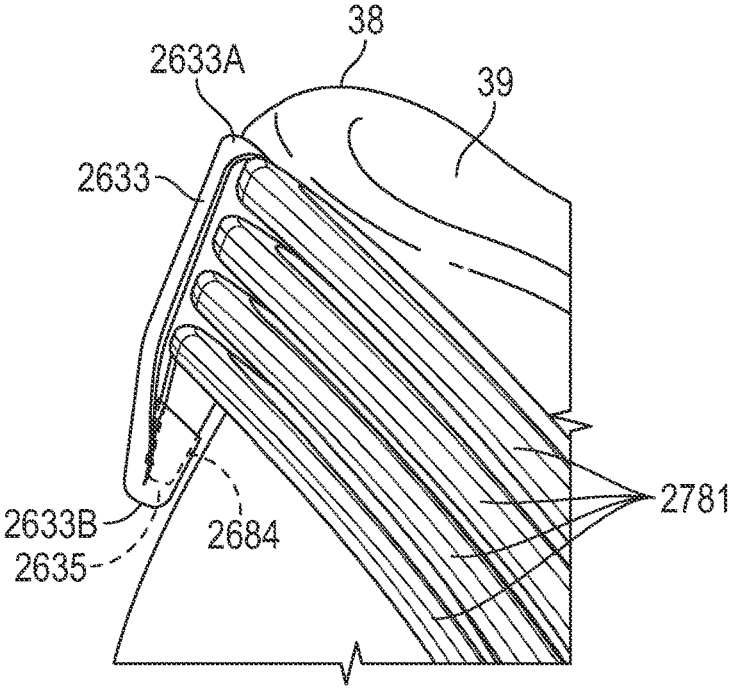
FIG. 59 is a schematic illustration in fragmentary side view of a portion of the article of footwear of FIG. 54 including a strap secured to an upper.
Figure 60:
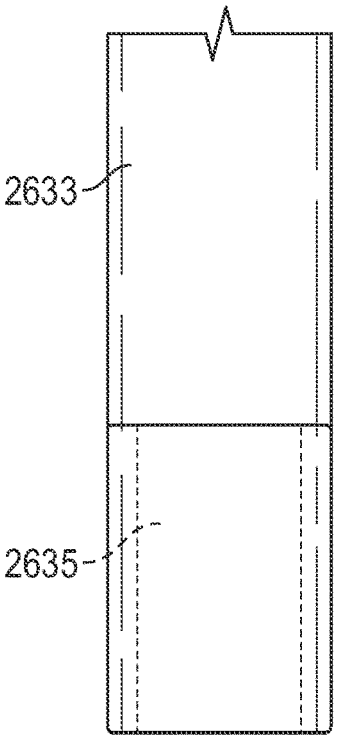
FIG. 60 is a schematic illustration in fragmentary view of a portion of the strap of FIG. 59.

With reference to FIGS. 54, 59, and 60, a strap 2633 has a proximal end 2633A sewn, integrally formed with, or otherwise connected to the upper 38 near the ankle opening 39 at the rear of the upper 38. The strap 2633 has a pocket 2635 at a distal end 2633B. The pocket 2635 may be formed, for example, by folding the strap 2633 over on itself at the distal end 2633B and stitching the folded portion to the remainder of the strap 2633. The strap 2633 extends downward from the upper 38. The strap 2633 is placed over and rearward of the control bar 2614, and the extension 2684 is then disposed in the pocket 2635 with the strap 2633 overlaying the center segment 2616. The extension 2684 and strap 2633 are thus used to operatively connect the upper 38 to the control bar 2614 so that the portion of the upper 38 rearward of the ankle opening 39 will move downward with the control bar 2614 to the loaded position, easing foot entry into the foot-receiving cavity of the upper 38 through the ankle opening 39, and then move back upward with the control bar to the unloaded position when the force F is removed, placing the upper 38 around the back of a foot that has been inserted into the foot-receiving cavity.

Figure 61:
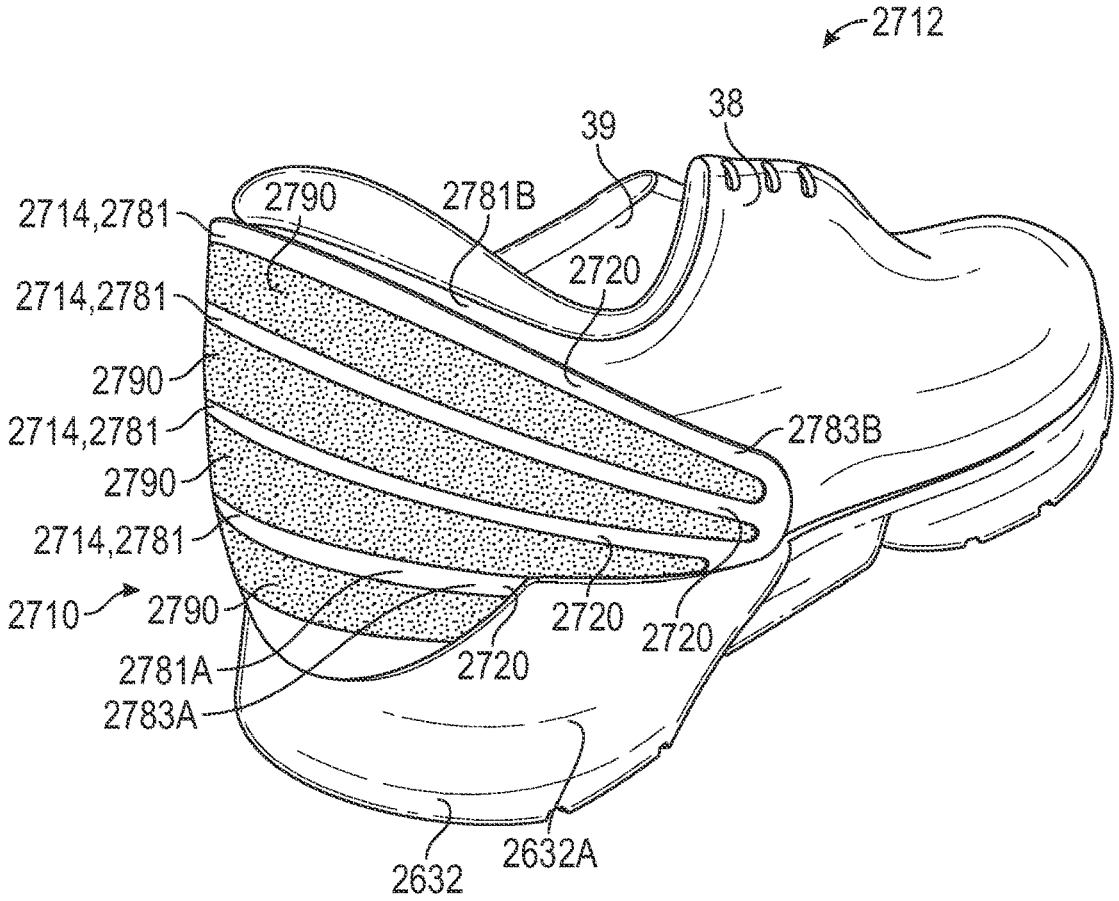
FIG. 61 is a schematic illustration in perspective view of an article of footwear with an alternative embodiment of a heel spring device in an unloaded position.

FIG. 61 shows an article of footwear 2712 with another embodiment of a heel spring device 2710. Like reference numbers are used to refer to components identical to those described with respect to article of footwear 2612 and heel spring device 2610. The heel spring device 2710 has similar function and features as heel spring device 2610. The device 2710 has a control bar 2714 with a series of slats 2781, and multiple slots 2780 best shown in FIG. 63. Each slat 2781 has a center segment 2716, a medial side arm 2718 (best shown in FIG. 62A) and a lateral side arm 2720, best shown in FIG. 61. The lateral side arm 2720 and the medial side arm 2718 are mirror images of each other. The device 2710 has the continuous base 2622, as described with respect to FIGS. 54 and 55, that underlies the control bar 2714, and that connects the side arms and extends rearward from a junction of the control bar 2714 with the base 2622. As is evident from FIGS. 65 and 66, the device 2710 has a concave inner surface 2711 with a concavity in both the medial-lateral and vertical directions.

The slots 2780 reduce the amount of material between an uppermost one 2781B of the slats and a lowermost one 2781A of the slats at the side arms, and accordingly reduce the amount of force required to bend the side arms via the force F applied to the center segment 2616. More specifically, due to the slots 2780, the slats 2781 function as multiple thinner side arms that bend along their lengths in the region of the slots 2780. As shown in FIGS. 61 and 63, a lowermost 2781A one of the slats 2781 closest to the base 2622 at the center segment 2716 is shorter from its medial end 2782A to its lateral end 2783A than is an uppermost one 2781B of the slats 2681 from its medial end 2782B to its lateral end 2783B, where the uppermost slat 2781B is furthest from the base 2622. The medial ends 2782A, 2782B are indicated in FIG. 62A and are a mirror image of lateral ends 2783A, 2783B.

At any point along the lowermost one of the slats 2781A, the lowermost one of the slats 2781A is thinner than any one of the other slats at a corresponding point (e.g., at a point directly aligned above the point along the lowermost one of the slats), as best shown in FIG. 63. The thickness of a slat is measured along its longitudinal axis. While the thickness of slat 2781A may vary along its longitudinal axis from its medial end to its lateral end, and the thickness of slat 2781B may vary along its longitudinal axis from its medial end to its lateral end, at any given point between the medial end and the lateral end of slat 2781A, the thickness of slat 2781A will be less than the thickness of slat 2781B at a point directly aligned above the point along slat 2781A.

Figure 62A:
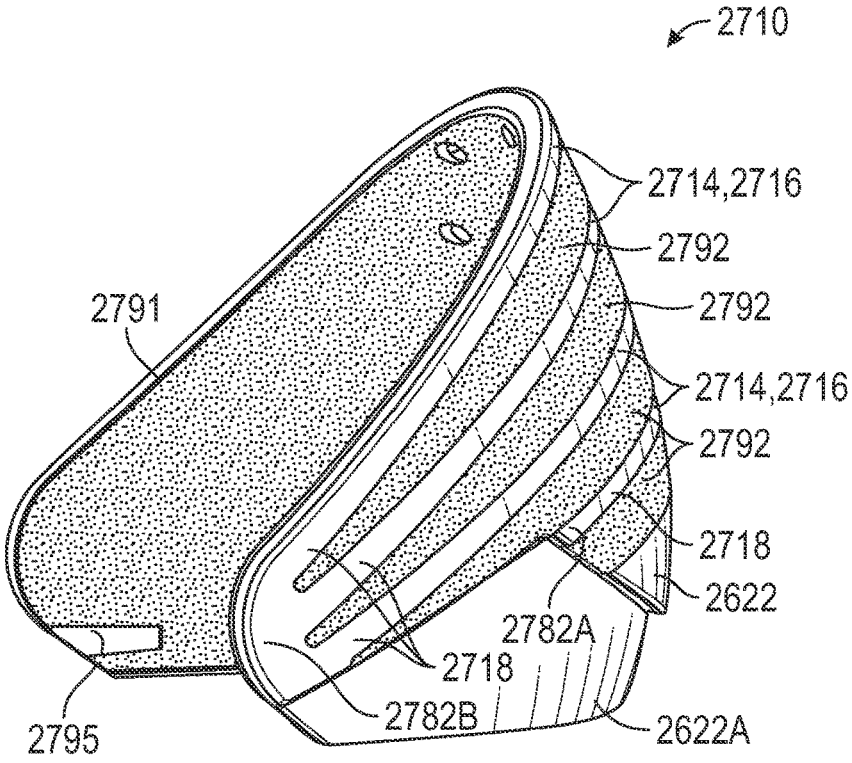
FIG. 62A is a schematic illustration in perspective side view of the heel spring device of FIG. 61 in an unloaded position.
Figure 64:
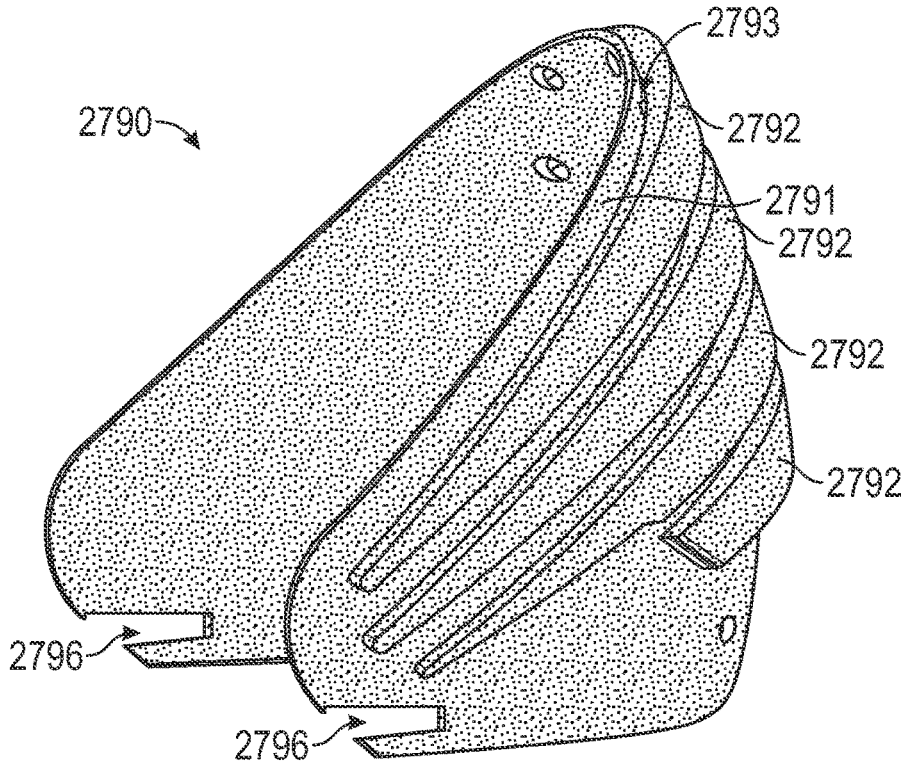
FIG. 64 is a schematic illustration in perspective medial view of the compressible insert of the heel spring device of FIG. 61 in an unloaded position.
Figure 65:
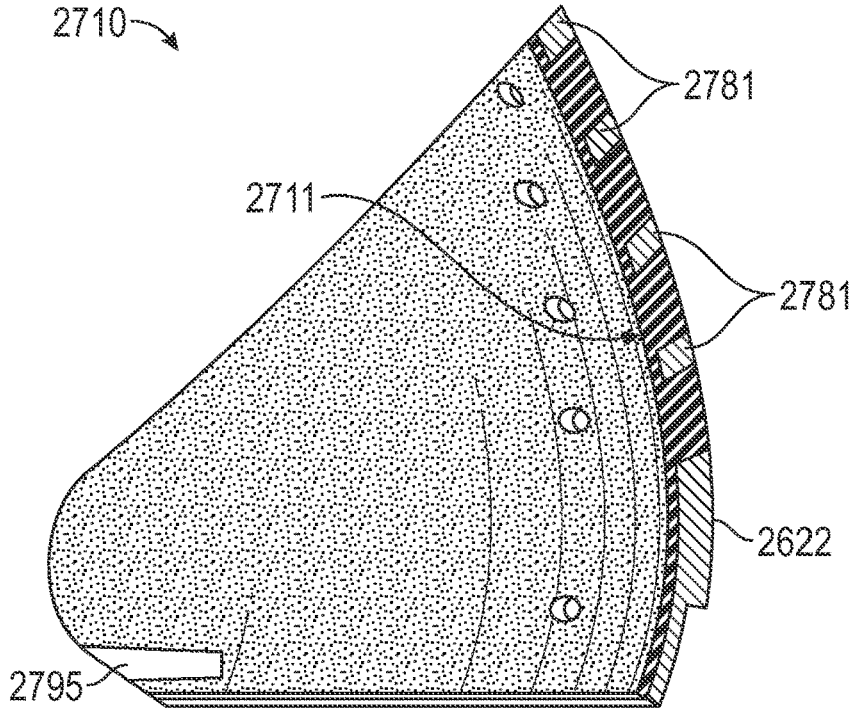
FIG. 65 is a schematic cross-sectional illustration of the heel spring device of FIG. 66 taken at lines 65-65 in FIG. 66.

The slats 2781 are spaced apart from one another by the slots 2780 when the control bar 2714 is in the unloaded position of FIGS. 61-62A. The heel spring device 2710 includes a resilient insert 2790 that at least partially fills the slots 2780. The resilient insert 2790 may comprise a resiliently compressible material, such as at least one of rubber or thermoplastic polyurethane, and may be a foam, but is not limited to these materials. In the embodiment shown, the resilient insert 2790 is a thermoplastic polyurethane foam that provides compressive stiffness and elastic resiliency. As best shown in FIG. 64, the resilient insert 2790 includes a sleeve 2791 with spaced protrusions 2792 extending outward on an outer surface 2793 of the sleeve 2791. As best shown in FIG. 65, the sleeve 2791 is configured to extend along an inner side of the slats 2781 from the uppermost one 2781B of the slats 2781 to a lower periphery of the base 2622. An outer perimeter of the sleeve 2791 is coincident with an outer perimeter of the slats 2781 and base 2622.

The spaced protrusions 2792 extend from the sleeve 2791 into the slots 2780 between the slats 2781. The spaced protrusions 2792 are shaped and dimensioned to completely fill the slots 2780 when the device 2710 is in the unloaded position of FIGS. 61 and 62A. In other embodiments, the spaced protrusions 2792 could be narrower than the slots 2780. The spaced protrusions 2792 may be flush with the outer surfaces of the slats 2781, or may extend outward beyond the outer surfaces of the slats 2781. The slats 2781 and base 2622 may be referred to as a cage which supports the insert 2790.

Figure 62B:
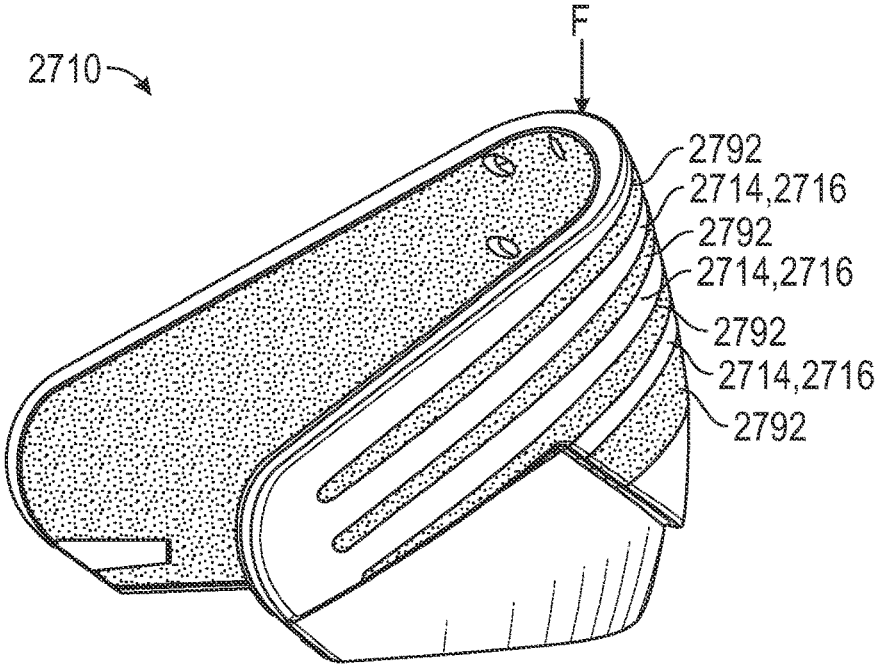
FIG. 62B is a schematic illustration in perspective side view of the heel spring device of FIG. 62A in a loaded position.
Figure 63:
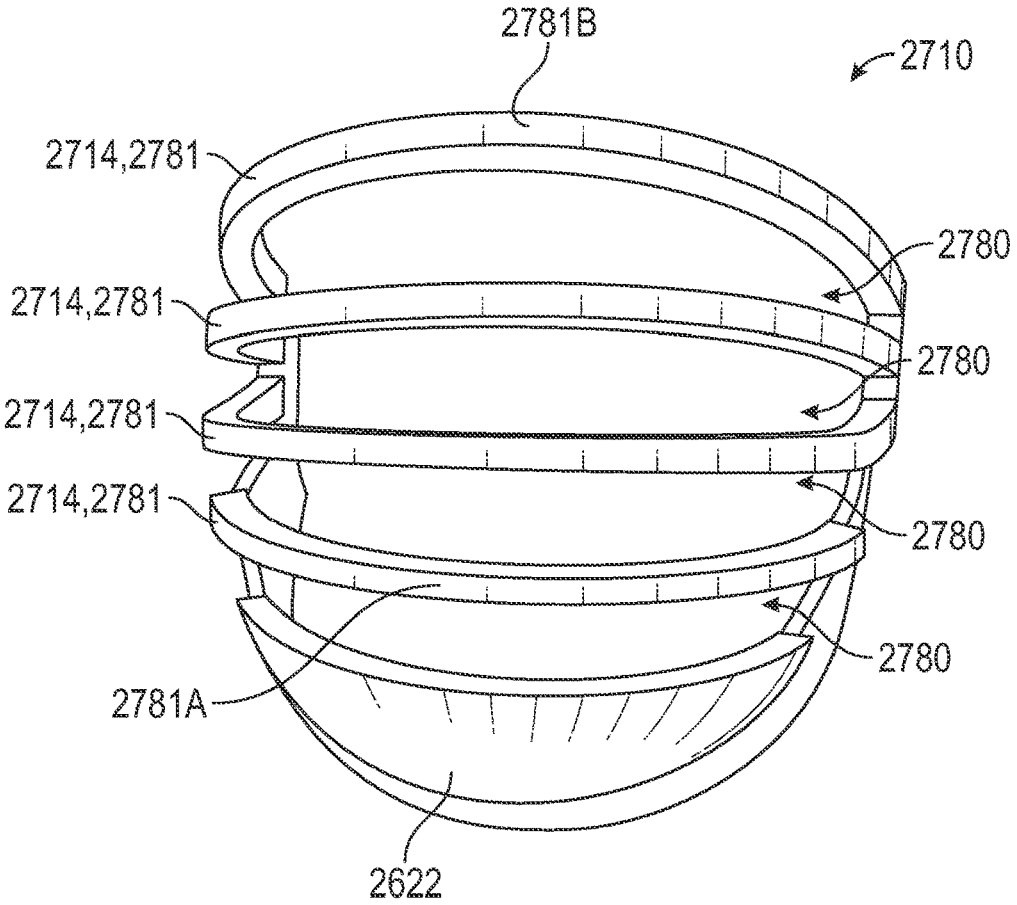
FIG. 63 is a schematic illustration in perspective rear view of the heel spring device of FIG. 61 in an unloaded position with a compressible insert removed.

The slots 2780 partially close between the slats 2781 when a downward force F is applied to the control bar 2714, moving the control bar 2714 to the loaded position of FIG. 62B so that the adjacent center segments 2716 move closer to one another and the protrusions 2792 are partially compressed between the slats 2781. The sleeve 2791 also compresses as it moves downward with the control bar 2714. Because the sleeve 2791 and/or the slats 2781 are operatively secured to the heel portion of the flexible covering of the upper 38 rearward of the ankle opening 39, the upper 38 moves downward with the sleeve 2791 and control bar 2714 to the loaded position. The amount of force required to move the device 2710 from the unloaded position to the loaded position is thus dependent on both the bending stiffness of the control arm 2714 and the compressive stiffness of the resilient insert 2790 in the slots 2780. The compressive stiffness of the insert 2790 is less than the bending stiffness of the slats 2781, and therefore enables the control bar 2714 to bend with a lower force F than if the control bar 2714 were of the same overall thickness as the multiple slats 2781 from the uppermost slat 2781B to the lowermost slat 2781A (i.e., if the control bar 2714 had no slats).

The article of footwear 2712 includes the sole structure 2632 and the footwear upper 38 with a flexible covering. The heel spring device 2710 is secured to the flexible covering of the footwear upper 38 with adhesive, stitching, thermal bonding, or otherwise so that a rear portion of the upper 38 rearward of the ankle opening 39 moves with the heel spring device 2710. The heel spring device 2710 is also secured to the sole structure 2632 at its base 2622 by the flange 2632A of the sole structure 2632 secured in the peripheral recess 2622A.

The control bar 2714 is biased to an unloaded position shown in FIG. 62A, and elastically bends under an applied force F to a loaded position shown in FIG. 62B. In the loaded position, each center segment 2716 is closer to the base 2622 than in the unloaded position due to the arms 2718, 2720 bending and storing potential energy that returns the control bar 2714 to the unloaded position upon removal of the applied force F. The control bar 2714 and the base 2622 are configured as a full elliptical leaf spring. The slats 2781 and base 2622 may be nylon or another resiliently bendable material.

FIG. 62A shows the control bar 2714 biased to an unstressed (i.e., unloaded) position. FIG. 62B shows the control bar 2714 elastically bent under an applied force F (such as a force of a foot sliding into the article of footwear) to a loaded position, which will widen the ankle opening 39 of the upper 38 of FIG. 61 in comparison to the unloaded position, as the upper 38 moves with the control bar 2714 in the heel region. A heel region of the upper 38 rearward of the ankle opening 39 moves with the center section 2716 of the slats 2781 closer to the base 2622 when the force F is applied, causing the ankle opening 39 to enlarge or at least change position by lowering the upper 38 rearward of the ankle opening 39 such that the ankle opening 39 may tilt downward and rearward relative to the unloaded position and is accessible for foot entry of a foot moving in a downward and forward direction from the rear.

Figure 66:
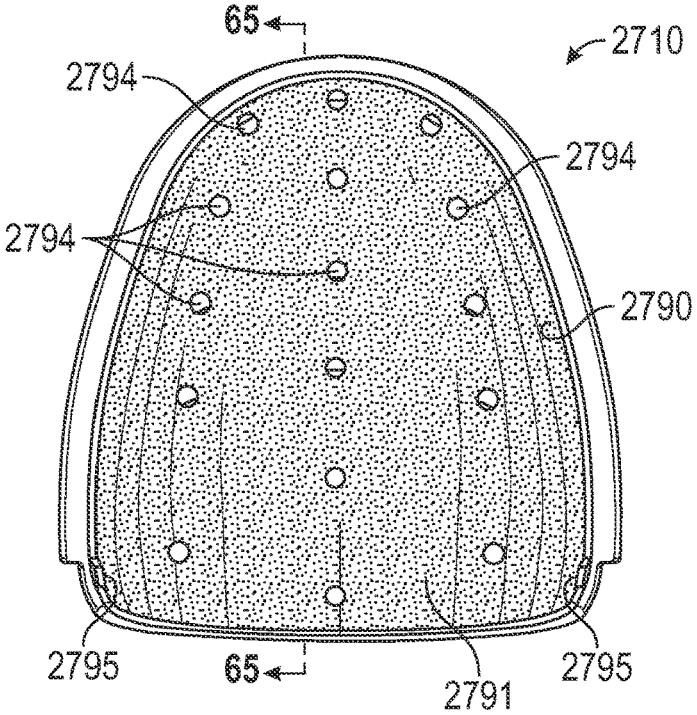
FIG. 66 is a schematic illustration in front view of the heel spring device of FIG. 61.

The slats 2781 and base 2622 may be injection molded. Once molded, the slats 2781 and base 2622 are a single, unitary component. The material of the foam insert 2790 may then be injected into a mold cavity containing the molded slats 2781 and base 2622. FIG. 66 shows apertures 2794 (only some of which are numbered) where pins hold the slats 2781 and base 2622 against a surface of the mold while the material of the insert 2790 is injected. The insert 2790 is molded around ribs 2795 of the base 2622 near the junctions of the slats 2781 with the base 2622, as indicated by slots 2796 in the insert 2790 in FIG. 64.

Figure 67:
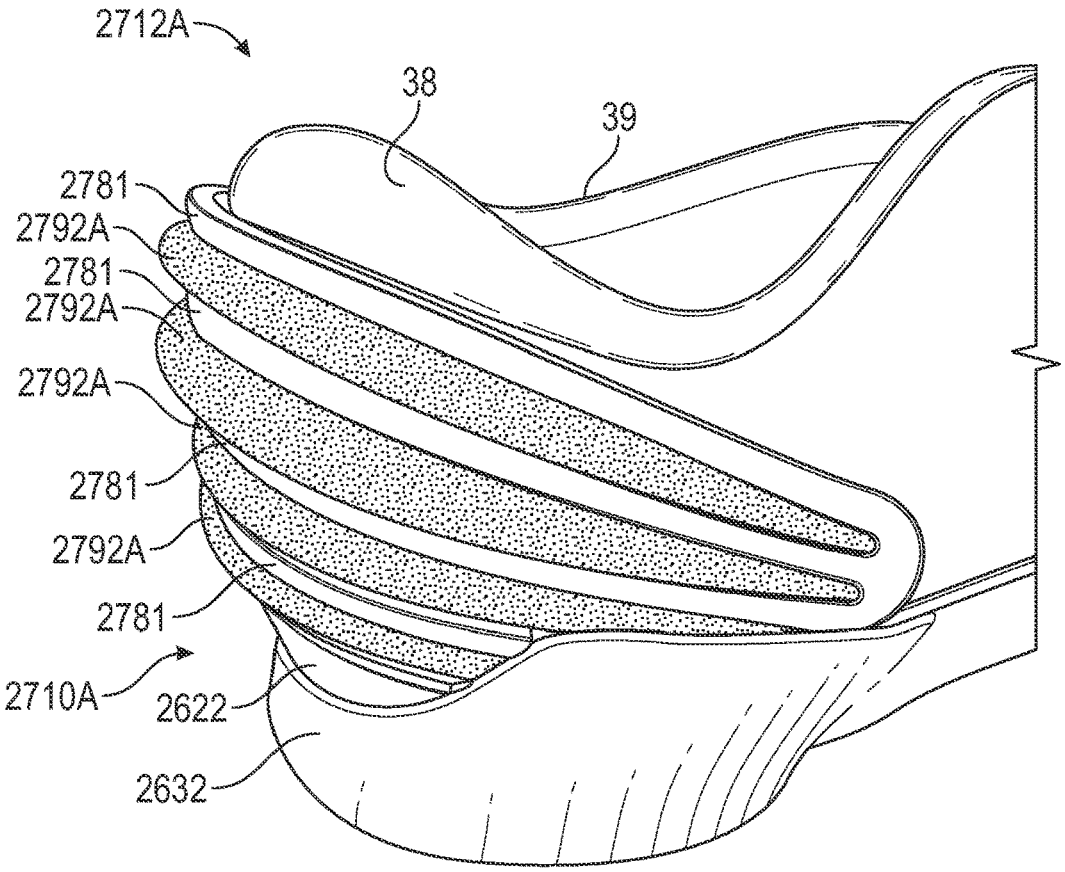
FIG. 67 is a schematic illustration in fragmentary perspective view of an article of footwear with an alternative embodiment of a heel spring in an unloaded position.

FIG. 67 shows an article of footwear 2712A with another embodiment of a heel spring device 2710A. The heel spring device 2710A is alike in all aspects as heel spring device 2710, except that the insert 2790 has protrusions 2792A that are configured as bellows that extend outward and fill slots between the slats 2781 between the slats 2781 from an inner side of the slats 2781. The slats 2781 and base 2622 may be formed of a semi-rigid or rigid thermoplastic polyurethane, while the insert 2790 with protrusions 2792A may be formed of a softer thermoplastic polyurethane relative to the slats 2781 and base 2622.

Figure 68:
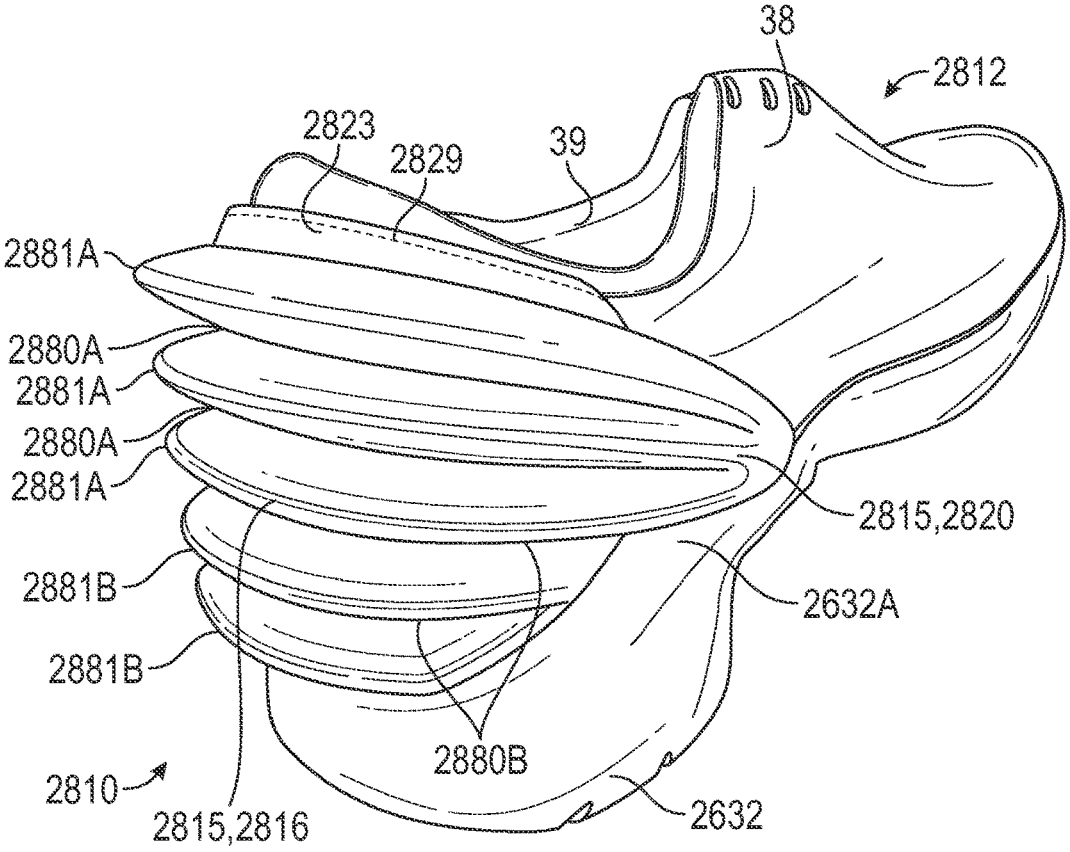
FIG. 68 is a schematic illustration in perspective view of an article of footwear with an alternative embodiment of a heel spring device in an unloaded position.
Figure 70:
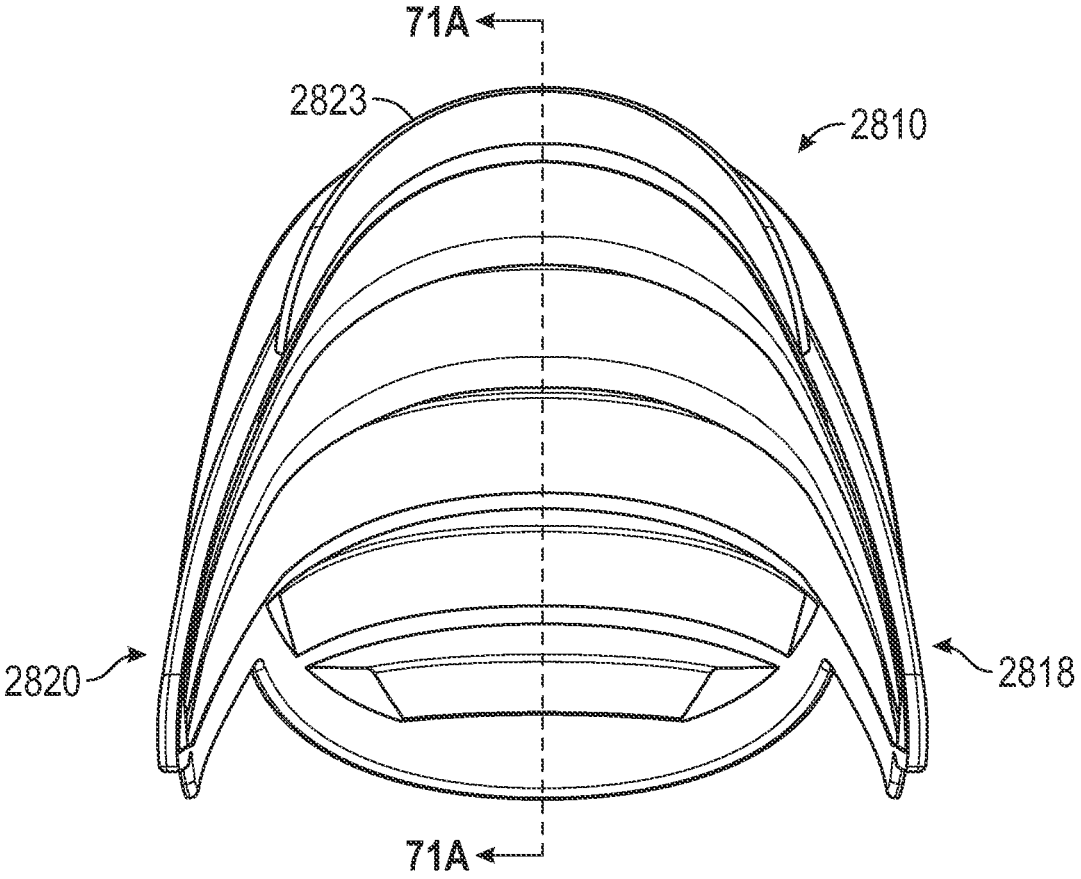
FIG. 70 is a schematic illustration in front view of the heel spring device of FIG. 69.
Figure 71A:
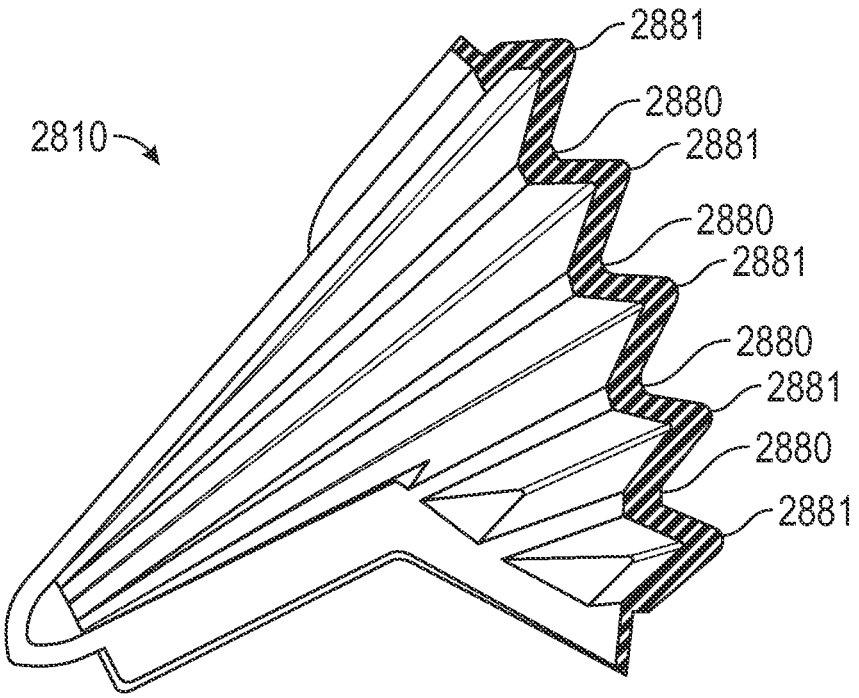
FIG. 71A is a schematic cross-sectional illustration of the heel spring device of FIG. 70 taken at lines 71A-71A in FIG. 70.

FIG. 68 shows an article of footwear 2812 with another embodiment of a heel spring device 2810. Like reference numbers are used to refer to components identical to those described with respect to article of footwear 2612 and heel spring device 2610. The heel spring device 2810 has a similar function as heel spring device 2710, but is comprised of an elastic corrugated body 2815 including a center segment 2816, a medial side arm 2818 (best shown in FIG. 69) extending downwardly and forwardly from the center segment 2816, and a lateral side arm 2820 (best shown in FIG. 68) extending downwardly and forwardly from the center segment 2816. The corrugated body 2815 includes alternating ridges 2881 and grooves 2880 that extend lengthwise along the medial side arm 2818, the center segment 2816 and the lateral side arm 2820. As is evident from FIGS. 70 and 71A, the device 2810 has a concavity at an inner surface in both the medial-lateral and vertical directions.

Figure 71B:
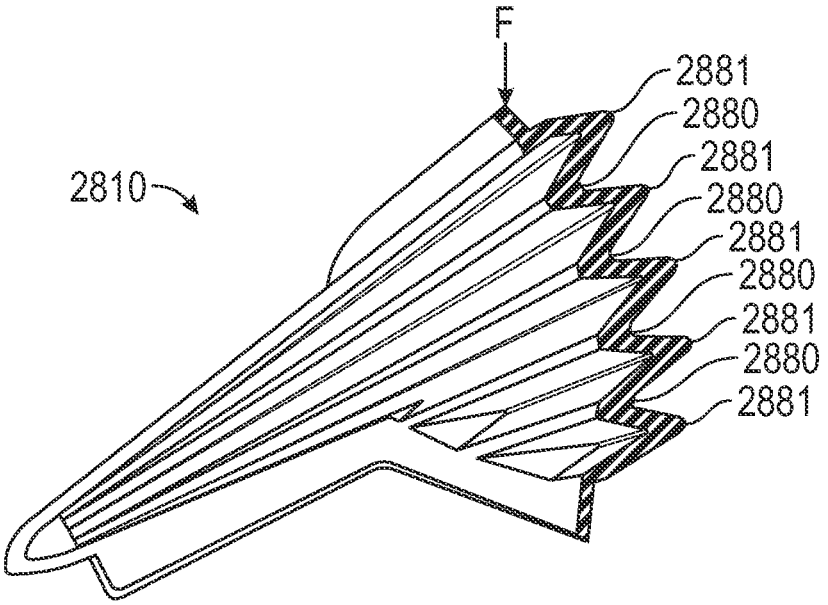
FIG. 71B is a schematic cross-sectional illustration of the heel spring device of FIG. 71A in a loaded position.

The corrugated body 2815 is biased to an unloaded position shown in FIGS. 68, 69, 70 and 71A. The corrugated body 2815 compresses under an applied force F to a loaded position shown in FIG. 71B. In the loaded position, the corrugated body 2815 compresses (e.g., by folding) so that adjacent ones of the alternating ridges 2881 are closer to one another than in the unloaded position, particularly at the center segment 2816, storing elastic energy that returns the corrugated body 2815 to the unloaded position upon removal of the applied force F. The upper 38 moves with the center segment 2816 such that the ankle opening 39 may tilt downward and rearward relative to the unloaded position when the heel spring device 2810 is in the loaded position.

As indicated in FIG. 68, a first set of the ridges 2881A and grooves 2880A extend from the medial side arm 2818 to the lateral side arm 2820, and a second set of the ridges 2881B and grooves 2880B extend only along the center segment 2816. The first and second sets are configured so that the ridges and grooves can follow the contours of the upper 38, extending along the entire portion of the upper 38 rearward of the ankle opening 39, while still allowing some of the grooves and ridges (i.e., the first set) to extend downwardly and forwardly.

Figure 69:
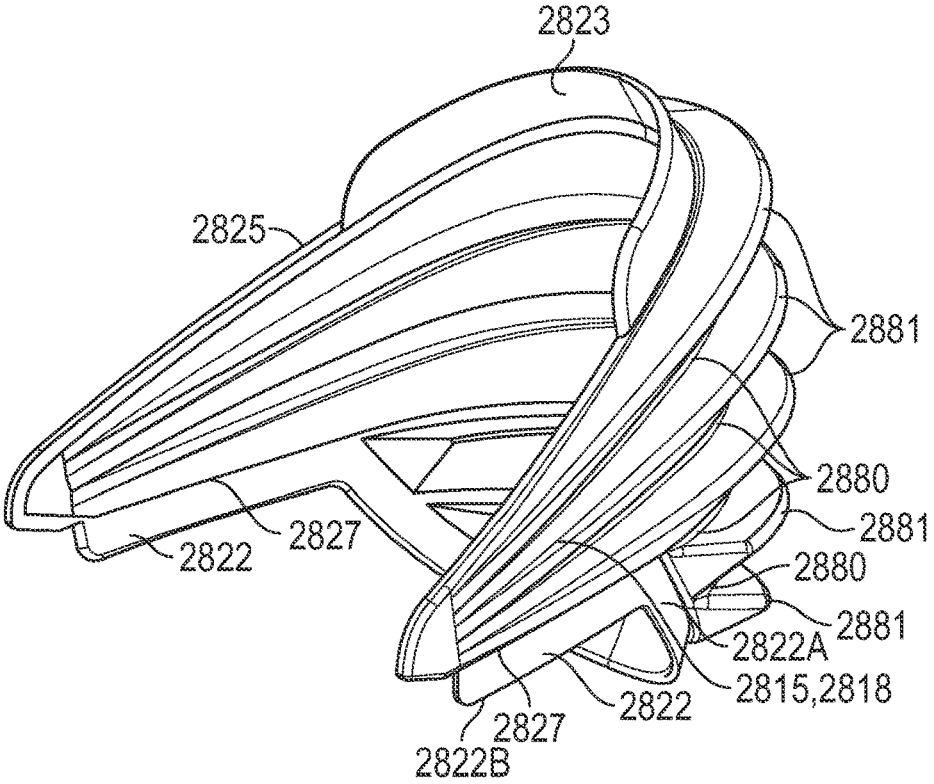
FIG. 69 is a schematic illustration in perspective view of the heel spring device of FIG. 68 in an unloaded position.

Referring to FIG. 69, the device 2810 may include an upper flange 2823 extending along an upper edge 2825 of the corrugated body 2815 at the center segment 2816, and further comprises a lower flange 2822 extending along a lower edge 2827 of the corrugated body 2815 at the medial arm 2818, the center segment 2816, and the lateral arm 2820.

The lower flange 2822 is also referred to as a base. The sole structure 2632 is secured to the lower flange 2822 by adhesive, thermal bonding, or otherwise, so that the sole structure 2632 generally underlies the upper 38 and the heel spring device 2810 as shown in FIG. 68. As best shown in FIG. 69, the outer surface of the base 2822 has a peripheral recess 2822A extending from a lower edge 2822B of the base 2822. The sole structure 2632 has a flange 2632A configured to be seated in the peripheral recess 2822A. The flange 2632A of the sole structure 2632 provides lateral support to the heel spring device 2810.

The upper flange 2823 is stitched to the upper 38 rearward of the ankle opening 39 as shown by stitches 2829 in FIG. 68. The upper flange 2823 may alternatively be adhered or thermally bonded to the upper 38. The connection of the heel spring device 2810 to the upper 38 via the upper flange 2823 enables the upper 38 to move with the heel spring device 2810 between the loaded and unloaded positions.

The ridges 2881 and grooves 2880 of the corrugated body 2815 may also be referred to as bellows. The ridges 2881 are pleats of the bellows and the grooves 2880 are folds of the bellows. The device 2810 is a one-piece, unitary component that includes the corrugated body 2815 and the flanges 2822, 2823. The device 2810 may be injection molded of an elastically deformable material, such as at least one of rubber or thermoplastic polyurethane, and may be a resilient foam (e.g., a polymer foam material, etc.), but is not limited to these materials.

Figure 72:
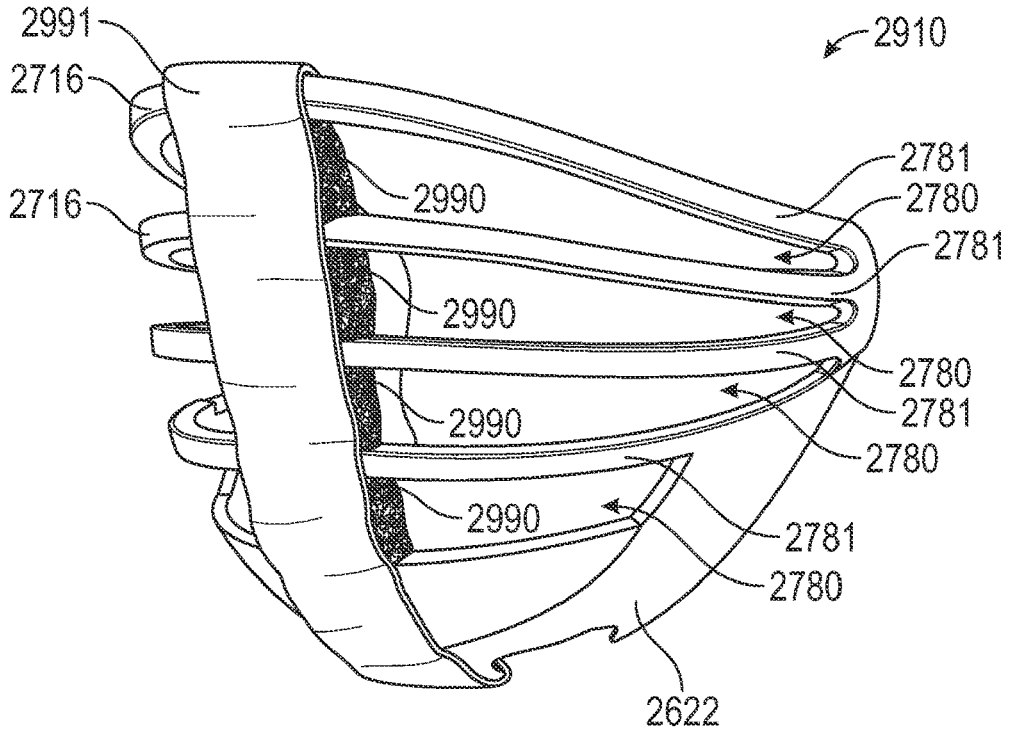
FIG. 72 is a schematic illustration in perspective rear view of an alternative embodiment of a heel spring device in an unloaded position.

FIG. 72 shows another embodiment of a heel spring device 2910 within the scope of the present teachings. The heel spring device 2910 has the spaced slats 2781 and a base 2622 as described with respect to the heel spring device 2710, and is biased to the unloaded position shown in FIG. 72, but elastically bends to a loaded position (not shown) in response to an applied load, which helps to open an ankle opening of an upper to ease foot entry as described with respect to heel spring device 2710. The heel spring device 2910 includes discrete resilient inserts 2990 disposed in the slots 2780 but only along a portion of the center segments 2716 (e.g., not in the slots of the side arms). A strap 2991 is adhered or otherwise connected to the inserts 2990 and to the slats 2781 to retain the inserts 2990 in position within the slots 2780. Alternatively, the strap 2991 may be an integral portion of the resilient inserts 2990 such that the resilient inserts 2990 are integrated as a unitary component.

Figure 73:
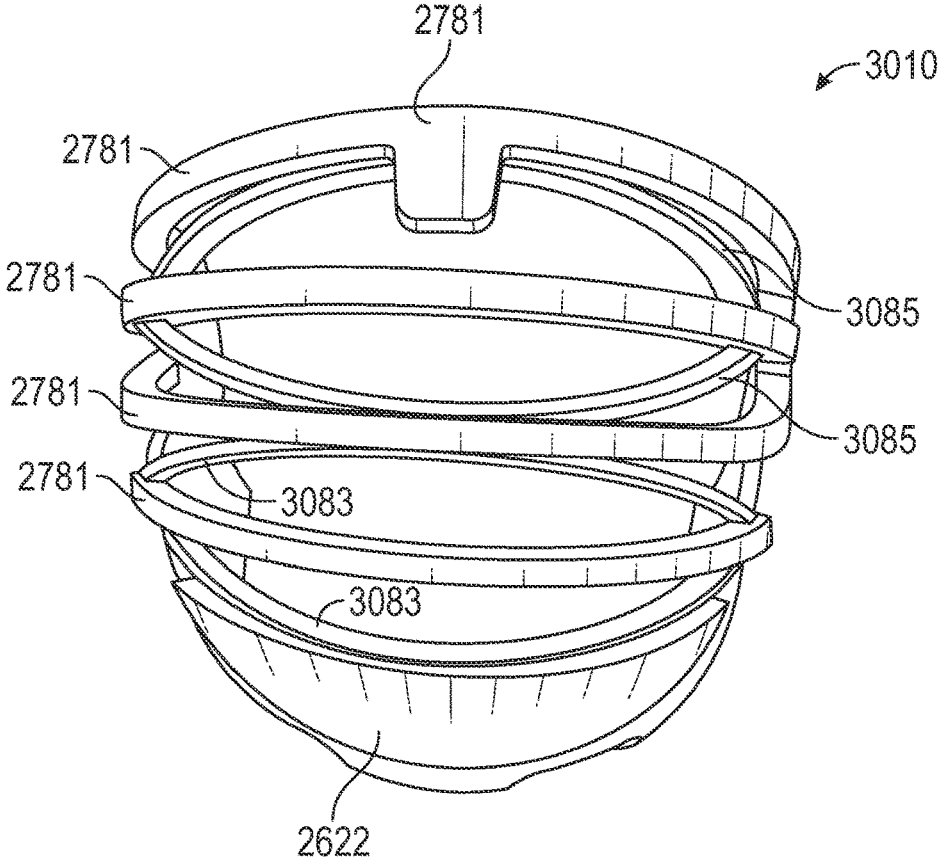
FIG. 73 is a schematic illustration in perspective rear view of an alternative embodiment of a heel spring device in an unloaded position.

FIG. 73 shows another embodiment of a heel spring device 3010. The heel spring device 3010 has the spaced slats 2781 and the base 2622 as described with respect to the heel spring device 2710, and is biased to the unloaded position shown in FIG. 73, but elastically bends to a loaded position (not shown) which helps to open an ankle opening of an upper to ease foot entry as described with respect to heel spring device 2710. The heel spring device 3010 has a pair of intermediate slats 3083 arranged as an elliptical spring between the base 2622 and a middle one of the slats 2781 and connected to the base 2622 and the middle slat 2781, respectively. The heel spring device 3010 also has a pair of intermediate slats 3085 arranged as an elliptical spring between the uppermost slat and the middle one of the slats 2781, and connected to the uppermost slat and the middle slat, respectively. The intermediate slats 3083, 3085 provide additional resistance to bending and stored elastic energy to return the heel spring device 3010 to the unloaded position upon removal of the applied load. The arrangement of slats 2781 and intermediate slats 3083, 3085 may be referred to as a lattice.

Figure 74:
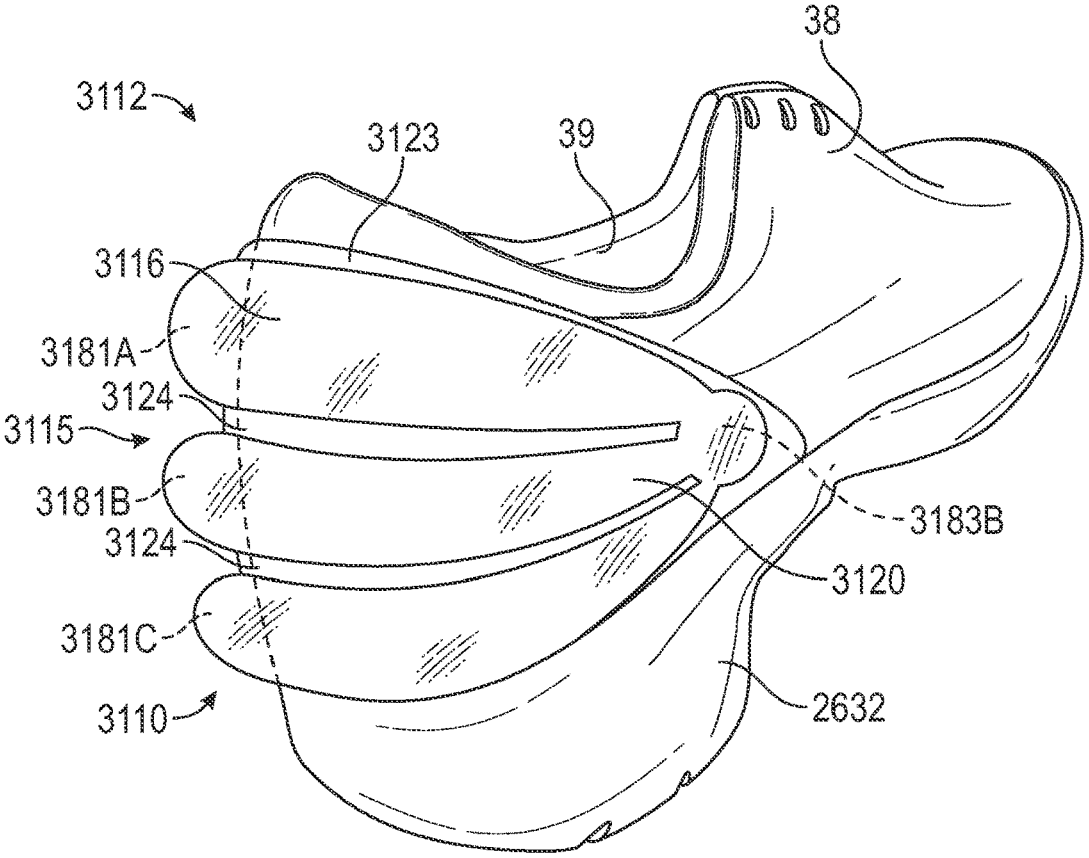
FIG. 74 is a schematic illustration in perspective view of an article of footwear with an alternative embodiment of a heel spring device in an unloaded position.
Figure 75:
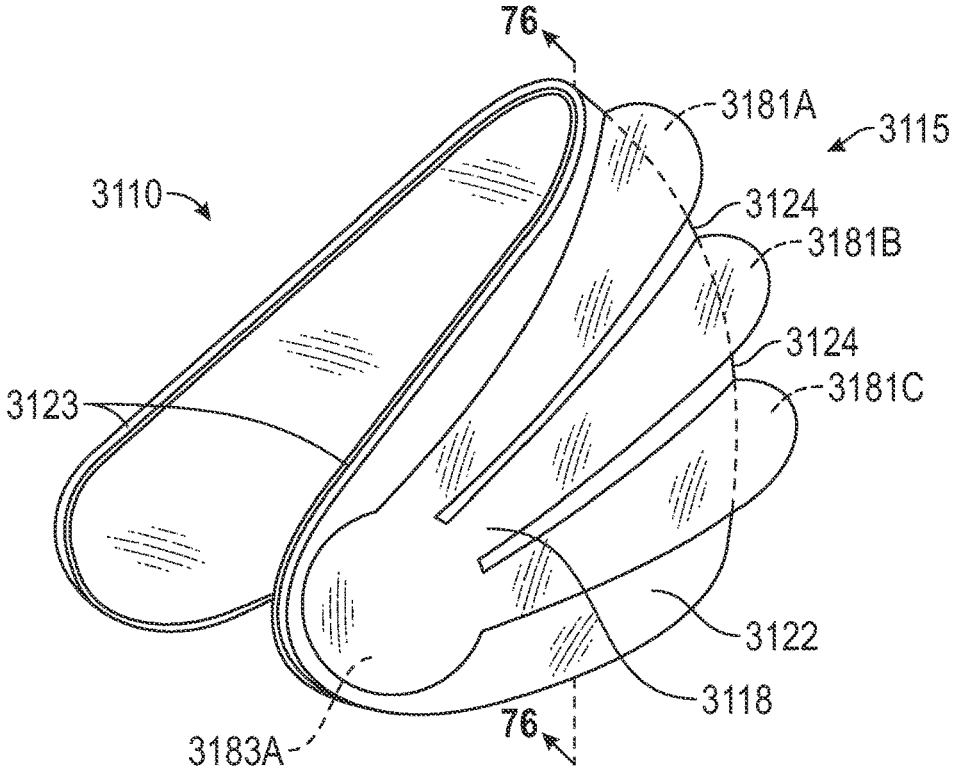
FIG. 75 is a schematic illustration in perspective side view of the heel spring device of FIG. 74 in an unloaded position.

FIG. 74 shows an article of footwear 3112 with another embodiment of a heel spring device 3110. Like reference numbers are used to refer to components identical to those described with respect to article of footwear 2612 and heel spring device 2610. The heel spring device 3110 has a similar function as heel spring device 2610, but is comprised of a fluid-filled bladder 3115 including a center segment 3116, a medial side arm 3118 (shown in FIG. 75) extending downwardly and forwardly from the center segment 3116, and a lateral side arm 3120 extending downwardly and forwardly from the center segment 3116. The sole structure 2632 is secured to a lower flange 3122 of the bladder element 3115 by adhesive, thermal bonding, or otherwise, so that the sole structure 2632 generally underlies the upper 38 and the heel spring device 3110 as shown in FIG. 74.

Figure 77:
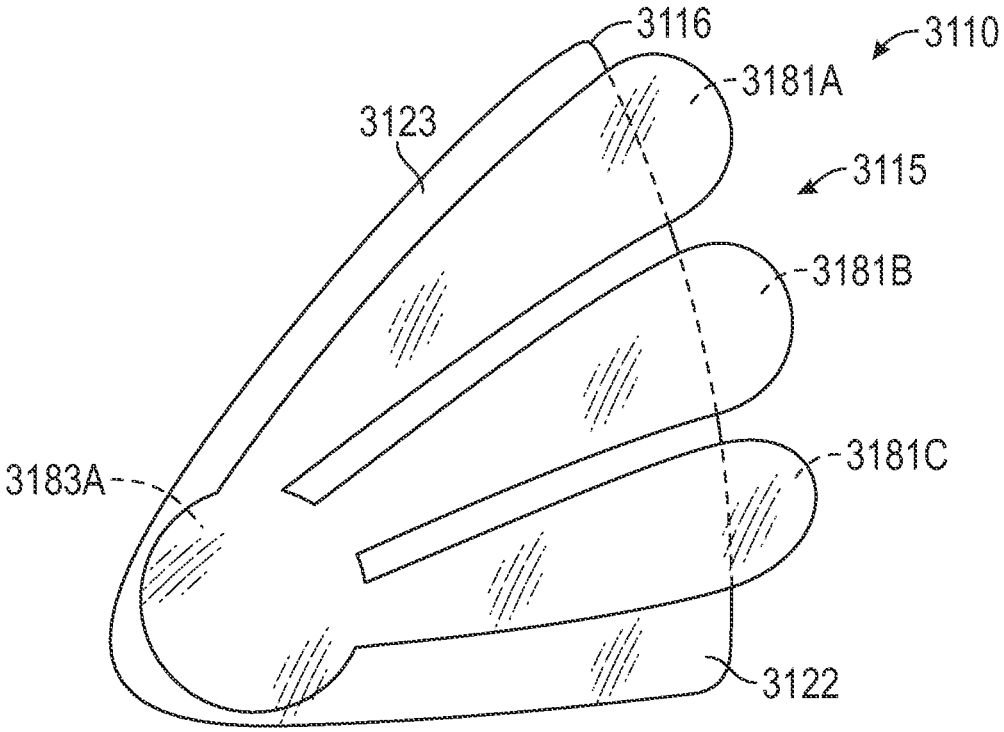
FIG. 77 is a schematic illustration in side view of the heel spring device of FIG. 74 in an unloaded position.
Figure 78:
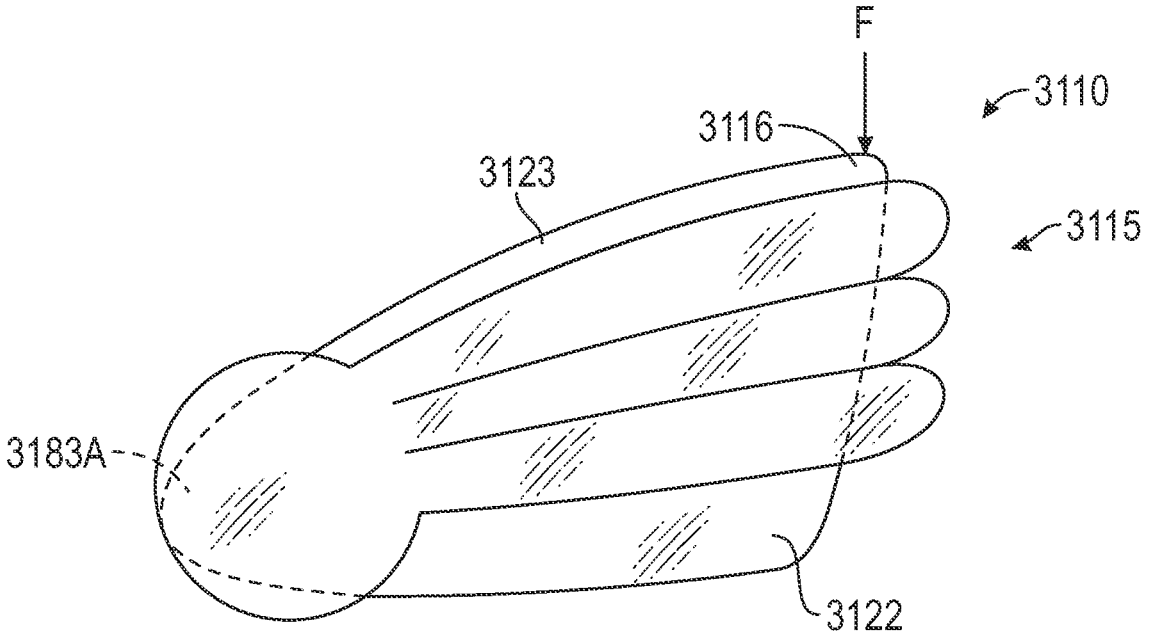
FIG. 78 is a schematic illustration in side view of the heel spring device of FIG. 74 in a loaded position.

Application of a downward force F on the center segment 3116 moves the bladder element 3115 from an unloaded position (FIG. 77) to a loaded position (FIG. 78). The unloaded position is also referred to as an expanded position, and the loaded position is also referred to as a collapsed or compressed position. The center segment 3116 may be referred to as a control bar.

Figure 76:
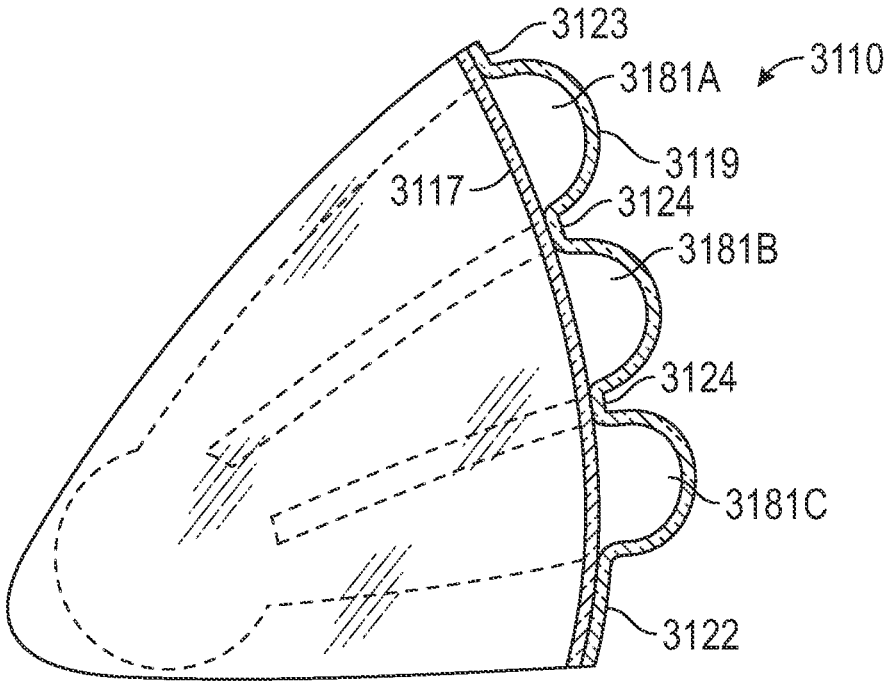
FIG. 76 is a schematic cross-sectional illustration of the heel spring device of FIG. 75 taken at lines 76-76 in FIG. 75.

The bladder element 3115 may be thermoformed from a first polymeric sheet 3117 and a second polymeric sheet 3119 (best shown in FIG. 76 and also referred to as an inner and an outer sheet, or an inner and an outer layer, respectively). Alternatively, the bladder element 3115 may be blow-molded from a pre-form polymeric material. The bladder element 3115 can be formed from any of various polymeric materials that retain a fluid at a predetermined pressure, including a fluid that is a gas, such as air, nitrogen, or another gas. As used herein, a "fluid" includes a gas, including air, an inert gas such as nitrogen, or another gas. Accordingly, "fluid-filled" includes "gas-filled".

For example, the bladder element 3115 can be a TPU material, a urethane, polyurethane, polyester, polyester polyurethane, and/or polyether polyurethane. Moreover, in one embodiment, the bladder element 3115 can be formed from sheets having layers of different materials. The sheets 3117, 3119 may be laminate membranes formed from thin films having one or more first layers that comprise thermoplastic polyurethane layers and that alternate with one or more second layers, also referred to herein as barrier layers, gas barrier polymers, or gas barrier layers. The second layers may comprise a copolymer of ethylene and vinyl alcohol (EVOH) that is impermeable to the pressurized fluid contained therein as disclosed in U.S. Pat. No. 6,082,025 to Bonk et al., which is incorporated by reference in its entirety. The first layer may be arranged to form an outer surface of the polymeric sheet. That is, the outermost first layer may be the outer surface of the bladder element 3115. The bladder element 3115 may also be formed from a material that includes alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. The sheets 3117, 3119 may have alternating layers of thermoplastic urethane (TPU) and a gas barrier material. In the embodiment shown, the sheets 3117, 3119 are transparent.

The sheets 3117, 3119 are bonded to one another at a periphery of the bladder element 3115, such as at an upper flange 3123 and the lower flange 3122, also referred to as a base. The lower flange 3122 is continuous and is connected to and supports the medial side arm 3118, the center segment 3116, and the lateral side arm 3120. The sheets 3117, 3119 are also bonded to one another at various intermediate bond locations 3124, referred to as webbing. The upper flange 3123 is thermally bonded, adhered, or otherwise secured to the upper 38 rearward of the ankle opening 39 as shown in FIG. 74. The upper 38 may also be secured to the inner surface of the first polymeric sheet 3117 between the upper and lower flanges 3123, 3122. The connection of the heel spring device 3110 to the upper 38 via the upper flange 3123 enables the upper 38 to move with the heel spring device 3110 between the loaded and unloaded positions. More specifically, the upper 38 moves with the center segment 3116 such that the ankle opening 39 may tilt downward and rearward relative to the unloaded position when the heel spring device 3110 is in the loaded position, enabling hands-free foot entry.

The bonded sheets 3117, 3119 form various fluid-filled interior cavities 3181A, 3181B, 3181C, 3183A, and 3183B which are fluid-tight, and may be pressurized or unpressurized. In the embodiment shown, the fluid-filled interior cavities 3181A, 3181B, 3181C, 3183A, and 3183B are at the ambient pressure of the environment in which the fluid-filled cavities were sealed. Alternatively, the fluid-filled interior cavities 3181A, 3181B, 3181C, 3183A, and 3183B could be pressurized by fluid introduced into the cavities through one or more inflation ports (not shown) that are then sealed.

In the embodiment shown, each of the fluid-filled interior cavities 3181A, 3181B, and 3181C is generally tubular, and extends lengthwise along the medial side arm 3118, the center segment 3116, and the lateral side arm 3120. In some embodiments, the cavities 3181A, 3181B, 3181C only extend along the center segment 3116. The cavities 3181A, 3181B, 3181C may be referred to as elongated cavities or tubular cavities. Alternatively, fluid-filled cavities of other shapes may extend along the center segment 3116, and may also extend along either or both of the medial side arm and the lateral side arm. For example, multiple discrete cavities shaped as tubes that are shorter than the cavities 3181A, 3181B, 3181C, or having other shapes, may extend along the center segment 3116 and may be fluidly-interconnected to one another by channels formed by the sheets.

The tubular cavities 3181A, 3181B, and 3181C are connected with and in fluid communication with the fluid-filled interior cavities 3183A, 3183B, which may be referred to as a medial reservoir 3183A and a lateral reservoir 3183B. In this manner, the tubular cavities 3181A, 3181B, and 3181C are indirectly in fluid communication with one another via the reservoirs 3183A, 3183B. In some embodiments, channels extending directly between adjacent ones of the tubular cavities 3181A, 3181B, and 3181C may also be provided such that the tubular cavities 3181A, 3181B, 3181C are in direct fluid communication with one another. In some embodiments, only one of the reservoirs 3183A, 3183B is provided, or no reservoirs are provided, and the tubular cavities 3181A, 3181B, and 3181C simply end on the side arm that does not have a reservoir. In still other embodiments, each of the tubular cavities may have its own separate reservoir on either or both of the side arms. The reservoirs 3183A, 3183B are formed by the first and second polymeric sheets 3117 and 3119 at medial and lateral extremities of the tubular cavities 3181A, 3181B, and 3181C, respectively. As is apparent from FIGS. 74-75, the device 3110 has a concavity at the inner surface of the first polymeric sheet in both the medial-lateral and vertical directions.

The formed sheets 3117, 3119 with interior cavities 3181A, 3181B, 3181C, 3183A, 3183B bias the heel spring device 3110 to the unloaded position shown in FIGS. 74-77. The heel spring device 3110 compresses under the applied force F to the loaded position shown in FIG. 78, storing elastic energy. For example, the applied force F may be the force of a foot as it is being inserted into the ankle opening 39 of the article of footwear 3112. In the loaded position, the bladder element 3115 is resiliently deformed as the force F is applied generally over the center segment 3116 of the tubular cavities 3181A, 3181B, and 3181C such that the top of the center segment 3116 is closer to the flange 3122 in the loaded position than in the unloaded position.

Some of the fluid within the fluid-filled interior cavities 3181A, 3181B, and 3181C may be displaced to the reservoirs 3183A, 3183B as the tubular cavities 3181A, 3181B, and 3181C are compressed, causing the reservoirs to expand and bulge outward, as represented in FIG. 78 at reservoir 3183A. The resiliently deformed bladder element 3115 returns to the unloaded position of FIG. 77 as the displaced fluid returns from the reservoirs 3183A, 3183B to the tubular cavities 3181A, 3181B, and 3181C upon removal of the applied force F, expanding the tubular cavities 3181A, 3181B, 3181C to their original shapes and reducing the sizes of the reservoirs 3183A, 3183B to their original shapes.

Figure 79:
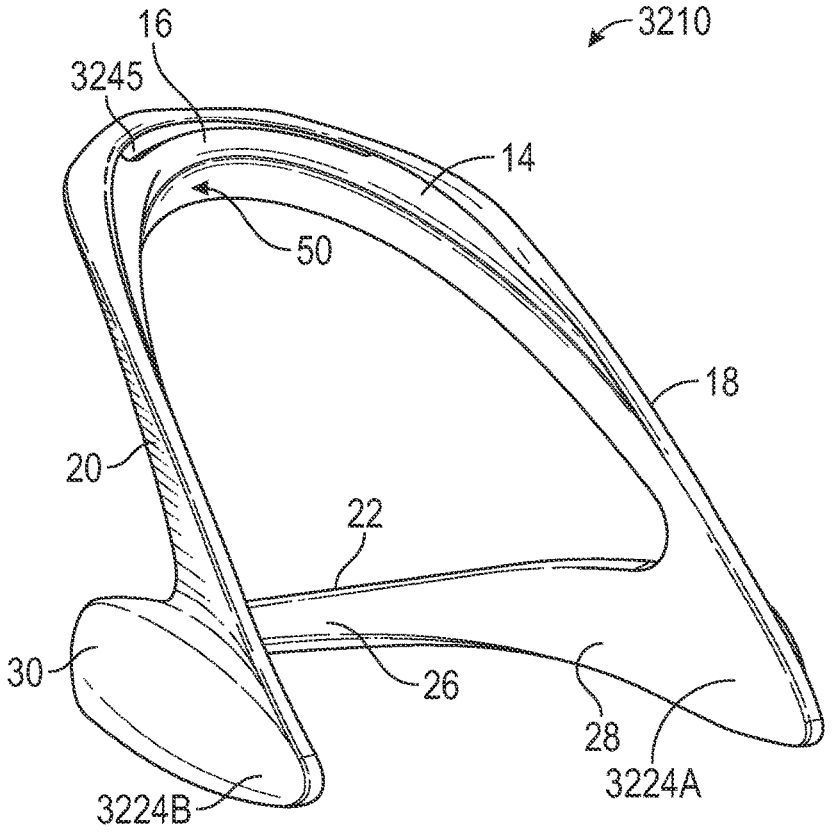
FIG. 79 is a schematic illustration in perspective view of an alternative embodiment of a heel spring device in an unloaded position.
Figure 80:
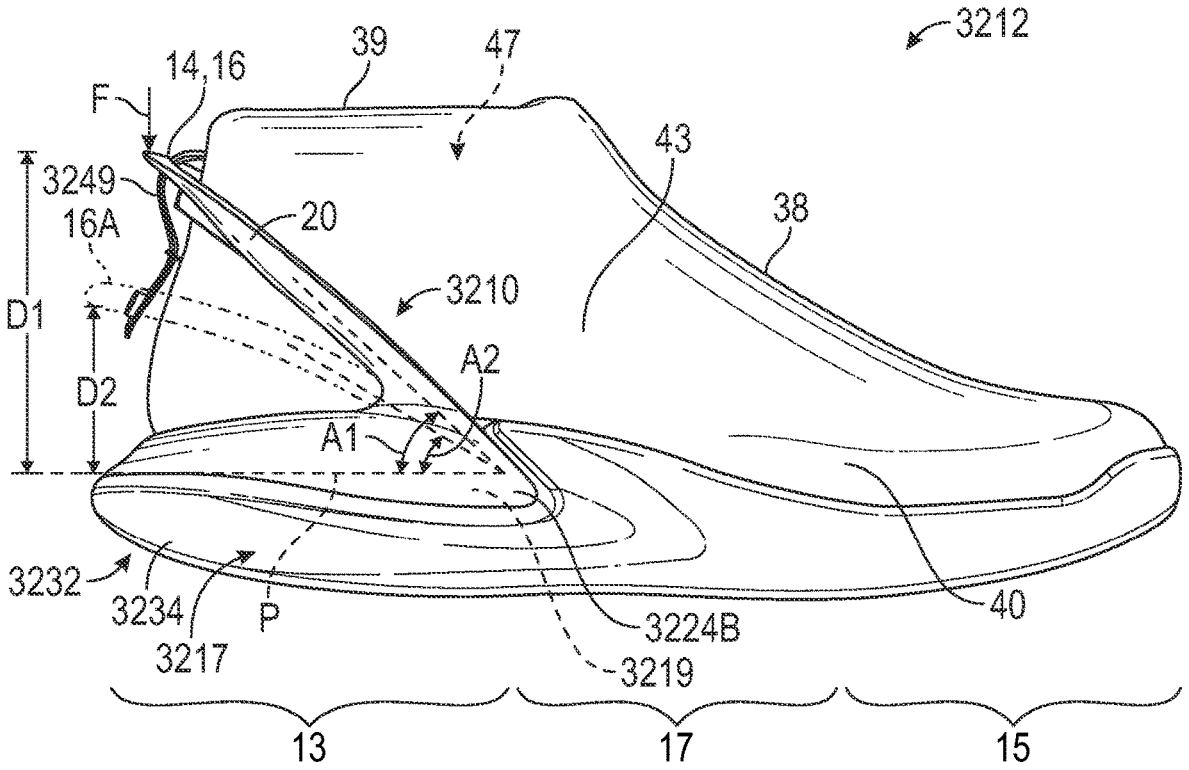
FIG. 80 is a schematic illustration in lateral side of an article of footwear with the heel spring device of FIG. 79.
Figure 81:
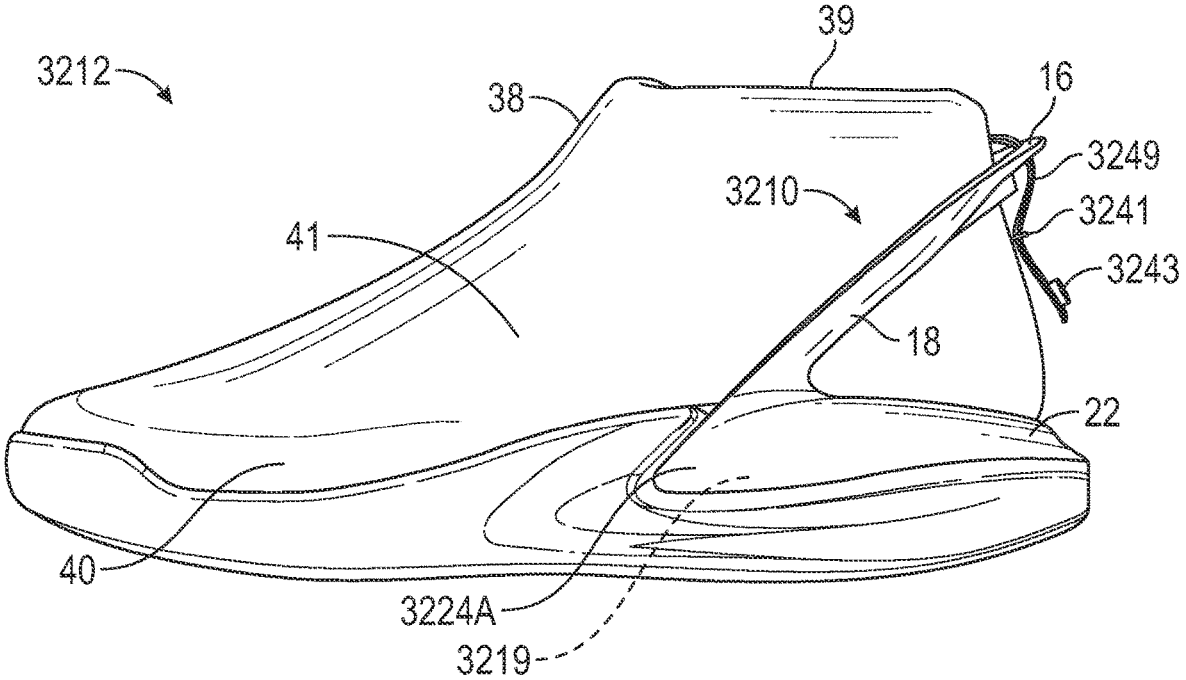
FIG. 81 is a schematic illustration in medial side of the article of footwear of FIG. 80.
Figure 82:
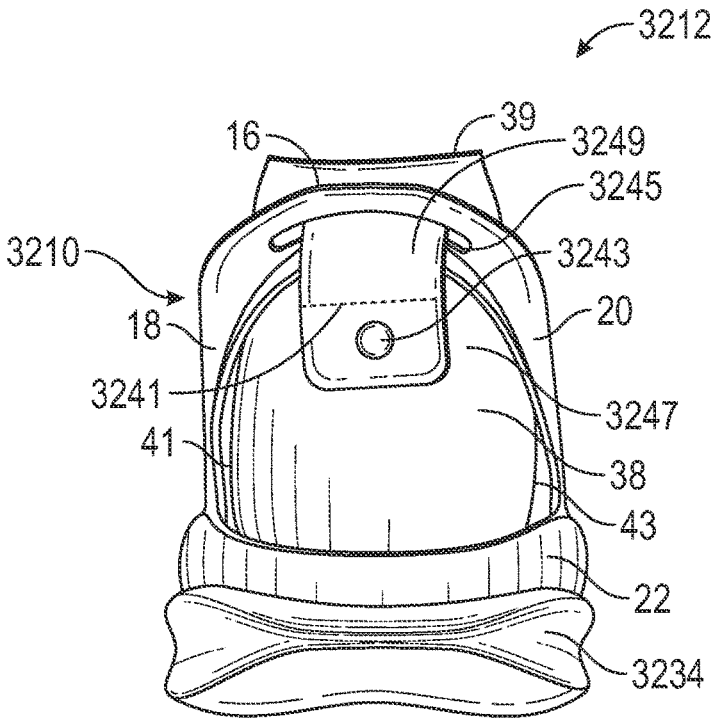
FIG. 82 is a schematic illustration in rear view of the article of footwear of FIG. 80.

FIG. 79 shows another embodiment of a heel spring device 3210 for an article of footwear 3212 shown in FIGS. 80-82. The heel spring device 3210 has similar function and features as heel spring device 10. For example, the device 3210 has the control bar 14 with the medial side arm 18 and lateral side arm 20. The device 3210 has the continuous base 22 that connects the side arms 18, 20 and extends rearward from a junction of the control bar 14 with the base 22. The base 22 underlies the control bar 14 with the first side arm 18 at a medial side 41 of a footwear upper 38, the second side arm 20 at a lateral side 43 of the footwear upper 38, and the center segment 16 of the control bar 14 rearward of the ankle opening 39 of the footwear upper 38.

The base 22 supports the control bar 14 and is connected to the control bar 14 at resiliently bendable junction 3224A, 3224B. The base 22 is continuous and extends between and connects to the first side arm 18 and the second side arm 20. The base 22 is continuous in that it is without breaks or connections through other components in extending from the first side arm 18 to the second side arm 20. The base 22 has a center segment 26, a first base arm 28, and a second base arm 30 all disposed in a common plane, as described with respect to the device 10 of FIG. 3. The first base arm 28 is spaced apart from the second base arm 30 and both extend from the center segment 26 of the base 22.

The junction 3224A, 3224B includes a first joint 3224A at which the base 22 and the first side arm 18 connect, and a second joint 3224B at which the base 22 and the second side arm 20 connect. The first joint 3224A is the connection of the first base arm 28 to the first side arm 18. The second joint 3224B is the connection of the second base arm 30 to the second side arm 20. The joints 3224A, 3224B may be referred to herein as hinged joints, or as a hinged junction.

The control bar 14 has an arced shape from the first joint 3224A to the second joint 3224B. Similarly, the base 22 has an arced shape from the first joint 3224A to the second joint 3224B. With this arrangement, the control bar 14 and the base 22 are configured as a full elliptical leaf spring as described herein. The device 3210 may be referred to as a heel spring. Additionally, the device 3210 is a single, unitary, one-piece component. For example, the device 3210 may be injection molded as a single, unitary, one-piece component.

The center segment 16 of the control bar 14 has the ramped surface 50 that declines toward an inner periphery of the center segment 16 between the first side arm 18 and the second side arm 20 and helps direct the foot downward and forward into the foot-receiving cavity 47 during application of the downward force F on the control bar 16 as described with respect to device 10. Additionally, the first side arm 18 and the second side arm 20 are each twisted outwardly along their respective longitudinal axis from the junction 3224A, 3224B near the base 22 to the center segment 16 of the control bar 14. The outward twist helps to encourage the down and back movement of the center segment 16 during loading by the foot.

The article of footwear 3212 includes a sole structure 3232, and the flexible footwear upper 38 has a medial side 41 and a lateral side 43, and defines an ankle opening 39 and a foot-receiving cavity 47, as described with respect to the article of footwear 12. The sole structure 3232 includes one or more sole components that may be sole layers, such as an outsole, a midsole, or a sole layer 3234 that is a unitary combination of an outsole and a midsole and may be referred to as a unisole. The sole layer 3234 underlies the upper 38 and the foot-receiving cavity 47 defined by the upper 38. A lower portion 40 of the footwear upper 38 is secured to the sole layer 3234, such as by adhesive or otherwise. The base 22 is secured to the sole layer 3234 such as by bonding with adhesive, thermal bonding, or otherwise.

Figure 83:
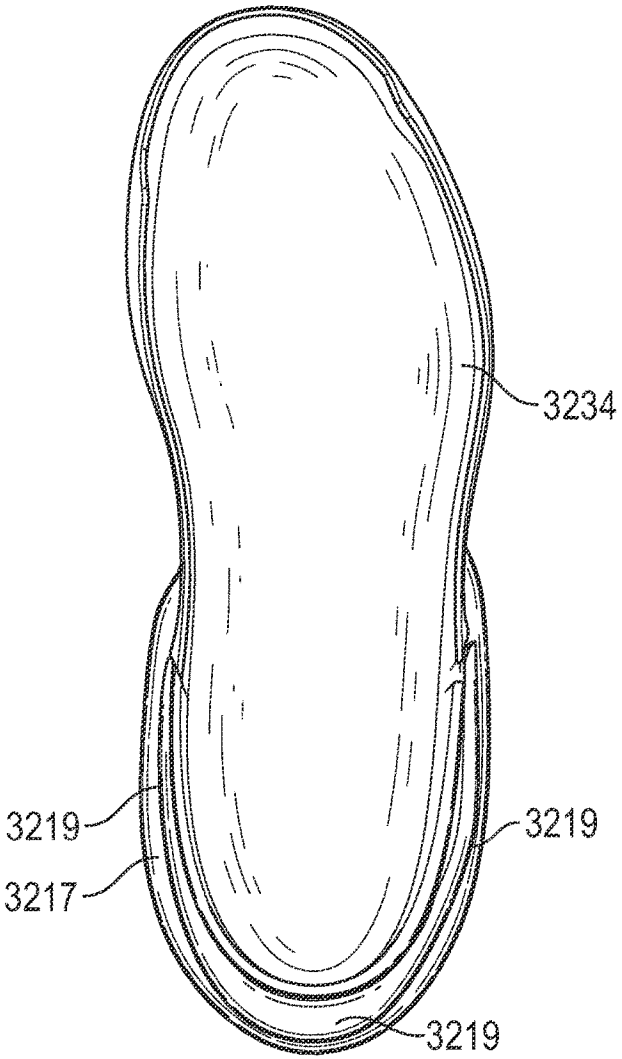
FIG. 83 is a plan view of a midsole of the article of footwear of FIG. 80.

As best shown in FIG. 83, the sole layer 3234 has a slight recess 3219 in the outer wall 3217 of the sole layer 3234 (i.e., in the outer side walls and rear wall in the heel region of the sole layer 3234). The recess 3219 is shaped to allow the base 22 and joints 3224A, 3224B to partially nest in the recess 3219. The portions of the base 22 and the joints 3224A, 3224B nested in the recess 3219 are secured to the outer wall 3217 of the sole layer 3234 in the recess 3219. The device 3210 is thus supported by the sole layer 3234 in the recess 3219.

The control bar 14 is biased to an unloaded position shown in FIGS. 80 and 82. The unloaded position is also referred to herein as an unstressed position. The control bar 14 is internally biased to the unstressed position by its material in its formed state. Stated differently, the material of the control bar 14 is sufficiently rigid that it remains in the unstressed position in its natural state without external loads applied to it, and will return to the unstressed position after elastic bending due to its resiliency. In the unstressed position, the center segment 16 is a first distance D1 from the bottom of the center segment 26 of the base 22, as indicated in FIG. 80 by a distance D1 from the top of the center segment 16 of the control bar 14 to the bottom of the center segment 26 of the base 22. The unstressed position is the position of the device 3210 in a relaxed, unloaded state (i.e., without a vertical force applied to the control bar 14). The control bar 14 can be depressed under an applied force F shown in FIG. 80, representing the force applied by a foot during insertion of the foot into the foot-receiving cavity 47 (see, e.g., FIGS. 5 and 6) of the article of footwear 3212. When loaded in this manner, the control bar 14 elastically bends to a loaded position in which the top of the center segment 16 is a second distance D2 from the bottom of the center segment 26 of the base 22. The loaded position is shown in FIG. 80, in which the control bar 14 and the center segment 16 are indicated with phantom lines, and the center segment is indicated with reference number 16A in FIG. 80. The second distance D2 is less than the first distance D1. The difference between the distances D1 and D2 is the deflection of the device 3210, which may be but is not limited to a deflection of 30 mm. The device 3210 is configured so that when it is depressed under the force F to the loaded position D2, it elastically bends at the junction 3224A, 3224B, storing elastic energy. When the force F is removed, the stored elastic energy returns the control bar 14 to the unstressed position. Like device 10, the first side arm 18 and the second side arm 20 extend at a first acute angle A1 to the common plane P of the base 22 when the control bar 14 is in the unloaded position. The first side arm 18 and the second side arm 20 extend at a second acute angle A2 to the common plane P of the base 22 when the control bar 14 is depressed. The second acute angle A2 is less than the first acute angle A1.

As best indicated in FIG. 82, the base 22 extends around a rearmost portion of the footwear upper 38 from the lateral side 43 to the medial side 41. As indicated in FIG. 82, the device 3210 is not secured to the upper 38 at the medial side 41 or the lateral side 43. Instead, the device 3210 is only secured to the upper 38 via a heel tab 3249 that extends through an aperture 3245 in the center segment 16. The tab 3249 is then stitched to a rear portion 3247 of the upper 38 at stitching 3241. A decorative snap 3243 may be secured to the tab 3249. However, in the embodiment shown, the decorative snap 3243 is merely decorative in that it does not snap or otherwise fasten to the upper 38.

Figure 84:
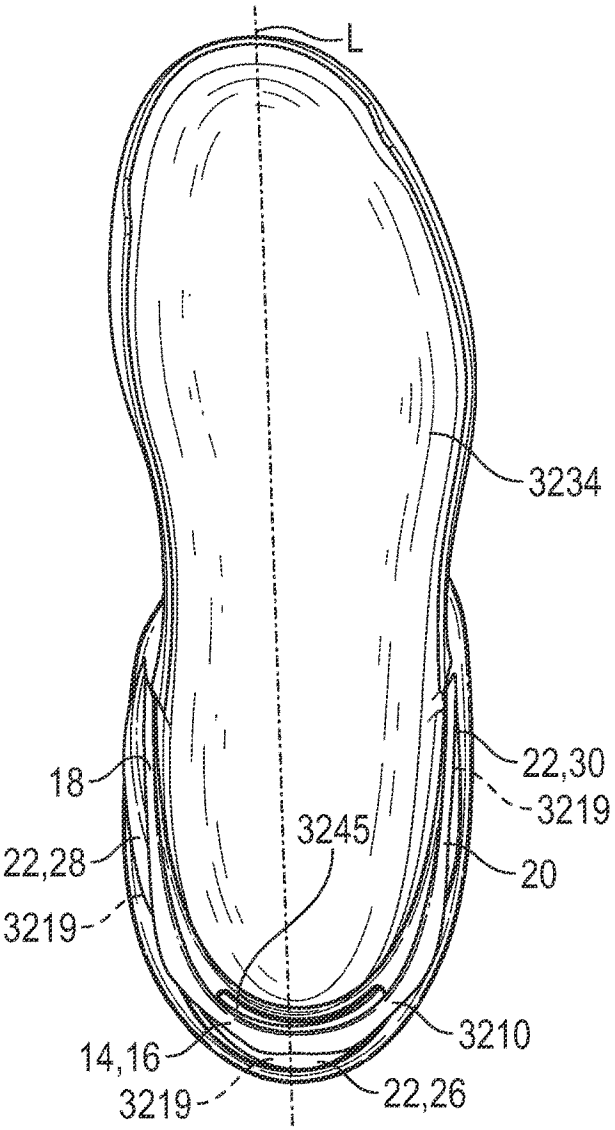
FIG. 84 is a plan view of the midsole of FIG. 83 with the heel spring device of FIG. 79 nested in a recess in the midsole.

FIG. 84 best illustrates that the medial side arm 18 and the lateral side arm 20 are asymmetrical about a longitudinal axis L extending between the medial side arm 18 and the lateral side arm 20 through the base 22. The medial side arm 18 is also referred to herein as a first side arm, and the lateral side arm 20 is also referred to as a second side arm. The medial side arm 18 may be shorter than the lateral side arm 20 and may have a greater lateral (i.e., outward) curvature than the lateral side arm, similar to the shape of a typical heel region of a foot. Because the heel device 3210 is asymmetrically shaped in this manner following a typical foot shape, pressure of the heel device 3210 against the sides of the foot during wear is thus minimized.

Figure 85:
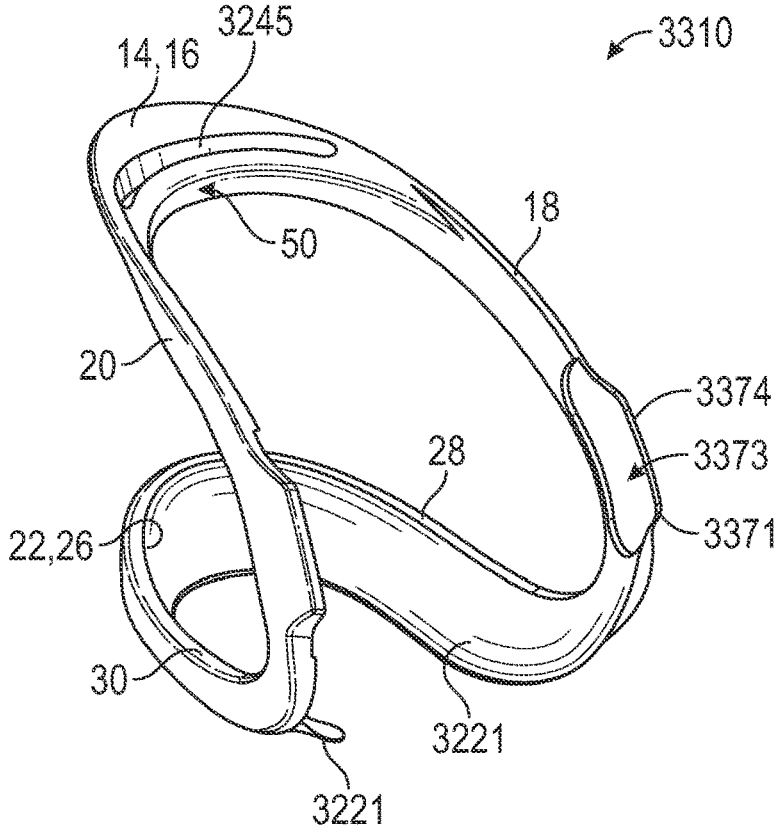
FIG. 85 is a schematic illustration in perspective view of an alternative embodiment of a heel spring device in an unloaded position.
Figure 86:
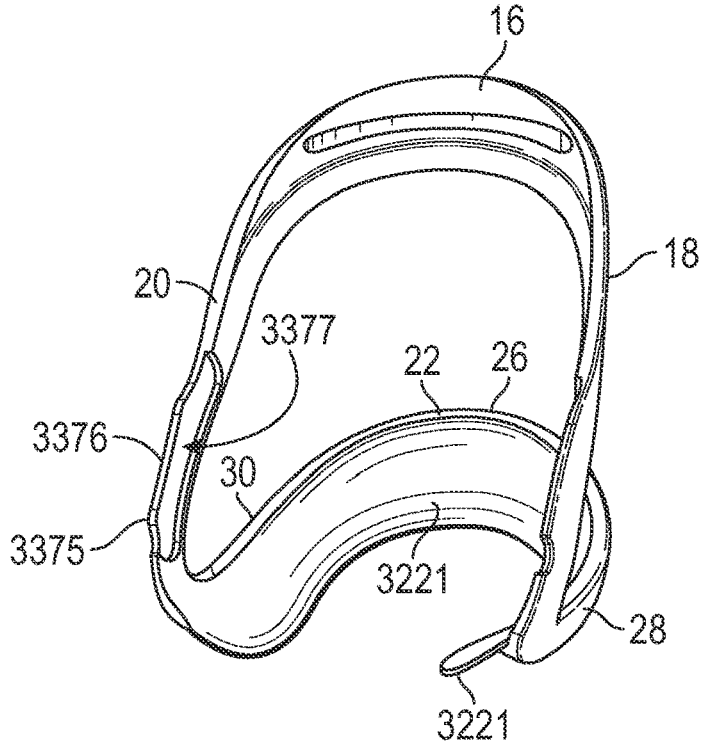
FIG. 86 is a schematic illustration in another perspective view of the heel spring device of FIG. 85.

FIGS. 85-86 illustrate another embodiment of a heel spring device 3310 that has many of the same features as heel spring device 10, 3210, which features are referenced with like reference numbers. Additionally, the base 22 has an inwardly-extending flange 3221 that extends continuously from the medial base side arm 28, around the center segment 26 to the lateral base side arm 30 such that the flange 3221 generally has a U-shape.

Figure 87:
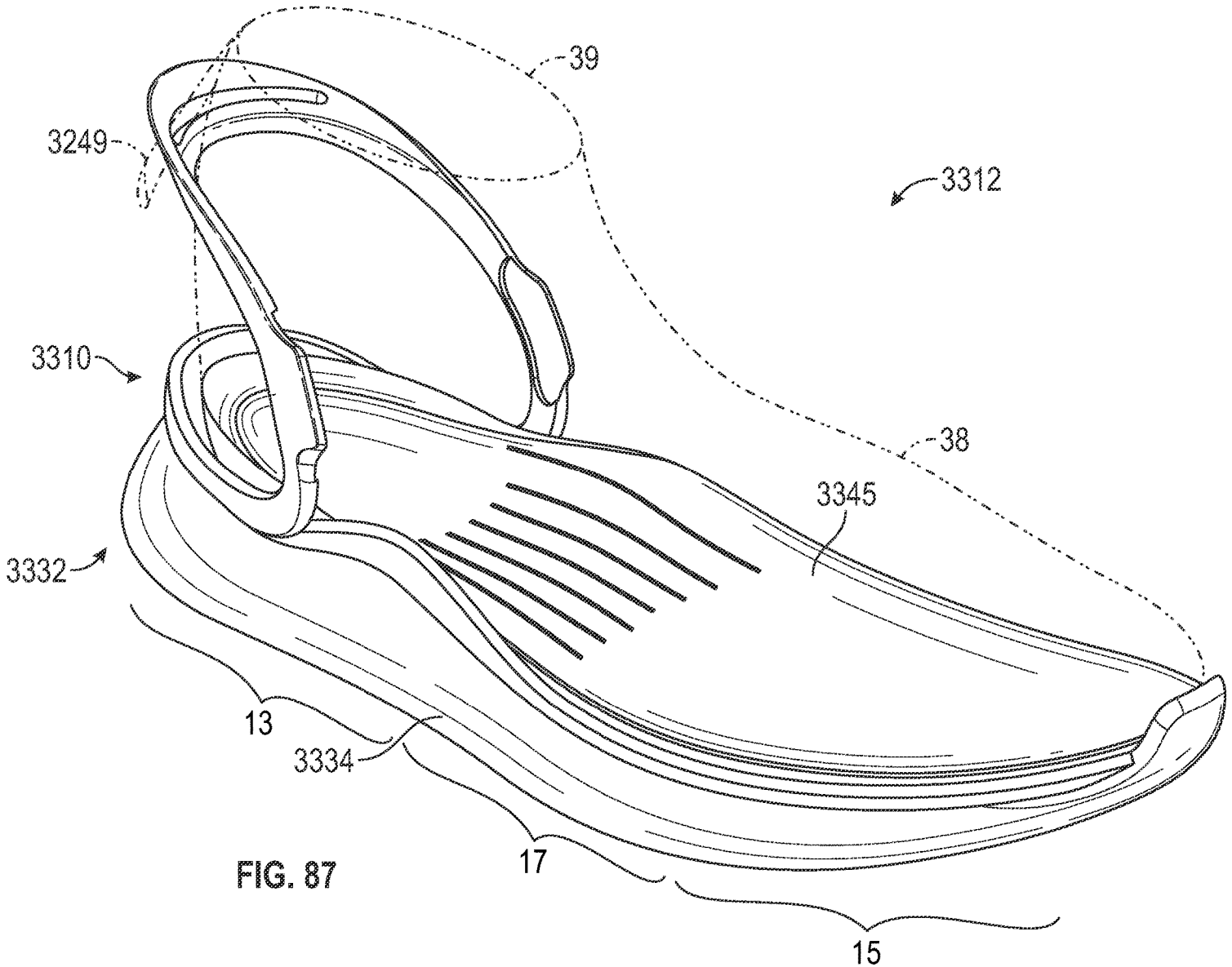
FIG. 87 is a schematic illustration of an article of footwear with the heel spring device of FIG. 85 and showing an upper in phantom.
Figure 90:
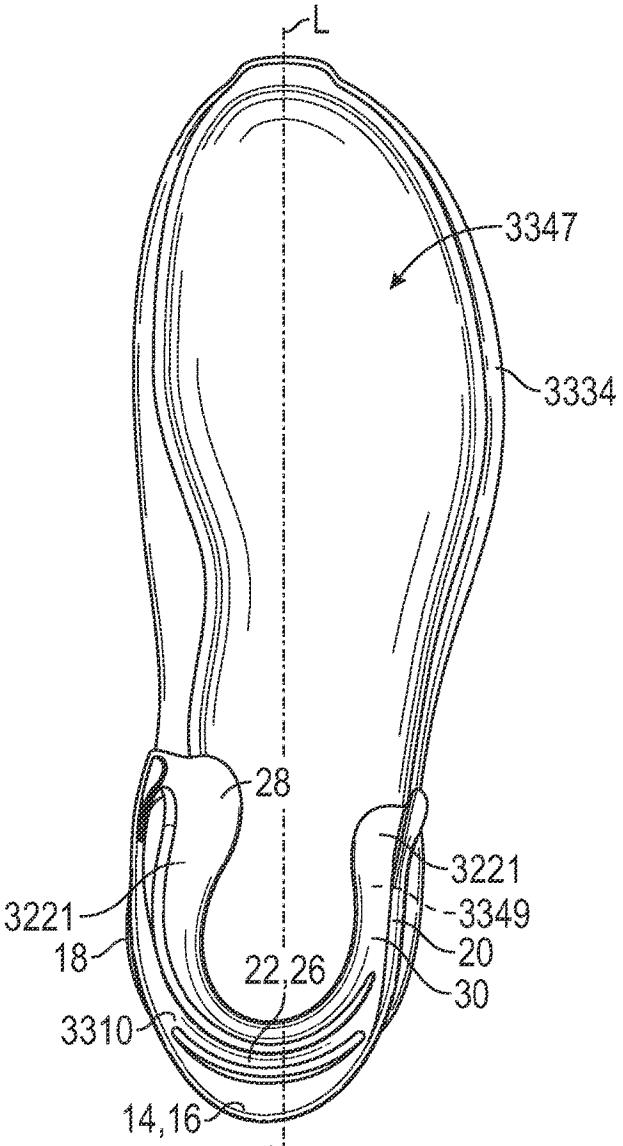
FIG. 90 is a schematic illustration in plan view of the heel spring device of FIG. 85 nested in a recess of the midsole of FIG. 89.
Figure 89:
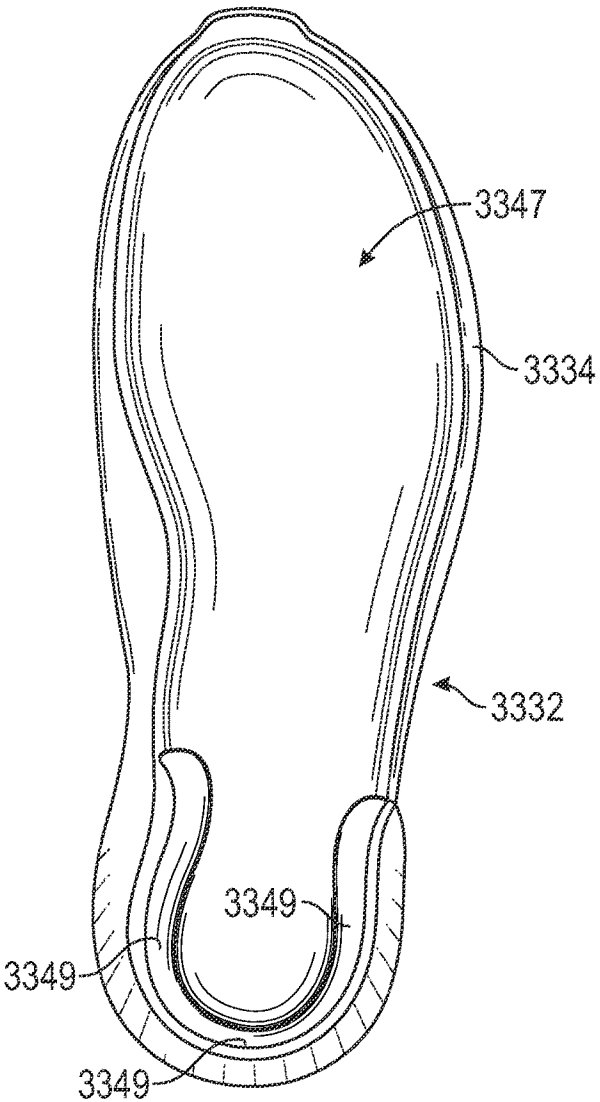
FIG. 89 is a schematic plan view illustration of a midsole of the article of footwear of FIG. 87.

With reference to FIG. 87, the heel spring device 3310 is included in an article of footwear 3312 that has an upper 38 and a sole structure 3332. The upper 38 is as described herein with respect to heel spring device 10, and is shown only in phantom in FIG. 87. The sole structure 3332 includes an outer sole layer 3334 that may serve as a unitary outsole and midsole. The sole structure 3332 also includes an inner sole layer 3345, also referred to as an insole, that overlays the sole layer 3334. FIG. 89 shows the sole layer 3334 alone with the inner sole layer 3345 removed. The sole layer 3334 has a recess 3349 in an upper surface 3347. The recess 3349 is shaped so that the flange 3221 is seated in and at least partially nested in the recess 3349, and secured to the upper surface 3347 in the heel region of the sole structure 3332. FIG. 90 shows the flange 3221 seated in the recess 3349. The heel spring device 3310 is secured to the sole layer 3334 by securing the flange 3221 to upper surface 3347 of the sole layer 3334 in the recess 3349 by thermal bonding, by adhesive, or otherwise. The inner sole layer 3345 is then inserted in the upper 38 to rest on the sole layer 3334 over the flange 3221 and at the upper surface 3347 of the sole layer 3334.

As best indicated in FIG. 90, the heel spring device 3310 is asymmetric about the longitudinal axis L. More specifically, the medial side arm 18 curves laterally outward more than the lateral side arm 20, and is also longer in a fore-aft direction (along the longitudinal axis L) than the lateral side arm 20. As discussed with respect to heel spring device 3210, this is a more anatomical shape than a symmetrical heel spring device, and avoids undesirable friction and pressure of the side arms 18, 20 on the foot.

Figure 88:
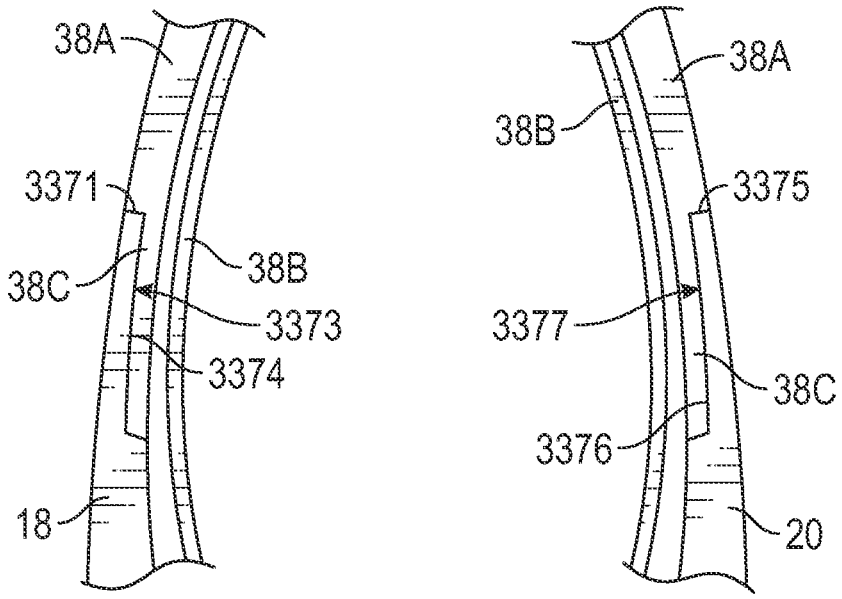
FIG. 88 is a schematic fragmentary plan view of arms of the heel spring device of FIG. 85 connected with a component of a footwear upper.

The heel spring device 3310 is configured to secure to the upper 38 at forwardmost portions of the side arms 18, 20, and via a heel tab extending through an aperture 3245 of the center segment 16 as indicated with respect to the upper 38 shown in phantom in FIG. 87. More specifically, a forwardmost portion 3371 of an inner surface 3373 of the first side arm 18 includes a medial recess 3374 such that the first side arm 18 is thinner at the medial recess 3374 than rearward of the medial recess 3374. A forwardmost portion 3375 of an inner surface 3377 of the second side arm 20 includes a lateral recess 3376 such that the second side arm 20 is thinner at the lateral recess 3376 than rearward of the lateral recess 3376. The upper 38 may be secured to the first side arm 18 at the medial recess 3374 and to the second side arm 20 at the lateral recess 3376. For example, the upper 38 may be bonded to the side arms 18, 20 at the recesses 3374, 3376. In some embodiments, the upper may include an inner portion 38B, and an outer portion 38A, as shown in FIG. 88. In such embodiments, the outer portion 38A may include rearward-extending flanges 38C that are thinner than more forward portions of the outer portion 38A. The flanges 38C interfit with and are secured to the inner surfaces 3373, 3377 of the side arms 18, 20 in the recesses 3374, 3376. The outer portion 38A may be less flexible than the inner portion 38B, and may thus provide better anchoring support to the device 3310 at the arms 18, 20 than would the inner portion 38B.

Figure 91:
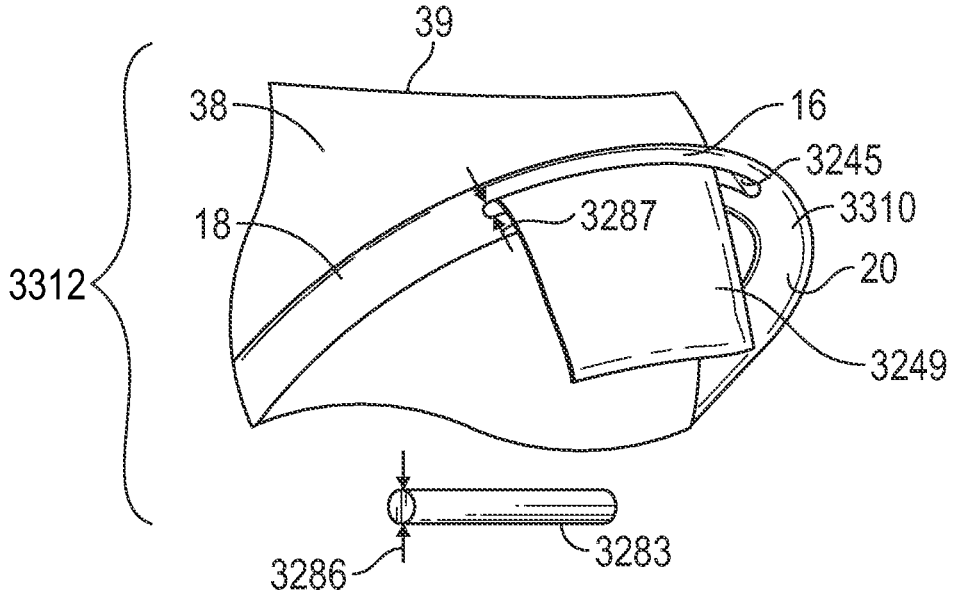
FIG. 91 is an exploded fragmentary view of the heel spring device of FIG. 85 with a tab of the upper extending through an aperture in the heel spring device, and showing a pin.
Figure 92:
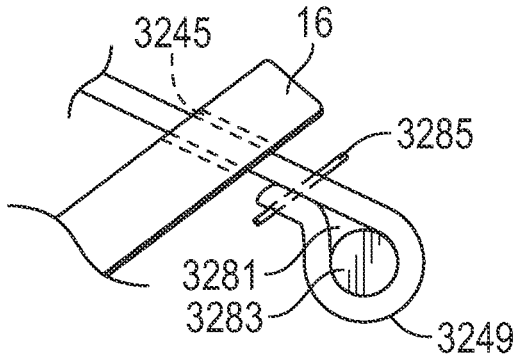
FIG. 92 is a fragmentary view of the heel spring device of FIG. 85 with the tab secured in a loop and with the pin inserted in the loop.

In addition to attaching to the upper 38 (or outer portion 38A) at the forwardmost portions 3371, 3375, the upper 38 may be secured to the heel spring device 3310 via a heel tab 3249 (see FIGS. 87 and 91). The heel tab 3249 extends through an aperture 3245 in the center segment 16. After the tab 3249 is extended through the aperture 3245, the tab 3249 may be folded over in a loop and stitched to itself at stitching 3285 as shown in FIG. 92. A pin 3283 may then be inserted into an opening 3281 in the loop of the tab 3249. The pin 3283 may be secured to the tab 3249 in the opening 3281 rearward of the aperture 3245, such as by inserting adhesive into the opening 3281. The tab 3249 with the pin 3283 therein may be wider than the aperture 3245. For example, the pin 3283 has a width 3286 (see FIG. 91) which is greater than the width 3287 of the aperture 3245. With the pin 3283 inserted into the looped tab 3249, after pulling the tab 3249 through the aperture 3245, the pin 3283 helps retain the tab 3249 in its position extended through the aperture 3245 and therefore helps to secure the upper 38 to the device 3310 via the tab 3249. The tab 3249 is thus anchored to the center segment 16 by the pin 3283.

Figure 93:
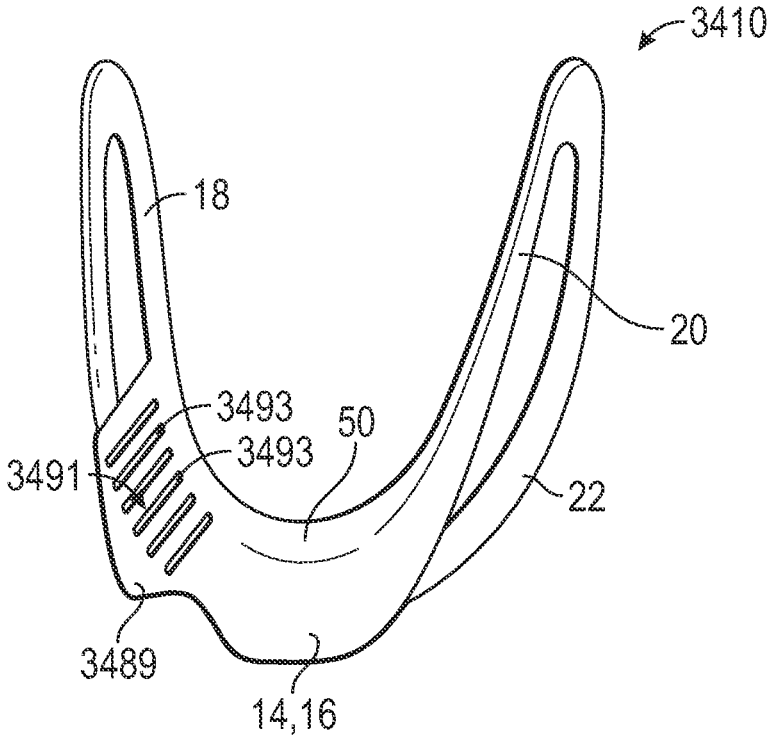
FIG. 93 is a schematic illustration in plan view of an alternative embodiment of a heel spring device.
Figure 94:
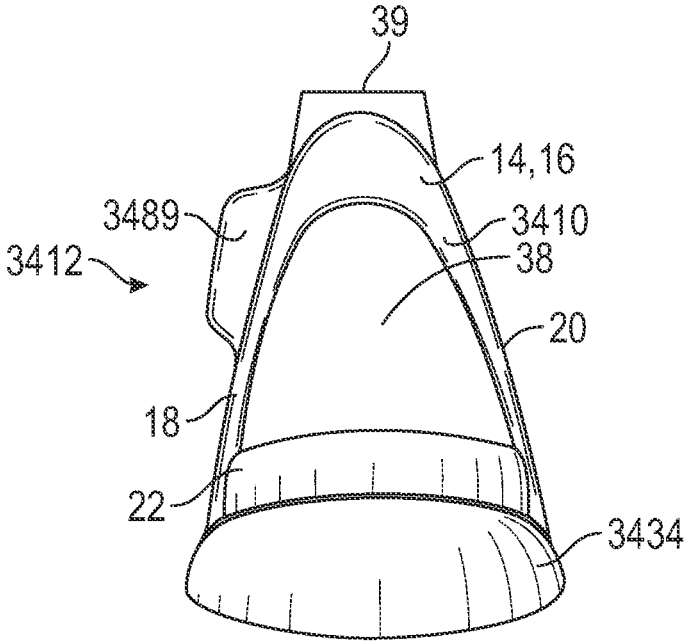
FIG. 94 is a schematic illustration in rear view of an article of footwear including the heel spring device of FIG. 93.

FIGS. 93-94 show a heel spring device 3410 that has many of the same features as heel spring devices 10 and 3210. Like reference numbers are used to refer to such features. The device 3410 includes a lever 3489 that extends laterally outward from the control bar 14. The lever 3489 may also be referred to as a ledge extension or a shelf. The lever 3489 is disposed partly along the medial side arm 18 and partly along the center segment 16. Within the scope of the present disclosure, the lever 3489 may be disposed anywhere along the control bar 14. The lever 3489 has an upward-facing surface 3491 that may be depressed downward, in a similar manner as described with respect to force F on the center segment 16 in FIG. 80. Depressing the lever 3489 facilitates depression of the control bar 14 from the unstressed position to the stressed position. The surface 3491 has recessed grooves 3493 such that the surface 3491 is not smooth, enhancing the ability to grip the surface 3491 when depressing the lever 3489. FIG. 94 shows a rear view of an article of footwear 3412 that includes the device 3410 secured to a sole layer 3434 and to the upper 38.

The various embodiments of heel spring devices disclosed herein enhance the ease of foot entry, allowing hands free foot entry into an article of footwear.

The following Clauses provide example configurations of an article of footwear, a device, and a footwear upper disclosed herein.

Clause 1: A device configured to surround a portion of a foot-receiving cavity at a heel region of an article of footwear, the device comprising a control bar having a center segment, a first side arm extending from the center segment, and a second side arm spaced from the first side arm and extending from the center segment; a continuous base supporting the control bar and connected to both of the first side arm and the second side arm; and wherein the control bar is biased to an unstressed position with the center segment a first distance from the base, the control bar elastically deforms under an applied force to a loaded position with the center segment a second distance from the base less than the first distance, and the device stores potential energy that returns the control bar to the unstressed position upon removal of the applied load.

Clause 2: The device of Clause 1, wherein the base is connected to the first side arm at a first joint, and the base is connected to the second side arm at a second joint.

Clause 3: The device of Clause 2, wherein: the control bar has an arced shape from the first joint to the second joint; the base has an arced shape from the first joint to the second joint; and the control bar and the base are configured as a full elliptical leaf spring.

Clause 4: The device of any of Clauses 2-3, wherein: the base has a center segment, a first base arm, and a second base arm all disposed in a common plane; the first base arm is spaced apart from the second base arm and both extend from the center segment of the base; the first base arm and the first side arm are connected at the first joint; the second base arm and the second side arm are connected at the second joint; the first side arm and the second side arm extend at an acute angle to the common plane of the base when the control bar is in the unstressed position; the first side arm and the second side arm extend at a second acute angle to the common plane of the base when the control bar is in the loaded position; and the second acute angle is less than the first acute angle.

Clause 5: The device of any of Clauses 1-4, wherein the center segment of the control bar has a ramped surface that declines toward an inner periphery of the center segment between the first side arm and the second side arm.

Clause 6: The device of any of Clauses 1-5, wherein the first side arm and the second side arm are each twisted outwardly along their respective longitudinal axis from the base to the center segment of the control bar.

Clause 7: The device of any of Clauses 1-6, wherein the first side arm and the second side arm are asymmetrical about a longitudinal axis extending between the first side arm and the second side arm through the base.

Clause 8: The device of any of Clauses 1-7, wherein the base has an inwardly-extending flange.

Clause 9: The device of Clause 8 in combination with a footwear sole structure having a foot-receiving surface with a recess in a heel region; and wherein the flange is seated in the recess and secured to the foot-receiving surface.

Clause 10: The device of any of Clauses 1-7 in combination with a footwear sole structure having an outer wall with a recess in a heel region; and wherein the base of the device at least partially nests in the recess and is secured to the outer wall of the sole structure.

Clause 11: The device of any of Clauses 1-10 in combination with a footwear upper that defines at least a portion of an ankle opening, wherein the base underlies the control bar with the first side arm at a medial side of the footwear upper, the second side arm at a lateral side of the footwear upper, and the center segment of the control bar rearward of the ankle opening.

Clause 12: The device of Clause 11, wherein a forwardmost portion of an inner surface of the first side arm includes a medial recess such that the first side arm is thinner at the medial recess than rearward of the medial recess, and a forwardmost portion of an inner surface of the second side arm includes a lateral recess such that the second side arm is thinner at the lateral recess than rearward of the lateral recess; and wherein the upper is secured to the second side arm at the lateral recess, and to the first side arm at the medial recess.

Clause 13: The device of any of Clauses 1-12, wherein the center segment has an aperture; and wherein the footwear upper includes a tab that extends through the aperture.

Clause 14: The device of Clause 13, wherein the tab is secured to a rear portion of the footwear upper.

Clause 15: The device of Clause 13, further comprising: a pin secured to the tab rearward of the aperture, wherein the tab with the pin thereon is wider than the aperture such that the tab is anchored to the center segment by the pin.

Clause 16: The device of any of Clauses 1-15, further comprising: a lever extending outward from the control bar.

Clause 17: The device of any of Clauses 1-16, wherein the first side arm and the second side arm each have at least one slot extending therethrough.

Clause 18: The device of Clause 17, wherein the control bar includes a series of slats each extending along the first side arm, the center segment, and the second side arm, and wherein the at least one slot includes a series of slots, each extending along the first side arm, the center segment, and the second side arm and disposed between respective adjacent ones of the slats.

Clause 19: The device of any of Clauses 1-16, wherein the device comprises a bladder element including one or more fluid-filled interior cavities.

Clause 20: The device of Clause 19, wherein: the one or more fluid-filled interior cavities include: cavities extending along the center segment; and one or more reservoirs disposed at either or both of the first side arm and the second side arm and in fluid communication with the cavities extending along the center segment; and the one or more reservoirs expand with fluid displaced from the cavities extending along the center segment when the heel spring device resiliently deforms under the applied force.

Clause 21: The device of any of Clauses 1-18, wherein the first side arm and the second side arm bow apart from one another when the control bar is in the loaded position.

Clause 22: The device of any of Clauses 1-18, wherein: one of the control bar and the base has an extension that extends toward the other of the control bar and the base; and the extension is spaced apart from the other of the control bar and the base when the control bar is in the unstressed position, and contacts the other of the control bar and the base when the control bar is in the loaded position, limiting further depression of the control bar.

Clause 23: The device of Clause 22, wherein: the extension extends from the center segment of the control bar toward the base; the base has a recess; and the extension is spaced apart from the base when the control bar is in the unstressed position, and protrudes into the recess when the control bar is in the loaded position.

Clause 24: The device of Clause 11, wherein the control bar is embedded within the footwear upper.

Clause 25: The device of Clause 11, wherein the base has a forward-extending protrusion underlying the foot-receiving void adjacent the medial side of the footwear upper, and a rearward extending protrusion underlying the foot-receiving void along the lateral side of the footwear upper.

Clause 26: The device of Clause 1, wherein the base couples to forwardmost portions of the first side arm and the second side arm.

Clause 27: The device of Clause 1, wherein the base extends rearward from the control bar.

Clause 28: The device of Clause 1, wherein the base extends forward from the control bar.

Clause 29: The device of Clause 1, wherein the base is a sole structure of an article of footwear.

Clause 30: The device of Clause 1, wherein the base is a flexible footwear upper.

Clause 31: The device of any of Clauses 1-30, wherein the device is a single, unitary, one-piece component.

Clause 32: A device for easing foot entry into an article of footwear and configured to surround a portion of a foot-receiving cavity at a heel region of an article of footwear, the device comprising: a control bar and a base underlying the control bar; wherein the control bar includes a series of slats each having: a center segment; a medial side arm extending from the center segment to a medial end connected to a medial side of the base; and a lateral side arm extending from the center segment to a lateral end connected to a lateral side of the base; and wherein the control bar is biased to an unloaded position and elastically bends under an applied force to a loaded position in which at least one center segment is closer to the base than in the unloaded position, storing potential energy that returns the control bar to the unloaded position upon removal of the applied load.

Clause 33: The device of Clause 32, wherein the control bar and the base are configured as a full elliptical leaf spring.

Clause 34: The device of any of Clauses 32 and 33, wherein: the control bar defines slots extending between the slats; the slats are spaced apart from one another by the slots when the control bar is in the unloaded position; and one or more of the slots close between the slats so that one or more adjacent center segments contact one another in the loaded position.

Clause 35: The device of Clause 34, wherein: the slots are parallel with one another; and exterior sides of the slats are flush with one another in the unloaded position.

Clause 36: The device of any of Clauses 32-35, wherein a lowermost one of the slats closest to the base at the center segment is shorter from the medial end to the lateral end than an uppermost one of the slats furthest from the center segment; and wherein the lowermost one of the slats is thinner than the uppermost one of the slats.

Clause 37: The device of any of Clauses 32-36, wherein a lowermost one of the slats has a tab extending from a lower edge of the center segment.

Clause 38: The device of any of Clauses 32-37, wherein an outer surface of the base has a peripheral recess extending from a lower edge of the base.

Clause 39: The device of any of Clauses 32-38, further comprising: a resilient insert at least partially filling the slots.

Clause 40: The device of Clause 39, wherein the resilient insert includes: a sleeve extending along an inner side of the slats; and spaced protrusions extending from the sleeve into the slots.

Clause 41: The device of Clause 39, wherein the resilient insert is configured as bellows that extend outward between the slats from an inner side of the slats.

Clause 42: The device of any of Clauses 39-41, wherein the resilient insert comprises at least one of rubber or thermoplastic polyurethane.

Clause 43: A device for easing foot entry into an article of footwear and configured to surround a portion of a foot-receiving cavity at a heel region of an article of footwear, the device comprising: an elastic corrugated body including a center segment, a medial side arm extending forwardly from the center segment, and a lateral side arm extending forwardly from the center segment; wherein the corrugated body includes alternating ridges and grooves that extend lengthwise along the medial side arm, the center segment, and the lateral side arm; and wherein the corrugated body is biased to an unloaded position and compresses under an applied force to a loaded position in which one or more adjacent ones of the alternating ridges are closer to one another than in the unloaded position, storing elastic energy that returns the corrugated body to the unloaded position upon removal of the applied load.

Clause 44: The device of Clause 43, wherein: the corrugated body comprises bellows; and the ridges are pleats of the bellows and the grooves are folds of the bellows.

Clause 45: The device of Clause 44, wherein: a first set of the ridges and grooves extend from the medial side arm to the lateral side arm, and a second set of the ridges and grooves extend only along the center segment.

Clause 46: The device of any of Clauses 43-45, further comprising an upper flange extending along an upper edge of the corrugated body at the center segment.

Clause 47: The device of any of Clauses 43-46, further comprising a lower flange extending along a lower edge of the corrugated body at the medial arm, the center segment, and the lateral arm.

Clause 48: The device of any of Clauses 43-47, wherein the corrugated body is at least one of rubber or thermoplastic polyurethane.

Clause 49: An article of footwear comprising: an upper defining at least a portion of an ankle opening; a sole structure secured to and underlying the upper; and a heel spring device comprising: a center segment secured to the upper rearward of the ankle opening; a medial side arm extending downwardly and forwardly from the center segment; a lateral side arm extending downwardly and forwardly from the center segment; and a base connected to both of the medial side arm and the lateral side arm; wherein the base is secured to the sole structure; and wherein the center segment is biased to an unloaded position, the heel spring device resiliently deforms under an applied force to a loaded position in which the center segment is closer to the base than in the unloaded position, and the heel spring device stores elastic energy that returns the center segment to the unloaded position upon removal of the applied load, the upper moving with the center segment such that the ankle opening is closer to the sole structure when the center segment is in the loaded position than when the center segment is in the unloaded position.

Clause 50: The article of footwear of Clause 49, wherein: the sole structure includes a midsole; and the base is partially recessed into the midsole.

Clause 51: The article of footwear of any of Clauses 49-50, wherein the medial side arm is secured to a medial side of the upper, and the lateral side arm is secured to a lateral side of the upper.

Clause 52. The article of footwear of Clause 51, wherein the medial side arm and the lateral side arm bow laterally outward and apart from one another when the center segment is in the loaded position, widening the ankle opening.

Clause 53: The article of footwear of any of Clauses 49-52, wherein the center segment is spaced apart from the base in the unloaded position, and the device is characterized by the absence of a rigid heel counter between the center segment and the base aft of a junction of the medial side arm and the base, and aft of a junction between the lateral side arm and the base.

Clause 54: The article of footwear of any of Clauses 49-53, wherein the medial side arm and the lateral side arm are each twisted outwardly along their respective longitudinal axis from the base to the center segment.

Clause 55: The article of footwear of any of Clauses 49-54, wherein: one of the center segment and the base has an extension that extends at least partially toward the other of the center segment and the base; and the extension is spaced apart from the other of the center segment and the base when the center segment is in the unloaded position.

Clause 56: The article of footwear of Clause 55, wherein: the extension extends from the center segment at least partially toward the base; the base has a recess; and the extension is spaced apart from the base when the center segment is in the unloaded position, and protrudes into the recess when the center segment is in the loaded position.

Clause 57: The article of footwear of Clause 55, wherein the extension extends from the center segment at least partially toward the base; and further comprising: a strap having a proximal end secured to the upper and a pocket at a distal end; and the extension is disposed in the pocket with the strap overlaying the center segment.

Clause 58: The article of footwear of any of Clauses 49-57, wherein: an outer surface of the base has a peripheral recess extending from a lower edge of the base; and the sole structure has a flange seated in the peripheral recess.

Clause 59: The article of footwear of any of Clauses 49-58, wherein the center segment has a ramped surface that declines toward an inner periphery of the center segment between the medial side arm and the lateral side arm.

Clause 60: The article of footwear of any of Clauses 49-59, wherein the heel spring device is a single, unitary, one-piece component.

Clause 61. The article of footwear of Clause 49, wherein the heel spring device comprises a bladder element including one or more fluid-filled interior cavities.

Clause 62: The article of footwear of Clause 61, wherein: the one or more fluid-filled interior cavities include: cavities extending along the center segment; and one or more reservoirs disposed at either or both of the medial side arm and the lateral side arm and in fluid communication with the cavities extending along the center segment; and the one or more reservoirs expand with fluid displaced from the cavities extending along the center segment when the heel spring device resiliently deforms under the applied force.

Clause 63: A footwear upper comprising: a flexible covering defining at least a portion of an ankle opening; a heel spring device comprising: a control bar having: a center segment secured to the flexible covering rearward of the ankle opening; a medial side arm extending from the center segment and secured to a medial side of the flexible covering; and a lateral side arm extending from the center segment and secured to a lateral side of the flexible covering; and a continuous base supporting the control bar and connected to both of the medial side arm and the lateral side arm; and wherein the control bar is biased to an unstressed position with the center segment a first distance from the base, the control bar elastically deforms under an applied force to a loaded position with the center segment a second distance from the base less than the first distance, and the heel spring device stores potential energy that returns the control bar to the unstressed position upon removal of the applied load.

Clause 64: The footwear upper of Clause 63, wherein the flexible covering is an elastically stretchable fabric, and further comprising a collar secured to the flexible covering and defining a front portion of the ankle opening; wherein the collar is stiffer than the elastically stretchable fabric.

Clause 65: The footwear upper of any of Clauses 63-64, further comprising: a heel pull tab secured to the flexible covering; wherein the center segment of the control bar has an aperture, and the heel pull tab extends through the aperture.

Clause 66: The footwear upper of any of Clauses 63-65, wherein the medial side arm and the lateral side arm bow laterally outward and apart from one another when the center segment is in the loaded position, widening the ankle opening of the flexible covering.

Clause 67: The footwear upper of any of Clauses 63-66, characterized by the absence of a rigid heel counter between the control bar and the base aft of a junction between the control bar and the base.

Clause 68: The footwear upper of any of Clauses 63-67, wherein the medial side arm and the lateral side arm are each twisted outwardly along their respective longitudinal axis from the base to the center segment of the control bar.

Clause 69: The footwear upper of any of Clauses 63-68, wherein: one of the control bar and the base has an extension that extends toward the other of the control bar and the base; and the extension is spaced apart from the other of the control bar and the base when the control bar is in the unstressed position, and contacts the other of the control bar and the base when the control bar is in the loaded position, limiting further depression of the control bar.

Clause 70: The footwear upper of Clause 69, wherein: the center segment of the control bar has the extension extending toward the base; the base has a recess; and the extension is spaced apart from the base when the control bar is in the unstressed position, and protrudes into the recess when the control bar is in the loaded position.

Clause 71: The footwear upper of any of Clauses 63-70, wherein the center segment of the control bar has a ramped surface that declines toward an inner periphery of the center segment between the medial side arm and the lateral side arm.

Clause 72: The footwear upper of any of Clauses 63-71, wherein the heel spring device is a single, unitary, one-piece component.

Clause 73: The footwear upper of Clause 63, wherein the heel spring device comprises a bladder element including one or more fluid-filled interior cavities.

Clause 74: The footwear upper of Clause 73, wherein: the one or more fluid-filled interior cavities include: cavities extending along the center segment; and one or more reservoirs disposed at either or both of the medial side arm and the lateral side arm and in fluid communication with the cavities extending along the center segment; and the one or more reservoirs expand with fluid displaced from the cavities extending along the center segment when the heel spring device resiliently deforms under the applied force.

Clause 75: An article of footwear comprising: a footwear upper including a flexible covering defining at least a portion of an ankle opening; a sole structure secured to and underlying the footwear upper; a heel spring device comprising: a control bar having: a center segment secured to the flexible covering rearward of the ankle opening; a medial side arm extending downwardly and forwardly from the center segment along a medial side of the footwear upper; and a lateral side arm extending downwardly and forwardly from the center segment along a lateral side of the footwear upper; and a spring operatively connected to the control bar and biasing the control bar to an unstressed position; and wherein the control bar pivots rearward under an applied force to a loaded position, storing potential energy in the spring that returns the control bar to the unstressed position upon removal of the applied load, the flexible covering moving with the control bar.

Clause 76: The article of footwear of Clause 75, further comprising: a pin connected to both of the medial side arm and the lateral side arm and extending through the sole structure; and wherein the spring is wound around the pin and has an end fixed to pivot with the control bar and another end fixed relative to the control bar.

Clause 77: An article of footwear comprising: a footwear upper including a flexible covering defining at least a portion of an ankle opening; a sole structure secured to and underlying the footwear upper; a heel spring device comprising: a rear control bar having: a center segment secured to the flexible covering rearward of the ankle opening; a medial side arm extending downwardly and forwardly from the center segment along a medial side of the footwear upper; and a lateral side arm extending downwardly and forwardly from the center segment along a lateral side of the footwear upper; a front bar having: a center segment secured to the flexible covering forward of the ankle opening; a medial side arm extending downwardly and rearwardly from the center segment along a medial side of the footwear upper; and a lateral side arm extending downwardly and rearwardly from the center segment along a lateral side of the footwear upper; wherein the front bar and the rear control bar cross at and are fixed to one another at the lateral side of the footwear upper and at the medial side of the footwear upper; and wherein the rear control bar pivots rearward under an applied force to a loaded position, storing potential energy that returns the rear control bar to the unstressed position upon removal of the applied load, the flexible covering moving with the rear control bar.

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above", "below", "upward", "downward", "top", "bottom", etc., may be used descriptively relative to the figures, without representing limitations on the scope of the invention, as defined by the claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. An article of footwear comprising:

a footwear upper defining a foot-receiving cavity with a heel region and defining an ankle opening;

a sole structure secured to the footwear upper and underlying the foot-receiving cavity; and a device surrounding a portion of the foot-receiving cavity at the heel region, the device extending between a medial side and a lateral side of the article of footwear, and extending from the sole structure toward the ankle opening;

wherein the device includes a center portion, a medial side portion extending forwardly from the center portion, and a lateral side portion extending forwardly from the center portion;

wherein the medial side portion and the lateral side portion taper in height in a direction away from the center portion; and wherein the footwear upper is joined with the device such that the article of footwear comprises an exterior-facing corrugated surface in the heel region in an unloaded position with an absence of applied downward force on the device.

2. The article of footwear of claim 1, wherein, under the applied downward force on the device, the ankle opening tilts rearward.

3. The article of footwear of claim 1, wherein the device comprises at least one of rubber, thermoplastic polyurethane, or a resilient foam.

4. The article of footwear of claim 1, wherein the device has an inner surface with a concavity at the inner surface in both medial-lateral and vertical directions.

5. The article of footwear of claim 1, wherein:

an upper portion of the device is secured to the footwear upper; and/or a lower portion of the device is secured to the footwear upper; and/or the lower portion of the device is secured to the sole structure.

6. The article of footwear of claim 1, wherein the device is a single, unitary, one-piece component.

7. The article of footwear of claim 1, wherein the device is stitched to the upper.

8. The article of footwear of claim 1, wherein the device is adhered or thermally bonded to the upper.

9. An article of footwear comprising:

a footwear upper defining at least a portion of a foot-receiving cavity and defining an ankle opening at the foot-receiving cavity;

a sole structure secured to and underlying the footwear upper; and a device configured to surround a portion of the foot-receiving cavity at a heel region of the article of footwear, the device including:

an upper portion rearward of the ankle opening; and a lower portion adjacent to the sole structure and disposed below the upper portion and rearward of the foot-receiving cavity, the device extending from the lower portion to the upper portion;

wherein, at a cross-section extending along a longitudinal midline of the article of footwear, an exterior-facing surface of the article of footwear in the heel region has a plurality of ridges and grooves at the upper portion and the lower portion;

wherein the device includes a center portion, a medial side portion extending forwardly from the center portion, and a lateral side portion extending forwardly from the center portion; and wherein the medial side portion and the lateral side portion taper in height in a direction away from the center portion.

10. The article of footwear of claim 9, wherein, under an applied downward force on the device, the ankle opening tilts rearward.

11. The article of footwear of claim 9, wherein the device comprises at least one of rubber, thermoplastic polyurethane, or a resilient foam.

12. The article of footwear of claim 9, wherein the device has an inner surface with a concavity at the inner surface in both medial-lateral and vertical directions.

13. The article of footwear of claim 9, wherein:

an upper portion of the device is secured to the footwear upper; and/or a lower portion of the device is secured to the footwear upper; and/or the lower portion of the device is secured to the sole structure.

14. The article of footwear of claim 9, wherein the device is stitched to the footwear upper.

15. The article of footwear of claim 9, wherein the device is adhered or thermally bonded to the footwear upper.

16. The article of footwear of claim 9, wherein the device is a single, unitary, one-piece component.

* * * * *